US005652076A

United States Patent [19]

Kato et al.

[11] Patent Number: 5,652,076

[45] Date of Patent: Jul. 29, 1997

[54] METHOD FOR PREPARATION OF PRINTING PLATE BY ELECTROPHOTOGRAPHIC PROCESS

[75] Inventors: Eiichi Kato; Hiroyuki Oishi; Kazuo Ishii, all of Shizuoka, Japan

[73] Assignee: Fuji Photo Film Co., Ltd., Kanagawa, Japan

[21] Appl. No.: 660,129

[22] Filed: Jun. 7, 1996

[30] Foreign Application Priority Data

Jun. 9, 1995 [JP] Japan ..... 7-143596

[51] Int. Cl.[6] ..... G03G 13/16; G03G 13/28

[52] U.S. Cl. ..... 430/49; 430/126

[58] Field of Search ..... 430/49, 126

[56] References Cited

U.S. PATENT DOCUMENTS

| | | | |
|---|---|---|---|
| 3,847,642 | 11/1974 | Rhodes | 430/126 |
| 3,999,481 | 12/1976 | Sankus | 430/126 |
| 5,176,974 | 1/1993 | Till et al. | 430/42 |
| 5,370,960 | 12/1994 | Cahill et al. | 430/126 |
| 5,501,929 | 3/1996 | Kato et al. | 430/49 |
| 5,526,102 | 6/1996 | Kato | 430/126 |
| 5,561,014 | 10/1996 | Kato | 430/49 |
| 5,582,941 | 12/1996 | Kato et al. | 430/126 |
| 5,589,308 | 12/1996 | Kato et al. | 430/49 |

FOREIGN PATENT DOCUMENTS

| | | | |
|---|---|---|---|
| 0078476 | 5/1983 | European Pat. Off. | 430/126 |

*Primary Examiner*—Roland Martin

*Attorney, Agent, or Firm*—Sughrue, Mion, Zinn, Macpeak & Seas

[57] ABSTRACT

A method for preparation of a printing plate by an electrophotographic process comprising providing a peelable transfer layer (T) containing a resin (A) capable of being removed upon a chemical reaction treatment on an electrophotographic light-sensitive element, forming a toner image on the transfer layer by an electrophotographic process, providing an adhesive layer (M) containing a thermoplastic resin (B) only on the toner image, transferring the toner image together with the transfer layer (T) and the adhesive layer (M) from the electrophotographic light-sensitive element to a receiving material having a surface capable of providing a hydrophilic surface suitable for lithographic printing at the time of printing, and then removing the transfer layer (T) on the receiving material by the chemical reaction treatment.

According to the method, printing plates which produces prints of good image qualities can be continuously obtained in a stable manner for a long period of time even when the transfer is conducted under conditions of low temperature, low pressure and high speed.

30 Claims, 3 Drawing Sheets

METHOD FOR PREPARATION OF PRINTING PLATE BY ELECTROPHOTOGRAPHIC PROCESS

FIELD OF THE INVENTION

The present invention relates to a method for preparation of a printing plate by an electrophotographic process, and more particularly to a method for preparation of a lithographic printing plate by an electrophotographic process including formation, transfer and removal of a transfer layer wherein the toner image is easily and completely transferred and good image qualities are maintained during a plate-making process thereby providing a printing plate which produces prints of good image qualities.

BACKGROUND OF THE INVENTION

Owing to the recent technical advancements of image processing by a computer, storage of a large amount of data and data communication, input of information, revision, edition, layout, and pagination are consistently computerized, and electronic editorial system enabling instantaneous output on a remote terminal plotter through a high speed communication network or a communications satellite has been practically used.

Light-sensitive materials having high photosensitivity which may provide direct type printing plate precursors directly preparing printing plates based on the output from a terminal plotter include electrophotographic light-sensitive materials.

In order to form a lithographic printing plate using an electrophotographic light-sensitive material, a method wherein after the formation of toner image by an electrophotographic process, non-image areas are subjected to oil-desensitization with an oil-desensitizing solution to obtain a lithographic printing plate, and a method wherein after the formation of toner image, a photoconductive layer is removed in non-image areas to obtain a lithographic printing plate are known.

However, in these method, since the light-sensitive layer is subjected to treatment for rendering it hydrophilic to form hydrophilic non-image areas or removed by dissolving out it in the non-image areas to expose an underlying hydrophilic surface of support, there are various restrictions on the light-sensitive material, particularly a photoconductive compound and a binder resin employed in the photoconductive layer. Further, printing plates obtained have several problems on their image qualities or durability.

In order to solve these problems there is proposed a method comprising providing a transfer layer composed of a thermoplastic resin capable of being removed upon a chemical reaction treatment on a surface of an electrophotographic light-sensitive element, forming a toner image on the transfer layer by a conventional electrophotographic process, transferring the toner image together with the transfer layer onto a receiving material capable of forming a hydrophilic surface suitable for a lithographic printing, and removing the transfer layer to leave the toner image on the receiving material whereby a lithographic printing plate is prepared as described in WO 93/16418.

Since the method for preparation of printing plate using a transfer layer is different from the method for forming hydrophilic non-image areas by modification of the surface of light-sensitive layer or dissolution of the light-sensitive layer, and comprises the formation of toner image not on the light-sensitive layer but on the transfer layer, the transfer of toner image together with the transfer layer onto another support having a hydrophilic surface and the removal of the transfer layer by a chemical reaction treatment, printing plates having good image qualities are obtained without various restrictions on the photoconductive layer employed as described above.

However, it is important in the above-described method to wholly transfer the toner image and transfer layer onto the receiving material even when the transfer layer has a reduced thickness or the transfer is conducted at low temperature and/or pressure or at a high transfer speed, since a good image quality is not obtained by the method if the toner image and transfer layer remain on the light-sensitive element.

Further, in case of using an original of a high image area ratio (ratio of the image area to the total of image area and non-image area), adhesion of toner image to a receiving material is adversely affected depending on the kind of toner used to form the image and thus transferability of toner image is disadvantageously deteriorated.

SUMMARY OF THE INVENTION

The present invention is to solve the above-described various problems associated with conventional plate-making techniques.

An object of the present invention is to provide a method for preparation of a printing plate by an electrophotographic process in which transferability of toner image is so good even under a moderate transfer condition of temperature and/or pressure at a high transfer speed that printing plates of excellent image qualities are continuously obtained in a stable manner.

Other objects of the present invention will become apparent from the following description.

It has been found that the above described objects of the present invention are accomplished by a method for preparation of a printing plate by an electrophotographic process comprising providing a peelable transfer layer (T) containing a resin (A) capable of being removed upon a chemical reaction treatment on an electrophotographic light-sensitive element, forming a toner image on the transfer layer by an electrophotographic process, providing an adhesive layer (M) containing a thermoplastic resin (B) only on the toner image, transferring the toner image together with the transfer layer (T) and the adhesive layer (M) from the electrophotographic light-sensitive element to a receiving material having a surface capable of providing a hydrophilic surface suitable for lithographic printing at the time of printing, and then removing the transfer layer (T) on the receiving material by the chemical reaction treatment.

BRIEF DESCRIPTION OF THE ACCOMPANYING DRAWINGS

Figure 1:
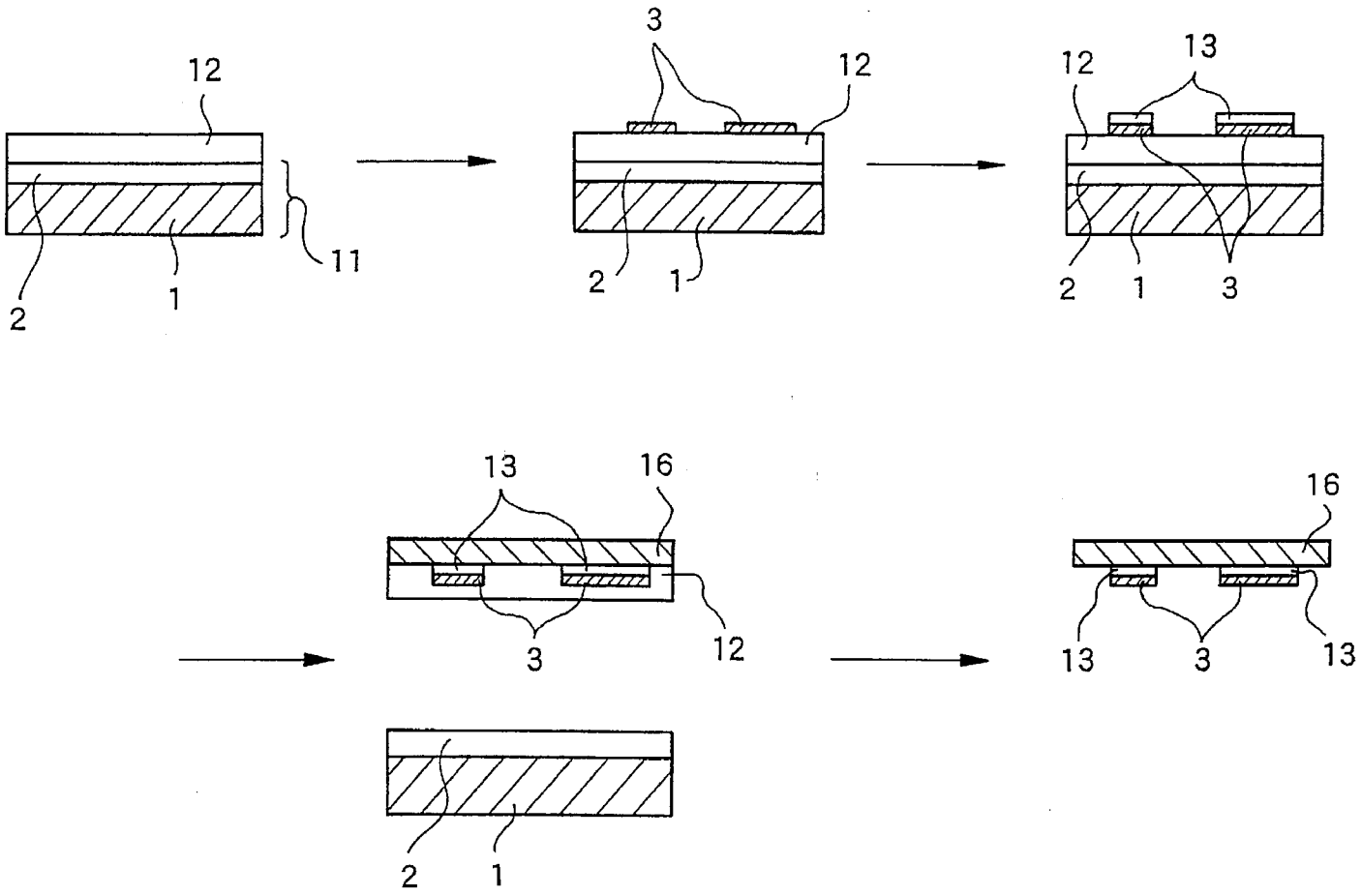
FIG. 1 is a schematic view for explanation of the method according to the present invention.

Explanation of the Symbols:

1 Support of light-sensitive element
2 Light-sensitive layer
3 Toner image
10 Applying unit for compound (S)
11 Light-sensitive element
12 Transfer layer (T)
12α Dispersion of resin grains for forming transfer layer (T)
12D Electrodeposition unit for forming transfer layer (T)
12β Resin for forming transfer layer (T)
12H Hot-melt coater
12W Stand-by position of hot melt coater
13 Adhesive layer (M)
13α Dispersion of resin grains for forming adhesive layer (M)
13M Electrodeposition unit for forming adhesive layer (M)
14 Liquid developing unit set
14L Liquid developing unit
15 Suction/exhaust unit
15*a* Suction part
15*b* Exhaust part
16 Receiving material
17 Transfer unit to receiving material
17*a* Heating means
17*b* Backup roller for transfer
17*c* Backup roller for release
18 Corona charger
19 Exposure device
20 Release paper
117 Transfer unit to light-sensitive element
117*b* Heating roller
117*c* Cooling roller

DETAILED DESCRIPTION OF THE INVENTION

The method for preparation of a printing plate by an electrophotographic process according to the present invention will be diagrammatically described with reference to FIG. 1 of the accompanying drawings.

As shown in FIG. 1, the method for preparing a printing plate comprises providing a transfer layer (T) 12 comprising a resin (A) on an electrophotographic light-sensitive element 11 having at least a support 1 and a light-sensitive layer 2, which transfer layer has weak adhesion to the surface of electrophotographic light-sensitive element so as to be easily released from the electrophotographic light-sensitive element in the transfer step, forming a toner image 3 thereon by a conventional electrophotographic process, providing an adhesive layer (M) 13 which has good adhesion to a receiving material 16 only on the toner image 3 so that the toner image 3 is put between the transfer layer (T) 12 and the adhesive layer (M) 13, transferring the toner image 3 together with the transfer layer (T) 12 and the adhesive layer (M) 13 onto the receiving material 16 which is a support for a lithographic printing plate to prepare a printing plate precursor, and the removing the transfer layer (T) by a chemical reaction treatment and leaving the toner image 3 and the adhesive layer (M) 13 thereunder on the receiving material 16 to prepare a lithographic printing plate.

The method of the present invention is characterized in that the toner image is sandwiched between the transfer layer (T) and the adhesiver layer (M) at the time of transfer.

According to the method of the present invention, the transfer layer (T) acts on easy and complete transfer of the toner image from the surface of electrophotographic light-sensitive element to a receiving material and the adhesive layer (M) provided on the toner image sufficiently adheres to the receiving material, whereby the toner image even in high definition regions (i.e., fine lines, fine letters and dots of continuous tone) is transferred to the receiving material without distortion or shear in the image. Further, the toner image is stably transferred on the receiving material even when an original of a high image area ratio is used or when the kind of toner used for the image is varied, since the adhesive layer (M) is brought into contact with the receiving material and thus the adhesion of the image to the receiving material is constantly maintained. Moreover, good transferability is exhibited under transfer conditions of low temperature and/or pressure, and high speed. Furthermore, the image is easily transferred in spite of the kind of receiving material.

Now, the electrophotographic light-sensitive element which can be used in the present invention will be described in detail below.

Any conventionally known electrophotographic light-sensitive element can be employed. What is important is that the surface of electrophotographic light-sensitive element has the releasability at the time for the formation of transfer layer (T) so as to easily release afterward the transfer layer to be formed thereon together with a toner image.

More specifically, an electrophotographic light-sensitive element wherein an adhesion of the surface thereof measured according to the method described below is not more than 50 gram·force (g·f) is preferably employed.

The measurement of adhesion is conducted according-to JIS Z 0237-1980 8.3.1. 180 Degrees Peeling Method with the following modifications:

(i) As a test plate, an electrophotographic light-sensitive element on which a transfer layer is to be formed is used.
(ii) As a test piece, a pressure sensitive adhesive tape of 6 mm in width prepared according to JIS C2338-1984 is used.
(iii) A peeling rate is 120 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width.

The adhesive strength of the surface of electrophotographic light-sensitive element is more preferably not more than 30 g·f, and particularly preferably not more than 10 g·f.

Using such an electrophotographic light-sensitive element having the controlled adhesion, a transfer layer formed on the light-sensitive element easily transferred together with a toner image onto a receiving material.

While an electrophotographic light-sensitive element which has already the surface exhibiting the desired releasability can be employed in the present invention, it is also possible to cause a compound (S) containing at least a fluorine atom and/or a silicon atom to adsorb or adhere onto the surface of electrophotographic light-sensitive element for imparting the releasability thereto before the formation of transfer layer. Thus, conventional electrophotographic light-sensitive elements can be utilized without taking releasability of the surface thereof into consideration.

Further, when releasability of the surface of electrophotographic light-sensitive element tends to decrease during repeated use of the light-sensitive element having the surface releasability according to the present invention, the method for adsorbing or adhering a compound (S) can be applied. By the method, the releasability of electrophotographic light-sensitive element is easily maintained.

In order to obtain an electrophotographic light-sensitive element having a surface of the releasability, there are a method of selecting an electrophotographic light-sensitive element previously having such a surface of the releasability (first method), a method of imparting the releasability to a surface of electrophotographic light-sensitive element conventionally employed by causing the compound (S) for imparting releasability to adsorb or adhere onto the surface of electrophotographic light-sensitive element (second method), and a method of imparting the releasability and forming a transfer layer (T) at once onto a surface of electrophotographic light-sensitive element by an electrodeposition coating method using a dispersion of resin (A) containing the compound (S) (third method).

Suitable examples of the electrophotographic light-sensitive elements previously having the surface of releasability used in the first method include those employing a photoconductive substance which is obtained by modifying a surface of amorphous silicon to exhibit the releasability.

For the purpose of modifying the surface of electrophotographic light-sensitive element mainly containing amorphous silicon to have the releasability, there is a method of treating a surface of amorphous silicon with a coupling agent containing a fluorine atom and/or a silicon atom (for example, a silane coupling agent or a titanium coupling agent) as described, for example, in JP-A-55-89844, JP-A-4-231318, JP-A-60- 170860, JP-A-59-102244 and JP-A-60-17750 (the term "JP-A" herein used means an unexamined published Japanese patent application). Also, a method of adsorbing and fixing the compound (S) according to the present invention, particularly a releasing agent containing a component having a fluorine atom and/or a silicon atom as a substituent in the form of a block (for example, a polyether-, carboxylic acid-, amino group- or carbinol-modified polydialkylsilicone) as described in detail below can be employed.

Further, another example of the electrophotographic light-sensitive elements previously having the surface of releasability is an electrophotographic light-sensitive element containing a polymer having a polymer component containing a fluorine atom and/or a silicon atom in the region near to the surface thereof.

The term "region near to the surface of electrophotographic light-sensitive element" used herein means the uppermost layer of the electrophotographic light-sensitive element and includes an overcoat layer provided on a photoconductive layer, and the uppermost photoconductive layer. Specifically, an overcoat layer which contains the above-described polymer to impart the releasability is provided on the electrophotographic light-sensitive element having a photosensitive layer as the uppermost layer, or the above-described polymer is incorporated into the uppermost layer of a photoconductive layer (including a single photoconductive layer and a laminated photoconductive layer) to modify the surface thereof so as to exhibit the releasability. By using such an electrophotographic light-sensitive element, a transfer layer can be easily and completely transferred together with a toner image since the surface of the electrophotographic light-sensitive element has the good releasability.

In order to impart the releasability to the overcoat layer or the uppermost photoconductive layer, a polymer containing a silicon atom and/or a fluorine atom is used as a binder resin of the layer. It is preferred to use a small amount of a block copolymer containing a polymer segment comprising a silicon atom and/or fluorine atom-containing polymer component described in detail below (hereinafter referred to as a surface-localized type copolymer sometimes) in combination with other binder resins. Further, such polymers containing a silicon atom and/or a fluorine atom are employed in the form of grains.

In the case of providing an overcoat layer, it is preferred to use the above-described surface-localized type block copolymer together with other binder resins of the layer for maintaining sufficient adhesion between the overcoat layer and the photoconductive layer.

The surface-localized type copolymer is ordinarily used in a proportion of from 0.1 to 20 parts by weight per 100 parts by weight of the total composition of the overcoat layer, or in a proportion of from 0.5 to 30 parts by weight per 100 parts by weight of the total composition of the uppermost photoconductive layer.

Specific examples of the overcoat layer include a protective layer which is a surface layer provided on an electrophotographic light-sensitive element for protection known as one means for ensuring durability of the surface of electrophotographic light-sensitive element for a plain paper copier (PPC) using a dry toner against repeated use. For instance, techniques relating to a protective layer using a silicon type block copolymer are described, for example, in JP-A-61-95358, JP-A-55-83049, JP-A-62-87971, JP-A-61-189559, JP-A-62-75461, JP-A-62-139556, JP-A-62-139557, and JP-A-62-208055. Techniques relating to a protective layer using a fluorine type block copolymer are described, for example, in JP-A-61-116362, JP-A-61-117563, JP-A-62-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type electrophotographic light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component as a block and resin grains containing a fluorine atom and/or silicon atom-containing polymer component, whereby the resin material migrates to the surface portion of the layer and is localized in situ to have the surface imparted with the releasability. The copolymers and resin grains which can be used include those described in European Patent Application No. 534,479Al.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the photoconductive layer. Examples of such polymer segments containing a photo- and/or heat-curable group-containing component are described in European Patent Application No. 534,479Al. Alternatively, a photo- and/or heat-curable resin may be used in combination with the fluorine atom and/or silicon atom-containing resin in the present invention.

The polymer comprising a polymer component containing a fluorine atom and/or a silicon atom effectively used for modifying the surface of the electrophotographic light-sensitive element according to the present invention include a resin (hereinafter referred to as resin (P) sometimes) and resin grains (hereinafter referred to as resin grains (PL) sometimes).

Where the polymer containing a fluorine atom and/or silicon atom-containing polymer component used in the present invention is a random copolymer, the content of the fluorine atom and/or silicon atom-containing polymer component is preferably at least 60% by weight, and more preferably at least 80% by weight based on the total polymer component.

In a preferred embodiment, the above-described polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks. More preferably, the polymer segment (β) of the block copolymer contains at least one polymer component containing at least one photo- and/or heat-curable functional group.

It is preferred that the polymer segment (β) does not contain any fluorine atom and/or silicon atom-containing polymer component.

As compared with the random copolymer, the block copolymer comprising the polymer segments (α) and (β) (surface-localized type copolymer) is more effective not only for improving the surface releasability but also for maintaining such releasability.

More specifically, where a film is formed in the presence of a small amount of the resin or resin grains of copolymer containing a fluorine atom and/or a silicon atom, the resins (P) or resin grains (PL) easily migrate to the surface portion of the film and are localized in situ by the end of a drying step of the film to thereby modify the film surface so as to exhibit the releasability.

Where the resin (P) is the block copolymer in which the fluorine atom and/or silicon atom-containing polymer segment (α) exists as a block, the other polymer segment (β) containing no, or if any a small proportion of, fluorine atom and/or silicon atom-containing polymer component undertakes sufficient interaction with the film-forming binder resin since it has good compatibility therewith. Thus, during the formation of transfer layer (T) on the electrophotographic light-sensitive element, further migration of the resin into the transfer layer (T) is inhibited or prevented by an anchor effect to form and maintain the definite interface between the transfer layer and the electrophotographic light-sensitive element.

Further, where the segment (β) of the block copolymer contains a photo- and/or heat-curable group, crosslinking between the polymer molecules takes place during the film formation to thereby ensure retention of the releasability at the interface of the electrophotographic light-sensitive element.

As a preferred embodiment of the surface-localized type copolymer in the resin (P) according to the present invention, any type of the block copolymer can be used as far as the fluorine atom and/or silicon atom-containing polymer component is contained as a block. The term "to be contained as a block" means that the polymer has the polymer segment (α) containing at least 50% by weight of the fluorine atom and/or silicon atom-containing polymer component. The forms of blocks include an A-B type block, an A-B-A type block, a B-A-B type block, a graft type block, and a starlike type block.

With respect to the surface-localized type copolymer, preparation thereof and application thereof to an electrophotographic light-sensitive element, reference can be made to JP-A-5-197169.

Now, the second method for obtaining an electrophotographic light-sensitive element having the surface of releasability by applying the compound (S) for imparting the desired releasability to the surface of a conventionally known electrophotographic light-sensitive element before the formation of transfer layer (T) will be described in detail below.

The compound (S) is a compound containing a fluorine atom and/or a silicon atom. The compound (S) containing a moiety having a fluorine and/or silicon atom is not particularly limited in its structure as long as it can improve releasability of the surface of electrophotographic light-sensitive element, and includes a low molecular weight compound, an oligomer, and a polymer.

When the compound (S) is an oligomer or a polymer, the moiety having a fluorine and/or silicon atom includes that incorporated into the main chain of the oligomer or polymer and that contained as a substituent in the side chain thereof. Of the oligomers and polymers, those containing repeating units containing the moiety having a fluorine and/or silicon atom as a block are preferred since they adsorb on the surface of electrophotographic light-sensitive element to impart good releasability.

The fluorine atom and/or silicon atom-containing moieties include those described with respect to the resin (P) above.

Specific examples of the compound (S) containing a fluorine and/or silicon atom which can be used in the present invention include fluorine and/or silicon-containing organic compounds described, for example, in Tokiyuki Yoshida, et al. (ed.), *Shin-ban Kaimenkasseizai Handbook,* Kogaku Tosho (1987), Takao Karikome, *Saishin Kaimenkasseizai Oyo Gijutsu,* C.M.C. (1990), Kunio Ito (ed.), *Silicone Handbook,* Nikkan Kogyo Shinbunsha (1990), Takao Karikome, *Tokushukino Kaimenkasseizai,* C.M.C. (1986), and A. M. Schwartz, et al., *Surface Active Agents and Detergents,* Vol. II.

Further, the compound (S) according to the present invention can be synthesized by utilizing synthesis methods as described, for example, in Nobuo Ishikawa, *Fussokagobutsu no Gosei to Kino,* C.M.C. (1987), Jiro Hirano et al. (ed.), *Ganfussoyukikagobutsu— Soho Gosei to Oyo,* Gijutsu Joho Kokai (1991), and Mitsuo Ishikawa, *Yukikeiso Senryaku Shiryo,* Chapter 3, Science Forum (1991).

Specific examples of polymer components having the fluorine atom and/or silicon atom-containing moiety used in the oligomer or polymer include those described with respect to the resin (P) above.

When the compound (S) is a so-called block copolymer, the compound (S) may be any type of copolymer as far as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The forms of blocks include an A-B type block, an A-B-A type block, a B-A-B type block, a graft type block, and a starlike type block as illustrated with respect to the resin (P) above. These block copolymers can be synthesized according to the methods described with respect to the resin (P) above.

By the application of compound (S) onto the surface of electrophotographic light-sensitive element, the surface is modified to have the desired releasability. The term "application of compound (S) onto the surface of electrophotographic light-sensitive element" means that the compound is supplied on the surface of electrophotographic light-sensitive element to form a state wherein the compound (S) is adsorbed or adhered thereon.

In order to apply the compound (S) to the surface of electrophotographic light-sensitive element, conventionally known various methods can be employed.

The application of compound (S) is preferably performed by a means which is easily incorporated into an electrophotographic apparatus to conduct the electrophotographic process.

An amount of the compound (S) applied to the surface of electrophotographic light-sensitive element is not particularly limited and is adjusted in a range wherein the electrophotographic characteristics of electrophotographic light-sensitive element do not adversely affected in substance. Ordinarily, a thickness of the coating is sufficiently 1 μm or less. By the formation of weak boundary layer as defined in Bikerman, *The Science of Adhesive Joints,* Academic Press (1961), the releasability-imparting effect of the present invention can be obtained. Specifically, when the adhesion of the surface of an electrophotographic light-sensitive element to which the compound (S) has been applied is measured according to the method described above, the resulting adhesive strength is preferably not more than 50 g·f.

In accordance with the present invention, the surface of electrophotographic light-sensitive element is provided with the desired releasability by the application of compound (S), and the electrophotographic light-sensitive element can be repeatedly employed as far as the releasability is maintained. Specifically, the application of compound (S) is not always necessarily whenever a series of steps for the preparation of a printing plate according to the present invention is repeated. The application may be suitably performed by an appropriate combination of an electrophotographic light-sensitive element, an ability of compound (S) for imparting the releasability and a means for the application.

With respect to the compound (S) and application thereof to an electrophotographic light-sensitive element, reference can be made to JP-A-7-5727.

The third method for obtaining an electrophotographic light-sensitive element having a surface of the desired releasability comprises conducting an electrodeposition coating method using a dispersion of resin grains for forming the transfer layer (T), to which a compound (S) exhibiting the desired releasability is added. According to the method, the dispersion for electrodeposition containing the compound (S) is subjected to electrodeposition on a conventionally known electrophotographic light-sensitive element, thereby providing the releasability on the surface of electrophotographic light-sensitive element as well as the formation of transfer layer (T).

More specifically, the dispersion for electrodeposition used comprises an electrically insulating organic solvent having a dielectric constant of not more than 3.5, grains of resin (A) dispersed therein and the compound (S) exhibiting the desired releasability.

The compound (S) present in the dispersion for electrodeposition is able to adhere to or adsorb on the surface of electrophotographic light-sensitive element before the electrodeposition of resin grains on the surface of the electrophotographic light-sensitive element by electrophoresis and as a result, the electrophotographic light-sensitive element having the surface of desired releasability is obtained before the formation of transfer layer (T).

The compounds (S) used are same as the compound (S) described in the second method above in substance. Of the compounds (S), those soluble at least 0.005 g per one liter of the electrically insulating organic solvent used in the dispersion for electrodeposition at 25° C. are preferred, and those soluble 0.01 g or more per one liter of the solvent are more preferred.

The amount of compound (S) added to the dispersion for electrodeposition may by varied depending on the compound (S) and the electrically insulating organic solvent to be used. A suitable amount of the compound (S) is determined taking the effect to be obtained and adverse affects on electrophoresis of resin grains (e.g., decrease in electric resistance or increase in viscosity of the dispersion) into consideration. A preferred range of the compound (S) added is ordinarily from 0.01 to 20 g pen one liter of the electrically insulating organic solvent used.

With respect to the third method, reference can be made to JP-A-7-64356.

The construction and material used for the electrophotographic light-sensitive element according to the present invention are not particularly limited and any of those conventionally known can be employed.

Suitable examples of electrophotographic light-sensitive element used are described, for example, in Denshishashin Gakkai (ed.), *Denshishashin Gijutsu no Kiso to Oyo,* Corona (1988), Hiroshi Kokado (ed.), *Saikin no Kododen Zairyo to Kankotai no Kaihatsu·Jitsuyoka,* Nippon Kagaku Joho (1985), Takaharu Shibata and Jiro Ishiwatari, *Kobunshi,* Vol. 17, p. 278 (1968), Harumi Miyamoto and Hidehiko Takei, *Imaging,* Vol. 1973, No. 8, Denshishashin Gakkai (ed.), *Denshishashinyo Yuki-kankotai no Genjo Symposium* (preprint) (1985), R. M. Schaffert, *Electrophotography,* Forcal Press, London (1980), S. W. Ing, M. D. Tabak and W. E. Haas, *Electrophotography Fourth International Conference,* SPSE (1983), Isao Shinohara, Hidetoshi Tsuchida and Hideaki Kusakawa (ed.), *Kirokuzairyo to Kankoseijushi,* Gakkai Shuppan Center (1979), and Hiroshi Kokado, *Kagaku to Kogyo,* Vol. 39, No. 3, p. 161 (1986).

A photoconductive layer for the electrophotographic light-sensitive element which can be used includes a single layer made of a photoconductive compound itself and a photoconductive layer comprising a binder resin having dispersed therein a photoconductive compound. The dispersed type photoconductive layer may have a single layer structure or a laminated structure.

The photoconductive compounds used in the present invention may be inorganic compounds or organic compounds.

Inorganic photoconductive compounds used in the present invention include those conventionally known, for example, zinc oxide, titanium oxide, zinc sulfide, cadmium sulfide, selenium, selenium-tellurium, amorphous silicon, and lead sulfide. These compounds are used together with a binder resin to form a photoconductive layer, or they are used alone to form a photoconductive layer by vacuum deposition or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer comprising an organic photoconductive compound, a sensitizing dye, and a binder resin, and (ii) a layer comprising a charge generating agent, a charge transporting agent, and a binder resin or a double-layered structure containing a charge generating agent and a charge transporting agent in separate layers.

The photoconductive layer of the electrophotographic light-sensitive element according to the present invention may have any of the above-described structure.

In the latter case, an organic photoconductive compound is employed as the charge transporting agent.

The organic photoconductive compounds which may be used in the present invention include, for example, triazole derivatives, oxadiazole derivatives, imidazole derivatives, polyarylalkane derivatives, pyrazoline derivatives, pyrazolone derivatives, arylamine derivatives, azulenium salt derivatives, amino-substituted chalcone derivatives, N,N-bicarbazyl derivatives, oxazole derivatives, styrylanthracene derivatives, fluorenone derivatives, hydrazone derivatives, benzidine derivatives, stilbene derivatives, polyvinylcarbazole and derivatives thereof, vinyl polymers such as polyvinylpyrene, polyvinylanthracene, poly-2-vinyl-4-(4'-dimethylaminophenyl)-5-phenyloxazole and poly-3-vinyl-N-ethylcarbazole, polymers such as polyacenaphthylene, polyindene and an acenaphthylene-styrene copolymer, triphenylmethane polymers, and condensed resins such as pyrene-formaldehyde resin, bromopyrene-formaldehyde resin and ethylcarbazole-formaldehyde resin.

The organic photoconductive compounds which can be used in the present invention are not limited to the above-described compounds, and any of known organic photoconductive compounds may be employed in the present invention. The organic photoconductive compounds may be used either individually or in combination of two or more thereof.

The charge generating agents which can be used in the photoconductive layer include various conventionally known charge generating agents, either organic or inorganic, such as selenium, selenium-tellurium, cadmium sulfide, zinc oxide, and organic pigments described below. The charge generating agent is appropriately selected to have spectral sensitivity suitable for a wavelength of a light source employed.

The organic pigments used include azo pigments (including monoazo, bisazo, and trisazo pigments), metal-free or metallized phthalocyanine pigments, perylene pigments, indigo or thioindigo derivatives, quinacridone pigments, polycyclic quinone pigments, bisbenzimidazole pigments, squarylium salt pigments, and azulenium salt pigments.

These charge generating agents may be used either individually or in combination of two or more thereof.

The charge transporting agents used in the photoconductive layer include those described for the organic photoconductive compounds above. The charge transporting agent is appropriately selected so as to suite the charge generating agent to be employed in combination.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resin.

Binder resins which can be used in the electrophotographic light-sensitive element according to the present invention include those for conventionally known electrophotographic light-sensitive elements. A weight average molecular weight of the binder resin is preferably from $5\times10^3$ to $1\times10^6$, and more preferably from $2\times10^4$ to $5\times10^5$. A glass transition point of the binder resin is preferably from −40° to 200° C., and more preferably from −10° to 140° C.

Suitable examples of the binder resin used are described, for example, in Koichi Nakamura (ed.), *Kioku Zairyoyo Binder no Jissai Gijutsu,* Ch. 10, C.M.C. (1985), Tsuyoshi Endo, *Netsukokasei Kobunshi no Seimitsuka,* C.M.C. (1986), Yuji Harasaki, *Saishin Binder Gijutsu Binran,* Ch. II-1, Sogo Gijutsu Center (1985), Takayuki Otsu, *Acryl Jushi no Gosei·Sekkei to Shinyoto Kaihatsu,* Chubu Kei-ei Kaihatsu Center Shuppanbu (1985), Eizo Omori, *Kinosei Acryl-Kei Jushi,* Techno System (1985), D. Tatt and S. C. Heidecker, *Tappi,* Vol. 49, No. 10, p. 439 (1966), E. S. Baltazzi and R. G. Blanchlotte, et al., *Photo. Sci. Eng.,* Vol. 16, No. 5, p. 354 (1972), and Nguyen Chank Keh, Isamu Shimizu and Eiichi Inoue, *Denshi Shashin Gakkaishi,* Vol. 18, No. 2, p. 22 (1980), in addition to the literature references mentioned with respect to the electrophotographic light-sensitive element above.

Specific examples of binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring which does not contain a nitrogen atom (the heterocyclic ring including, for example, furan, tetrahydrofuran, thiophene, dioxane, dioxofuran, lactone, benzofuran, benzothiophene and 1,3-dioxetane rings), and epoxy resins.

Further, the electrostatic characteristics of photoconductive layer are improved by using as the binder resin a resin having a relatively low molecular weight (e.g., a weight average molecular weight of from $10^3$ to $10^4$) and containing an acidic group such as a carboxy group, a sulfo group or a phosphono group. Suitable examples of such a resin are described, for example, in JP-A-64-70761, JP-A-2-67563, JP-A-3-181948 and JP-A-3-249659.

Moreover, in order to maintain a relatively stable performance even when ambient conditions are widely fluctuated, a specific medium to high molecular weight resin is employed as the binder resin. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Also, JP-A-3-206464 and JP-A-3-223762 discloses a resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Further, excellent electrostatic characteristics can be maintained even when ambient conditions are fluctuated or when a scanning exposure system using a semiconductor laser beam is utilized for the image exposure.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described, for example, in *Denshishashin,* Vol. 12, p. 9 (1973), *Yuki Gosei Kagaku,* Vol. 24, No. 11, p. 1010 (1966), Harumi Miyamoto and Hidehiko Takei, *Imaging,* Vol. 1973, No. 8, p. 12, C. J. Young et al., *RCA Review,* Vol. 15, p. 469 (1954), Kohei Kiyota et al., *Denkitsushin Gakkai Ronbunshi,* Vol. J 63-C, No. 2, p. 97 (1980), Yuji Harasaki et al., *Kogyo Kagaku Zasshi,* Vol. 66, p. 78 and 188 (1963), Tadaaki Tani, *Nihon Shashin Gakkaishi,* Vol. 35, p. 208 (1972), *Research Disclosure,* No. 216, pp. 117–118 (1982), and F. M. Hamer, *The Cyanine Dyes and Related Compounds,* in addition to the literature references mentioned with respect to the electrophotographic light-sensitive element above.

If desired, the electrophotographic light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu·Jitsuyoka,* Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin,* Vol. 14, No. 1, pp. 2–11 (1975), Hiroyuki Moriga, *Nyumon Tokushushi no Kagaku,* Kobunshi Kankokai (1975), and M. F. Hoover, *J. Macromol. Sci. Chem.,* Vol. A-4, No. 6, pp. 1327–1417 (1970).

Now, the transfer layer which can be used in the present invention will be described in greater detail below.

The transfer layer of the present invention is generally a layer having a function of bearing a toner image formed by an electrophotographic process, of transferring the toner image from the light-sensitive element to a receiving material which provides a support for a printing plate, and of being appropriately removed by a chemical reaction treatment to prepare a printing plate.

The transfer layer (T) provided on an electrophotographic light-sensitive element is light-transmittive and capable of transmitting a radiation having a wavelength which constitutes at least one part of a spectrally sensitive region of the electrophotographic light-sensitive element. The layer may be colored. A colorless and transparent transfer layer is usually employed.

It is important for the transfer layer (T) used in the present invention to have features in that it does not degrade electrophotographic characteristics (such as chargeability, dark charge retention rate and photosensitivity) until a toner image is formed by an electrophotographic process to form a good duplicated image, in that it has thermoplasticity sufficient for easy release from the surface of light-sensitive element in the heat transfer process and in that it is easily removed by a chemical reaction treatment.

The transfer layer (T) is preferred to be transferred under conditions of temperature of not more than 100° C. and/or pressure of not more than 15 Kgf/cm$^2$, more preferably under conditions of temperature of not more than 80° C. and/or pressure of not more than 10 Kgf/cm$^2$. When the transfer conditions are lower than the above-described upper limit, there is no problem in practice since a large-sized apparatus is almost unnecessary in order to maintain the heat capacity and pressure sufficient for release of the transfer layer from the surface of light-sensitive element and transfer to a receiving material, and the transfer is sufficiently performed at an appropriate transfer speed. The lower limit of transfer conditions is preferably not less than room temperature and/or pressure of not less than 100 gf/cm$^2$.

Thus, the resin (A) constituting the transfer layer of the present invention is a resin which is thermoplastic and capable of being removed by a chemical reaction treatment.

With respect to thermal property of the resin (A), a glass transition point thereof is preferably not more than 80° C., more preferably not more than 60° C., and particularly preferably not more than 50° C., or a softening point thereof is preferably not more than 100° C., more preferably not more than 80° C., and particularly preferably not more than 70° C.

The resins (A) may be employed either individually or in combination of two or more thereof. For instance, at least two resins having a glass transition point or a softening point different from each other are preferably used in combination in order to improve transferability. Specifically, a transfer layer comprising a resin having a glass transition point of from 28° C. to 80° C. or a softening point of from 35° C. to 100° C. (hereinafter referred to as resin (AH) sometimes) and a resin having a glass transition point of not more than 30° C. or a softening point of not more than 30° C. (hereinafter referred to as resin (AL) sometimes) and its glass transition point or softening point is at least 2° C. lower than that of the resin (AH) is preferred.

The resin (AH) has a glass transition point of preferably from 30° C. to 60° C., and more preferably from 30° C. to 50° C., or a softening point of preferably from 38° C. to 80° C., and more preferably from 40° C. to 70° C., and on the other hand, the resin (AL) has a glass transition point of preferably from −50° C. to 25° C., and more preferably from −25° C. to 20° C., or a softening point of preferably from −30° C. to 30° C., and more preferably from 0° C. to 25° C. The difference in the glass transition point or softening point between the resin (AH) and the resin (AL) used is preferably in a range of from 5° C. to 30° C. The difference in the glass transition point or softening point between the resin (AH) and the resin (AL) means a difference between the lowest glass transition point or softening point of those of the resins (AH) and the highest glass transition point or softening point of those of the resins (AL) when two or more of the resins (AH) and/or resins (AL) are employed.

The resin (AH) and resin (AL) are preferably present in the transfer layer in a weight ratio of resin (AH)/resin (AL) ranging from 5/95 to 90/10, particularly from 20/80 to 70/30. In the above described range of weight ratio of resin (AH)/resin (AL), the advantage of the combination can be effectively obtained.

By adjusting the glass transition point or softening point of the resin (A) used in the transfer layer as described above, adhesion between the surface of electrophotographic light-sensitive element and the transfer layer (T) is further reduced and, on the other hand, adhesion between the transfer layer (T) and a receiving material in the non-image portion is increased. As a result, transferability of the transfer layer to a receiving material is remarkably improved, and a further enlarged latitude of transfer conditions (e.g., heating temperature, pressure, and transportation speed) can be achieved even when a thickness of the transfer layer is reduced.

The resin (A) used in the present invention is capable of being removed upon a chemical reaction treatment.

The term "resin capable of being removed upon a chemical reaction treatment" means and includes a resin which is dissolved and/or swollen upon a chemical reaction treatment to remove and a resin which is rendered hydrophilic upon a chemical reaction treatment and as a result, dissolved and/or swollen to remove.

One representative example of the resin (A) capable of being removed upon a chemical reaction treatment used in the transfer layer according to the present invention is a resin which can be removed with an alkaline processing solution. Particularly useful resins of the resins capable of being removed with an alkaline processing solution include polymers comprising a polymer component containing a hydrophilic group.

Another representative example of the resin (A) capable of being removed upon the chemical reaction treatment used in the transfer layer according to the present invention is a resin which has a hydrophilic group protected by a protective group and is capable of forming the hydrophilic group upon a chemical reaction.

The chemical reaction for converting the protected hydrophilic group to a hydrophilic group includes a reaction for rendering hydrophilic with a processing solution utilizing a conventionally known reaction, for example, hydrolysis, hydrogenolysis, oxygenation, β-release, and nucleophilic substitution, and a reaction for rendering hydrophilic by a decomposition reaction induced by exposure of actinic radiation.

Particularly useful resins of the resins capable of being rendered hydrophilic upon the chemical reaction treatment includes polymers comprising a polymer component containing a functional group capable of forming a hydrophilic group.

As the resin (A) for the formation of transfer layer, a polymer comprising at least one polymer component selected from a polymer component (a) containing a specific hydrophilic group described below and a polymer component (b) containing a functional group capable of forming a specific hydrophilic group upon a chemical reaction described below is preferred. Polymer component (a):

a polymer component containing at least one group selected from a $-CO_2H$ group, a -CHO group, a $-SO_3H$ group, a $-SO_2H$ group, a $-P(=O)(OH)R^1$ group (wherein $R^1$ represents a -OH group, a hydrocarbon group or a $-OR^2$ group (wherein $R^2$ represents a hydrocarbon group)), a phenolic hydroxy group, a cyclic acid anhydride-containing group, a $-CONHCOR^3$ group (wherein $R^3$ represents a hydrocarbon group) and a $-CONHSO_2R^3$ group; Polymer component (b):

a polymer component containing at least one functional group capable of forming at least one group selected from a $-CO_2H$ group, a -CHO group, a $-SO_3H$ group, a $-SO_2H$ group, a $-P(=O)(OH)R^1$ group (wherein $R^1$ has the same meaning as defined above) and a -OH group upon a chemical reaction.

The $-P(=O)(OH)R^1$ group denotes a group having the following formula:

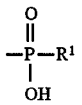

The hydrocarbon group represented by $R^1$, $R^2$ or $R^3$ preferably includes an aliphatic group having from 1 to 18 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylmethylphenyl, dichlorophenyl, methoxyphenyl, cyanophenyl, acetamidophenyl, acetylphenyl and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexane- 1,2-dicarboxylic acid anhydride ring, and 2,3-bicyclo[2,2,2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphthalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl, and ethoxycarbonyl).

To incorporate the polymer component (a) having the specific hydrophilic group into the thermoplastic resin used for the formation of transfer layer is preferred since the removal of transfer layer is easily and rapidly performed by a chemical reaction treatment. On the other hand, it is advantageous to use the thermoplastic resin containing the polymer component (b) which forms the specific hydrophilic group by a chemical reaction, because a glass transition point of the resin can be controlled in a low temperature range.

By appropriately selecting the polymer component (a) and the polymer component (b) to be employed in the resin (A), a glass transition point of the resin (A) is suitably controlled and thus, transferability of the transfer layer is remarkably improved. Also, the transfer layer is rapidly and completely removed to provide a printing plate without adversely affecting the hydrophilic property of the non-image areas and causing degradation of the toner image. As a result, the reproduced image transferred on receiving material has excellent reproducibility, and a transfer apparatus of small size can be utilized since the transfer is easily conducted under conditions of low temperature and low pressure. Moreover, in the resulting printing plate, cutting of toner image in highly accurate image portions such as fine lines, fine letters and dots for continuous tone areas is prevented and the residual transfer layer is not observed.

Suitable contents of polymer component (a) and/or polymer component (b) in the resin (A) are determined so as to prevent the occurrence of background stain in the non-image areas of prints because of incomplete removal of the transfer layer by a chemical reaction treatment on the one side, and to prevent degradation of transferability of the transfer layer onto a receiving material due to an excessively high glass transition point or softening point of the resin (A) on the other side.

Preferred ranges of the contents of polymer component (a) and/or polymer component (b) in the resin (A) are as follows.

When the resin (A) contains only the polymer component (a) having the specific hydrophilic group, the content of polymer component (a) is preferably from 3 to 50% by weight, and more preferably from 5 to 40% by weight based on the total polymer component in the resin (A). On the other hand, when the resin (A) contains only the polymer component (b) having a functional group capable of forming the specific hydrophilic group by a chemical reaction, the content of polymer component (b) is preferably from 3 to 100% by weight, and more preferably from 5 to 70% by weight based on the total polymer component in the resin (A).

Further, when the resin (A) contains both the polymer component (a) and the polymer component (b), the content of polymer component (a) is preferably from 0.5 to 30% by weight, more preferably from 1 to 25% by weight, and the content of polymer component (b) is preferably from 3 to 99.5% by weight, more preferably from 5 to 50% by weight, based on the total polymer component in the resin (A).

Now, each of the polymer components which can be included in the resin (A) will be described in detail below.

The polymer component (a) containing the above-described specific hydrophilic group present in the resin (A) should not be particularly limited. Of the specific hydrophilic groups described above, those capable of forming a salt may be present in the form of salt (e.g., salt with an inorganic iron or salt with an organic base) in the polymer component (a). For instance, the above-described polymer component containing the specific hydrophilic group used in the resin (A) may be any of vinyl compounds each having the hydrophilic group. Such vinyl compounds are described, for example, in *Kobunshi Data Handbook* (*Kiso-hen*), edited by Kobunshi Gakkai, Baifukan (1986). Specific examples of the vinyl compound include acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinyl-phosphonic acid, half ester derivatives of the vinyl group or allyl group of dicarboxylic acids, and ester derivatives or amide derivatives of these carboxylic acids or sulfonic acids having the above-described hydrophilic group in the substituent thereof.

Specific examples of the polymer components (a) containing the specific hydrophilic group are set forth below, but the present invention should not be construed as being limited thereto. In the following formulae, $R^4$ represents -H or $-CH_3$; $R^5$ represents -H, $-CH_3$ or $-CH_2COOCH_3$; $R^6$ represents an alkyl group having from 1 to 4 carbon atoms; $R^7$ represents an alkyl group having from 1 to 6 carbon atoms, a benzyl group or a phenyl group; e represents an integer of 1 or 2; f represents an integer of from 1 to 3; g represents an integer of from 2 to 11; h represents an integer of from 1 to 11; and i represents an integer of from 2 to 4; and j represents an integer of from 2 to 10.

(a-1)
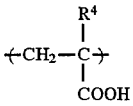
(a-2)
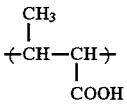
(a-3)
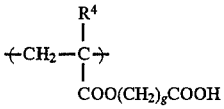
(a-4)
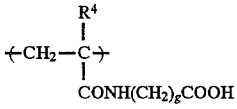
(a-5)
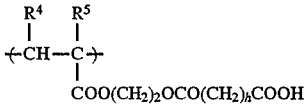
(a-6)
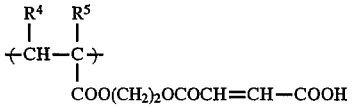
(a-7)
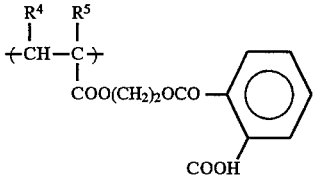
(a-8)
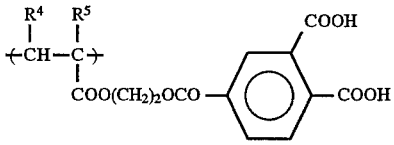
(a-9)
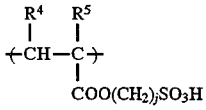
(a-10)
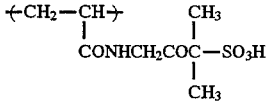
(a-11)
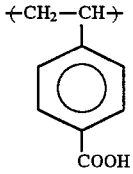
(a-12)
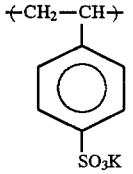
-continued
(a-13)
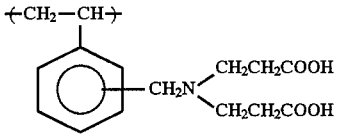
(a-14)
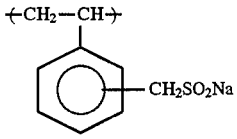
(a-15)
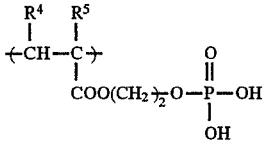
(a-16)
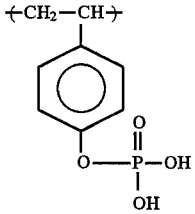
(a-17)
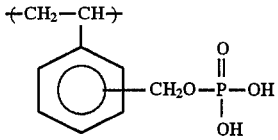
(a-18)
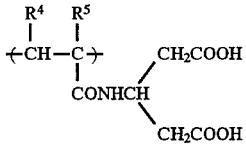
(a-19)
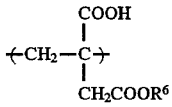
(a-20)
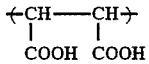
(a-21)
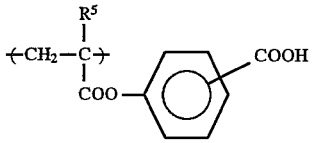
(a-22)
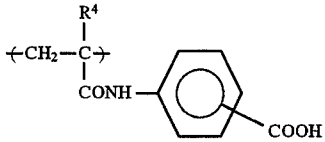
(a-23)
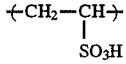
(a-24)
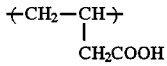

-continued
(a-25)
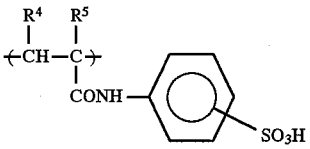
(a-26)
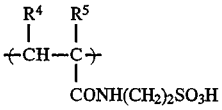
(a-27)
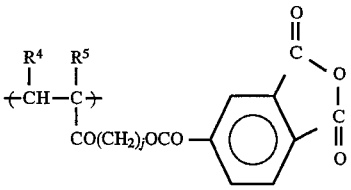
(a-28)
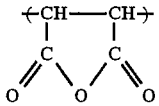
(a-29)
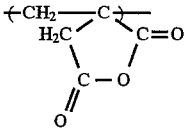
(a-30)
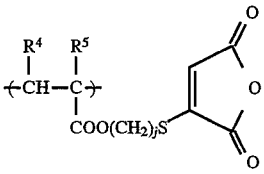
(a-31)
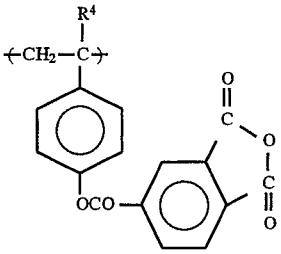
(a-32)
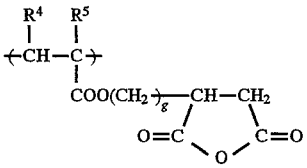
(a-33)
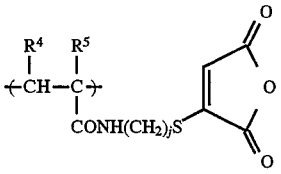
-continued
(a-34)
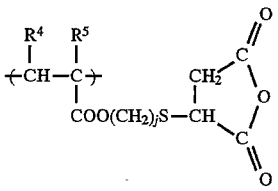
(a-35)
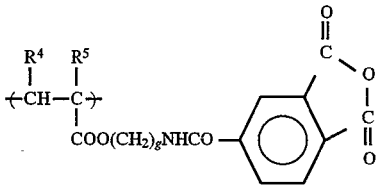
(a-36)
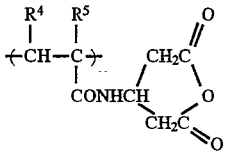
(a-37)
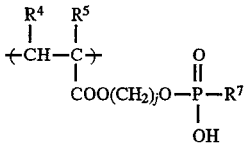
(a-38)
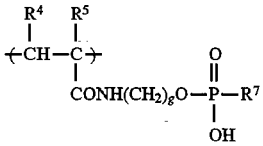
(a-39)
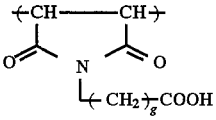
(a-40)
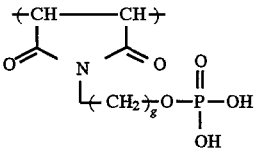
(a-41)
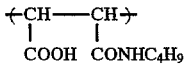
(a-42)
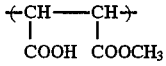
(a-43)
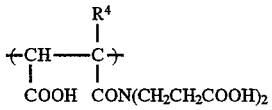
(a-44)
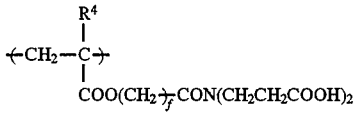

-continued (a-45)

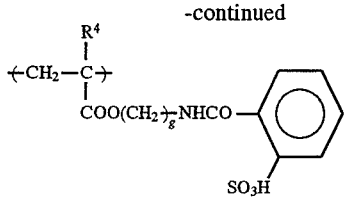

(a-46)

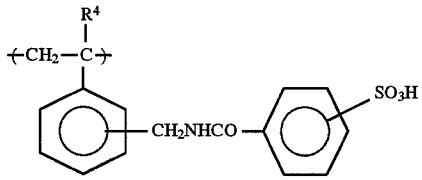

(a-47)

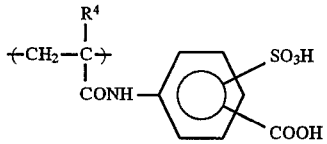

(a-48)

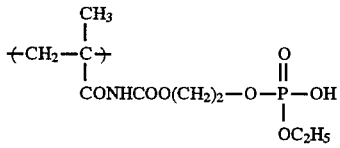

(a-49)

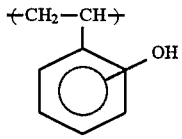

(a-50)

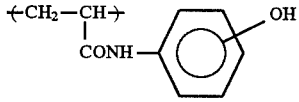

(a-51)

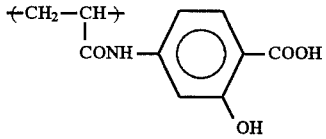

(a-52)

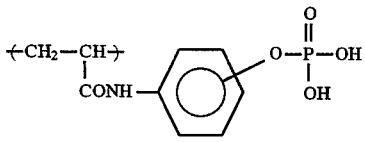

(a-53)

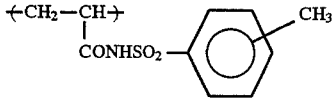

(a-54)

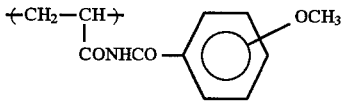

(a-55)

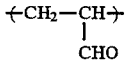

(a-56)

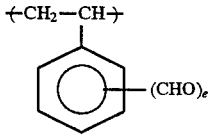

The polymer component (b) containing a functional group capable of forming a specific hydrophilic group upon a chemical reaction will be described below.

The number of hydrophilic groups formed from one functional group capable of forming a hydrophilic group upon the chemical reaction may be one, two or more.

Now, a functional group capable of forming at least one carboxyl group upon a chemical reaction will be described below.

According to one preferred embodiment of the present invention, a carboxy group-forming functional group is represented by the following general formula (F-I):

$$-COO-L^1 \qquad \text{(F-X)}$$

wherein $L^1$ represents

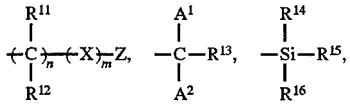

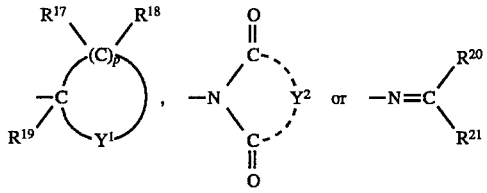

wherein $R^{11}$ and $R^{12}$, which may be the same or different, each represent a hydrogen atom or a hydrocarbon group; X represents an aromatic group; Z represents a hydrogen atom, a halogen atom, a trihalomethyl group, an alkyl group, a cyano group, a nitro group, $-SO_2-Z^1$ (wherein $Z^1$ represents a hydrocarbon group), $-COO-Z^2$ (wherein $Z^2$ represents a hydrocarbon group), $-O-Z^3$ (wherein $Z^3$ represents a hydrocarbon group), or $-CO-Z^4$ (wherein $Z^4$ represents a hydrocarbon group); n and m each represent 0, 1 or 2, provided that when both n and m are 0, Z is not a hydrogen atom; $A^1$ and $A^2$, which may be the same or different, each represent an electron attracting group having a positive Hammett's $\sigma$ value; $R^{13}$ represents a hydrogen atom or a hydrocarbon group; $R^{14}$, $R^{15}$, $R^{16}$, $R^{20}$ and $R^{21}$, which may be the same or different, each represent a hydrocarbon group or $-O-Z^5$ (wherein $Z^5$ represents a hydrocarbon group); $Y^1$ represents an oxygen atom or a sulfur atom; $R^{17}$, $R^{18}$, and $R^{19}$, which may be the same or different, each represent a hydrogen atom, a hydrocarbon group or $-O-Z^7$ (wherein $Z^7$ represents a hydrocarbon group); p represents an integer of 3 or 4; $Y^2$ represents an organic residue for forming a cyclic imido group.

In more detail, $R^{11}$ and $R^{12}$, which may be the same or different, each preferably represents a hydrogen atom or a straight chain or branched chain alkyl group having from 1 to 12 carbon atoms which may be substituted (e.g., methyl, ethyl, propyl, chloromethyl, dichloromethyl, trichloromethyl, trifluoromethyl, butyl, hexyl, octyl, decyl, hydroxyethyl, or 3-chloropropyl). X preferably represents a phenyl or naphthyl group which may be substituted (e.g., phenyl, methylphenyl, chlorophenyl, dimethylphenyl, chloromethylphenyl, or naphthyl). Z preferably represents a hydrogen atom, a halogen atom (e.g., chlorine or fluorine), a trihalomethyl group (e.g., trichloromethyl or trifluoromethyl), a straight chain or branched chain alkyl group having from 1 to 12 carbon atoms which may be substituted (e.g., methyl, chloromethyl, dichloromethyl, ethyl, propyl, butyl, hexyl, tetrafluoroethyl, octyl, cyanoethyl, or chloroethyl), a cyano group, a nitro group, $-SO_2-Z^1$ (wherein $Z^1$ represents an aliphatic group (for example an alkyl group having from 1 to 12 carbon atoms which may be substituted (e.g., methyl, ethyl, propyl, butyl, chloroethyl, pentyl, or octyl) or an aralkyl group having from 7 to 12 carbon atoms which may be substituted (e.g., benzyl, phenethyl, chlorobenzyl, methoxybenzyl, chlorophenethyl, or methylphenethyl)), or an aromatic group (for example, a phenyl or naphthyl group which may be substituted (e.g., phenyl, chlorophenyl, dichlorophenyl, methylphenyl, methoxyphenyl, acetylphenyl, acetamidophenyl, methoxycarbonylphenyl, or naphthyl)), $-COO-Z^2$ (wherein $Z^2$ has the same meaning as $Z^1$ above), $-O-Z^3$ (wherein $Z^3$ has the same meaning as $Z^1$ above), or $-CO-Z^4$ (wherein $Z^4$ has the same meaning as $Z^1$ above). n and m each represent 0, 1 or 2, provided that when both n and m are 0, Z is not a hydrogen atom.

$R^{14}$, $R^{15}$, $R^{16}$, $R^{20}$ and $R^{21}$, which may be the same or different, each preferably represent an aliphatic group having 1 to 18 carbon atoms which may be substituted (wherein the aliphatic group includes an alkyl group, an alkenyl group, an aralkyl group, and an alicyclic group, and the substituent therefor includes a halogen atom, a cyano group, and $-O-Z^6$ (wherein $Z^6$ represents an alkyl group, an aralkyl group, an alicyclic group, or an aryl group)), an aromatic group having from 6 to 18 carbon atoms which may be substituted (e.g., phenyl, tolyl, chlorophenyl, methoxyphenyl, acetamidophenyl, or naphthyl), or $-O-Z^5$ (wherein $Z^5$ represents an alkyl group having from 1 to 12 carbon atoms which may be substituted, an alkenyl group having from 2 to 12 carbon atoms which may be substituted, an aralkyl group having from 7 to 12 carbon atoms which may be substituted, an alicyclic group having from 5 to 18 carbon atoms which may be substituted, or an aryl group having from 6 to 18 carbon atoms which may be substituted).

$A^1$ and $A^2$ may be the same or different, at least one of $A^1$ and $A^2$ represents an electron attracting group, with the sum of their Hammett's $\sigma_p$ values being 0.45 or more. Examples of the electron attracting group for $A^1$ or $A^2$ include an acyl group, an aroyl group, a formyl group, an alkoxycarbonyl group, a phenoxycarbonyl group, an alkylsulfonyl group, an aroylsulfonyl group, a nitro group, a cyano group, a halogen atom, a halogenated alkyl group, and a carbamoyl group.

A Hammett's $\sigma_p$ value is generally used as an index for estimating the degree of electron attracting or donating property of a substituent. The greater the positive value, the higher the electron attracting property. Hammett's $\sigma_p$ values of various substituents are described, e.g., in Naoki Inamoto, *Hammett Soku— Kozo to Han-nosei,* Maruzen (1984).

It seems that an additivity rule applies to the Hammett's $\sigma_p$ values in this system so that both of $A^1$ and $A^2$ need not be electron attracting groups. Therefore, where one of them is an electron attracting group, the other may be any group selected without particular limitation as far as the sum of their $\sigma_p$ values is 0.45 or more.

$R^{13}$ preferably represents a hydrogen atom or a hydrocarbon group having from 1 to 8 carbon atoms which may be substituted, e.g., methyl, ethyl, propyl, butyl, pentyl, hexyl, octyl, allyl, benzyl, phenethyl, 2-hydroxyethyl, 2-methoxyethyl, 2-ethoxyethyl, 3-methoxypropyl, or 2-chloroethyl.

$Y^1$ represents an oxygen atom or a sulfur atom. $R^{17}$, $R^{18}$, and $R^{19}$, which may be the same or different, each preferably represents a hydrogen atom, a straight chain or branched chain alkyl group having from 1 to 18 carbon atoms which may be substituted (e.g., methyl, ethyl, propyl, butyl, hexyl, octyl, decyl, dodecyl, octadecyl, chloroethyl, methoxyethyl, or methoxypropyl), an alicyclic group which may be substituted (e.g., cyclopentyl or cyclohexyl), an aralkyl group having from 7 to 12 carbon atoms which may be substituted (e.g., benzyl, phenethyl, chlorobenzyl, or methoxybenzyl), an aromatic group which may be substituted (e.g., phenyl, naphthyl, chlorophenyl, tolyl, methoxyphenyl, methoxycarbonylphenyl, or dichlorophenyl), or $-O-Z^7$ (wherein $Z^7$ represents a hydrocarbon group and specifically the same hydrocarbon group as described for $R^{14}$, $R^{15}$, or $R^{16}$). p represents an integer of 3 or 4.

$Y^2$ represents an organic residue for forming a cyclic imido group, and preferably represents an organic residue represented by the following general formula (A) or (B):

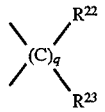

(A)

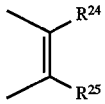

(B)

In the general formula (A), $R^{22}$ and $R^{23}$, which may be the same or different, each represent a hydrogen atom, a halogen atom (e.g., chlorine or bromine), an alkyl group having from 1 to 18 carbon atoms which may be substituted (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, or 2-(ethoxymethoxy)ethyl), an aralkyl group having from 7 to 12 carbon atoms which may be substituted (e.g., benzyl, phenethyl, 3-phenylpropyl, methylbenzyl, dimethylbenzyl, methoxybenzyl, chlorobenzyl, or bromobenzyl), an alkenyl group having from 3 to 18 carbon atoms which may be substituted (e.g., allyl, 3-methyl-2-propenyl, 2-hexenyl, 4-propyl-2-pentenyl, or 12-octadecenyl), $-S-Z^8$ (wherein $Z^8$ represents an alkyl, aralkyl or alkenyl group having the same meaning as $R^{22}$ or $R^{23}$ described above or an aryl group which may be substituted (e.g., phenyl, tolyl, chlorophenyl, bromophenyl, methoxyphenyl, ethoxyphenyl, or ethoxycarbonylphenyl)) or $-NH-Z^9$ (wherein $Z^9$ has the same meaning as $Z^8$ described above). Alternatively, $R^{22}$ and $R^{23}$ may be taken together to form a ring, such as a 5- or 6-membered monocyclic ring (e.g., cyclopentane or cyclohexane) or a 5- or 6-membered bicyclic ring (e.g., bicyclopentane, bicycloheptane, bicyclooctane, or bicyclooctene). The ring may be substituted. The substituent includes those described for $R^{22}$ or $R^{23}$. q represents an integer of 2 or 3.

In the general formula (B) $R^{24}$ and $R^{25}$, which may be the same or different, each have the same meaning as $R^{22}$ or $R^{23}$ described above. Alternatively, $R^{24}$ and $R^{25}$ may be taken together to form an aromatic ring (e.g., benzene or naphthalene).

According to another preferred embodiment of the present invention, the carboxyl group-forming functional group is a group containing an oxazolone ring represented by the following general formula (F-II):

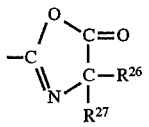

(F-II)

wherein $R^{26}$ and $R^{27}$, which may be the same or different, each represent a hydrogen atom or a hydrocarbon group, or $R^{26}$ and $R^{27}$ may be taken together to form a ring.

In the general formula (F-II), $R^{26}$ and $R^{27}$ each preferably represents a hydrogen atom, a straight chain or branched chain alkyl group having from 1 to 12 carbon atoms which may be substituted (e.g., methyl, ethyl, propyl, butyl, hexyl, 2-chloroethyl, 2-methoxyethyl, 2-methoxycarbonylethyl, or 3-hydroxypropyl), an aralkyl group having from 7 to 12 carbon atoms which may be substituted (e.g., benzyl, 4-chlorobenzyl, 4-acetamidobenzyl, phenethyl, or 4-methoxybenzyl), an alkenyl group having from 2 to 12 carbon atoms which may be substituted (e.g., vinyl, allyl, isopropenyl, butenyl, or hexenyl), a 5- to 7-membered alicyclic group which may be substituted (e.g., cyclopentyl, cyclohexyl, or chlorocyclohexyl), or an aromatic group which may be substituted (e.g., phenyl, chlorophenyl, methoxyphenyl, acetamidophenyl, methylphenyl, dichlorophenyl, nitrophenyl, naphthyl, butylphenyl, or dimethylphenyl). Alternatively, $R^{26}$ and $R^{27}$ may be taken together to form a 4- to 7-membered ring (e.g., tetramethylene, pentamethylene, or hexamethylene).

A functional group capable of forming at least one sulfo group upon a chemical reaction includes a functional group represented by the following general formula (F-III) or (F-IV):

$$-SO_2\text{-}O\text{-}L^2 \quad \text{(F-III)}$$

$$-SO_2\text{-}S\text{-}L^2 \quad \text{(F-IV)}$$

wherein $L^2$ represents

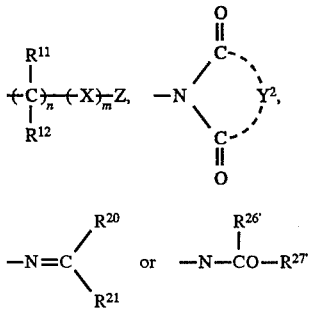

wherein $R^{11}$, $R^{12}$, X, Z, n, m, $Y^2$, $R^{20}$ and $R^{21}$ each has the same meaning as defined above; and $R^{26'}$ and $R^{27'}$ each represents a hydrogen atom, or a hydrocarbon group as defined for $R^{26}$.

A functional group capable of forming at least one sulfinic acid group upon a chemical reaction includes a functional group represented by the following general formula (F-V):

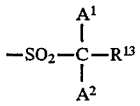

(F-V)

wherein $A^1$, $A^2$ and $R^{13}$ each has the same meaning as defined above.

A functional group capable of forming at least one $-P(=O)(OH)R^1$ group upon a chemical reaction includes a functional group represented by the following general formula (F-VIa) or (F-VIb):

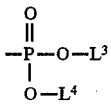

(F-VIa)

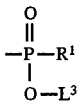

(F-VIb)

wherein $L^3$ and $L^4$, which may be the same or different, each has the same meaning as $L^1$ described above, and $R^1$ has the same meaning as defined above.

One preferred embodiment of functional groups capable of forming at least one hydroxyl group upon a chemical reaction includes a functional group represented by the following general formula (F-VII):

$$-O\text{-}L^5 \quad \text{(F-VII)}$$

wherein $L^5$ represents

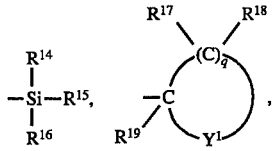

wherein $R^{14}$, $R^{15}$, $R^{16}$, $R^{17}$, $R^{18}$, $R^{19}$, $Y^1$, and p each has the same meaning as defined above; and $R^{28}$ represents a hydrocarbon group, and specifically the same hydrocarbon group as described for $R^{14}$.

Another preferred embodiment of functional groups capable of forming at least one hydroxyl group upon a chemical reaction includes a functional group wherein at least two hydroxyl groups which are sterically close to each other are protected with one protective group. Such hydroxyl group-forming functional groups are represented, for example, by the following general formulae (F-VIII), (F-IX) and (F-X):

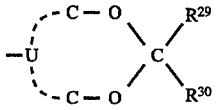

(F-VIII)

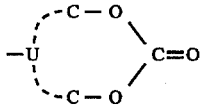

(F-IX)

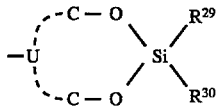

(F-X)

wherein $R^{29}$ and $R^{30}$, which may be the same or different, each represents a hydrogen atom, a hydrocarbon group, or $-O\text{-}Z^{10}$ (wherein $Z^{10}$ represents a hydrocarbon group); and U represents a carbon-to-carbon bond which may contain a hetero atom, provided that the number of atoms present between the two oxygen atoms is 5 or less.

More specifically, $R^{29}$ and $R^{30}$, which may be the same or different, each preferably represents a hydrogen atom, an alkyl group having from 1 to 12 carbon atoms which may be substituted (e.g., methyl, ethyl, propyl, butyl, hexyl, 2-methoxyethyl, or octyl), an aralkyl group having from 7 to 9 carbon atoms which may be substituted (e.g., benzyl, phenethyl, methylbenzyl, methoxybenzyl, or chlorobenzyl), an alicyclic group having from 5 to 7 carbon atoms (e.g., cyclopentyl or cyclohexyl), an aryl group which may be substituted (e.g., phenyl, chlorophenyl, methoxyphenyl, methylphenyl, or cyanophenyl), or $-OZ^{10}$ (wherein $Z^{10}$ represents a hydrocarbon group, and specifically the same hydrocarbon group as described for $R^{29}$ or R30), and U represents a carbon-to-carbon bond which may contain a hetero atom, provided that the number of atoms present between the two oxygen atoms is 5 or less.

Specific examples of the functional groups represented by the general formulae (F-I) to (F-X) described above are set forth below, but the present invention should not be construed as being limited thereto. In the following formulae (b-1)-through (b-67), the symbols used have the following meanings respectively:

$W_1$: —CO—, $—SO_2—$, or

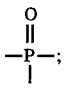

$W_2$: —CO— or $—SO_2—$;

$Q^1$: $—C_nH_{2n+1}$ (n: an integer of from 1 to 8),

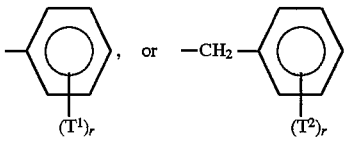

$T^1$, $T^2$: -H, $-C_nH_{2n+1}$, $-OC_nH_{2n+1}$, -CN, $-NO_2$, -Cl, -Br, $-COOC_nH_{2n+1}$, $-NHCOC_nH_{2n+1}$, or $-COC_nH_{2n+1}$;

r: an integer of from 1 to 5;

$Q^2$: $-C_nH_{2n+1}$, $-CH_2C_6H_5$, or $-C_6H_5$;

$Q^3$: $C_mH_{2m+1}$ (m: an integer of from 1 to 4) or $-CH_2C_6H_5$;

$Q^4$: -H, $-CH_3$, or $-OCH_3$;

$Q^5$, $Q^6$: -H, $-CH_3$, $-OCH_3$, $-C_6H_5$, or $-CH_2C_6H_5$;

G: -O- or -S-; and

J: -Cl or -Br

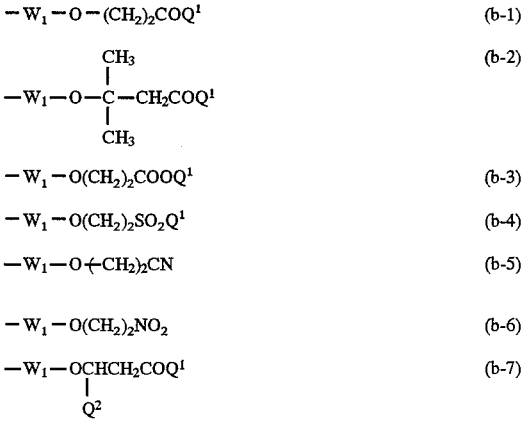

(b-1)

(b-2)

(b-3)

(b-4)

(b-5)

(b-6)

(b-7)

-continued

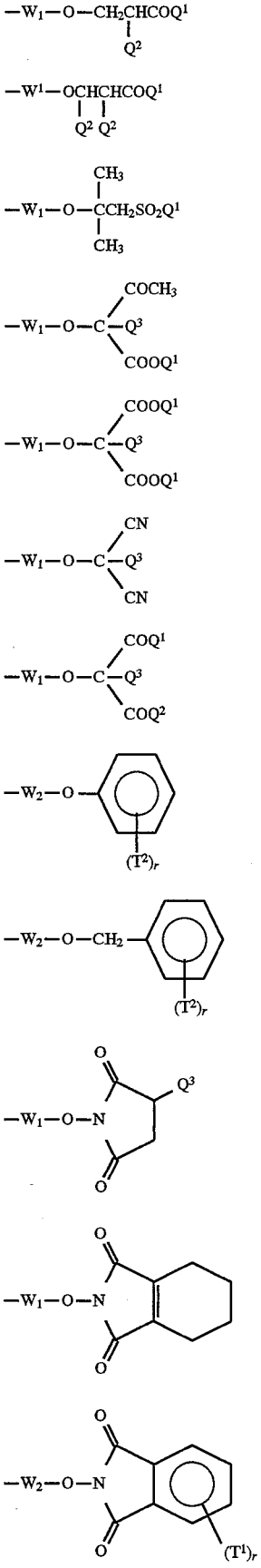

(b-8)

(b-9)

(b-10)

(b-11)

(b-12)

(b-13)

(b-14)

(b-15)

(b-16)

(b-17)

(b-18)

(b-19)

-continued
(b-20)
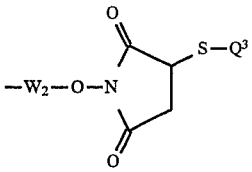
(b-21)
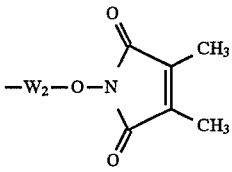
(b-22)
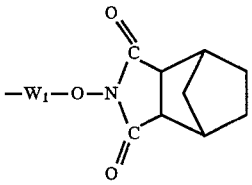
(b-23)
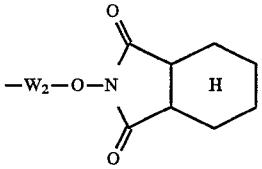
(b-24)
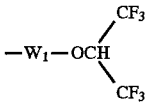
(b-25) $-W_1-O-CH_2CF_3$
(b-26)
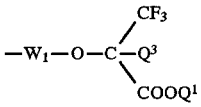
(b-27)
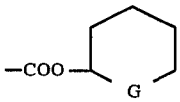
(b-28)
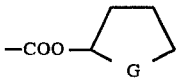
(b-29)
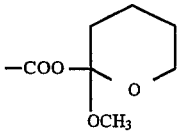
(b-30)
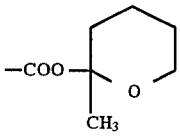
(b-31) $-COOSi(C_3H_7)_3$
(b-32)
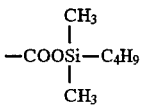
-continued
(b-33)
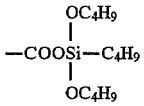
(b-34)
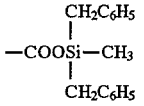
(b-35) $-SO_3-CH_2COQ^1$
(b-36) $-SO_3CH_2COOQ^1$
(b-37) $-SO_3(CH_2)_2J$
(b-38)
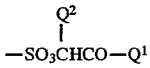
(b-39)
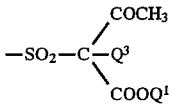
(b-40)
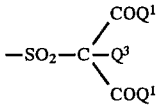
(b-41)
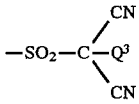
(b-42)
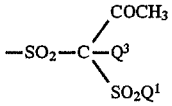
(b-43)
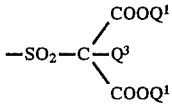
(b-44)
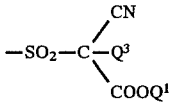
(b-45)
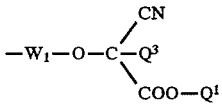
(b-46)
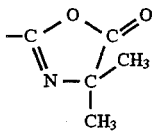
(b-47)
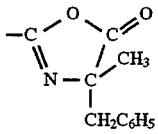
(b-48)
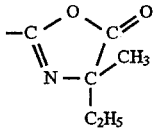

-continued (b-49)

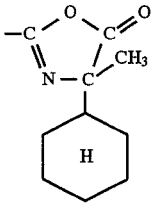

(b-50)

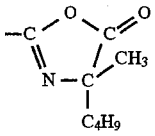

(b-51)

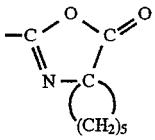

(b-52)

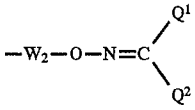

(b-53)

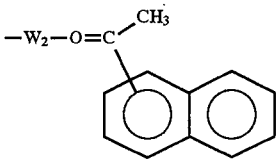

(b-54)

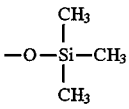

(b-55)

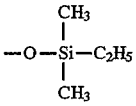

(b-56)

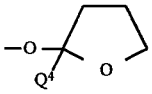

(b-57)

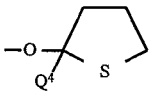

(b-58)

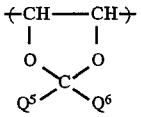

(b-59)

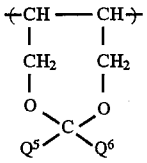

(b-60)

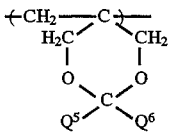

-continued (b-61)

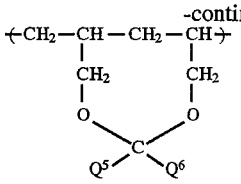

(b-62)

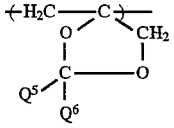

(b-63)

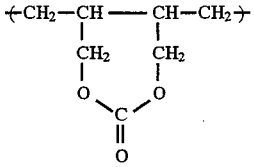

(b-64)

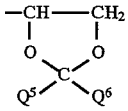

(b-65)

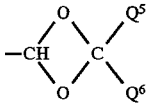

(b-66)

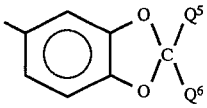

(b-67)

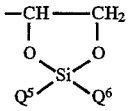

The polymer component (b) which contains the functional group capable of forming at least one hydrophilic group selected from -COOH, -CHO, $-SO_3H$, $-SO_2H$, $-P(=O)(OH)R^1$ and -OH upon a chemical reaction which can be used in the present invention is not particularly limited. Specific examples thereof include polymer components obtained by protecting the hydrophilic group in the polymer components (a) described above.

The above-described functional group capable of forming at least one hydrophilic group selected from -COOH, -CHO, $-SO_3H$, $-SO_2H$, $-P(=O)(OH)R^1$, and -OH upon a chemical reaction used in the present invention is a functional group in which such a hydrophilic group is protected with a protective group. Introduction of the protective group into a hydrophilic group by a chemical bond can easily be carried out according to conventionally known methods. For example, the reactions as described in J. F. W. McOmie, *Protective Groups in Organic Chemistry,* Plenum Press (1973), T. W. Greene, *Protective Groups in Organic Synthesis,* Wiley-Interscience (1981), Nippon Kagakukai (ed.), *Shin Jikken Kagaku Koza,* Vol. 14, "Yuki Kagobutsu no Gosei to Han-no", Maruzen (1978), and Yoshio Iwakura and Keisuke Kurita, *Han-nosei Kobunshi,* Kodansha can be employed.

In order to introduce the functional group which can be used in the present invention into a resin, a process using a so-called polymer reaction in which a polymer containing at least one hydrophilic group selected from -COOH, -CHO, $-SO_3H$, $-SO_2H$, $-PO_3H_2$, and -OH is reacted to convert its hydrophilic group to a protected hydrophilic group or a process comprising synthesizing at least one monomer containing at least one of the functional groups, for example, those represented by the general formulae (F-I) to (F-X) and then polymerizing the monomer or copolymerizing the monomer with any appropriate other copolymerizable monomer(s) is used.

The latter process (comprising preparing the desired monomer and then conducting polymerization reaction) is preferred for reasons that the amount or kind of the functional group to be incorporated into the polymer can be appropriately controlled and that incorporation of impurities can be avoided (in case of the polymer reaction process, a catalyst to be used or by-products are mixed in the polymer).

For example, a resin containing a carboxyl group-forming functional group may be prepared by converting a carboxyl group of a carboxylic acid containing a polymerizable double bond or a halide thereof to a functional group represented by the general formula (F-I) by the method as described in the literature references cited above and then subjecting the functional group-containing monomer to a polymerization reaction.

Also, a resin containing an oxazolone ring represented by the general formula (F-II) as a carboxyl group-forming functional group may be obtained by conducting a polymerization reaction of at least one monomer containing the oxazolone ring, if desired, in combination with other copolymerizable monomer(s). The monomer containing the oxazolone ring can be prepared by a dehydrating cyclization reaction of an N-acyloyl-α-amino acid containing a polymerizable unsaturated bond. More specifically, it can be prepared according to the method described in the literature references cited in Yoshio Iwakura and Keisuke Kurita, *Han-nosei Kobunshi,* Ch. 3, Kodansha.

The resin (A) may contain other polymer component(s) in addition to the above-described specific polymer components (a) and/or (b) in order to maintain its thermoplasticity. As such polymer components, those which form a homopolymer having a glass transition point of not more than 130° C. are preferred. More specifically, examples of such other polymer components include those corresponding to the repeating unit represented by the following general formula (U):

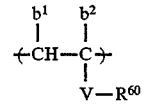

(U)

wherein V represents -COO-, -OCO-, -O-, -CO-, $-C_6H_4-$, $-(CH_2)_n-COO-$ or $-(CH_2)_n-OCO-$; n represents an integer of from 1 to 4; $R^{60}$ represents a hydrocarbon group having from 1 to 22 carbon atoms; and $b^1$ and $b^2$, which may be the same or different, each represents a hydrogen atom, a fluorine atom, a chlorine atom, a bromine atom, a cyano group, a trifluoromethyl group, a hydrocarbon group having from 1 to 7 carbon atoms (e.g., methyl, ethyl, propyl, butyl, pentyl, hexyl, phenyl and benzyl) or $-COOZ^{11}$ (wherein $Z^{11}$ represents a hydrocarbon group having from 1 to 7 carbon atoms).

Preferred examples of the hydrocarbon group represented by $R^{60}$ include an alkyl group having from 1 to 18 carbon atoms which may be substituted (e.g., methyl, ethyl, propyl, butyl, pentyl, hexyl, heptyl octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 2-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), and an aromatic group having from 6 to 12 carbon atoms which may be substituted (e.g., phenyl, tolyl, xylyl, mesityl, naphthyl, methoxyphenyl, ethoxyphenyl, fluorophenyl, methylfluorophenyl, difluorophenyl, bromophenyl, chlorophenyl, dichlorophenyl, methylcarbonylphenyl, methoxycarbonylphenyl, ethoxycarbonylphenyl, methanesulfonylphenyl, and cyanophenyl).

The content of one or more polymer components represented by the general formula (U) are preferably from 30 to 97% by weight based on the total polymer component in the resin (A).

The resin (A) may further contain a polymer component (f) containing a moiety having at least one of a fluorine atom and a silicon atom which is effective to increase the peelability of the resin (A) itself. Using such a resin, releasability of the transfer layer from the surface of electrophotographic light-sensitive element is increased and as a result, the transferability is improved.

The moiety having a fluorine atom and/or a silicon atom contained in the resin (A) includes that incorporated into the main chain of the polymer and that contained as a substituent in the side chain of the polymer.

The polymer component (f) is same as the polymer component containing a moiety having a fluorine atom and/or a silicon atom described with respect to the resin (P) used in the electrophotographic light-sensitive element hereinbefore.

The polymer components (f) are preferably present as a block in the resin (A). Embodiments of polymerization patterns of copolymer containing polymer components (f) as a block and methods for the preparation of the copolymer are the same as those described for the resin (P) comprising the fluorine atom and/or silicon atom-containing polymer components as a block described hereinbefore.

When two or more resins (A) having a glass transition point or softening point different from each other are employed, the polymer component (f) may be incorporated into any of these resins.

Suitable examples of the resin (A) containing the polymer component (f) are described in JP-A-6-289663.

The content of polymer component (f) is preferably from 1 to 20% by weight based on the total polymer component in the resin (A). If the content of polymer component (f) is less than 1% by weight, the effect for improving the releasability of the resin (A) is small and on the other hand, if the content is more than 20% by weight, wettability of the resin (A) with a processing solution may tend to decrease, resulting in some difficulties for complete removal of the transfer layer.

Moreover, the resin (A) may further contain other copolymerizable polymer components than the above described specific polymer components. Examples of monomers corresponding to such other polymer components include, in addition to methacrylic acid esters, acrylic acid esters and crotonic acid esters containing substituents other than those described for the general formula (U), α-olefins, vinyl or allyl esters of carboxylic acids (including, e.g., acetic acid, propionic acid, butyric acid, valeric acid, benzoic acid, naphthalenecarboxylic acid, as examples of the carboxylic acids), acrylonitrile, methacrylonitrile, vinyl ethers, itaconic acid esters (e.g., dimethyl ester, and diethyl ester), acrylamides, methacrylamides, styrenes (e.g., styrene, vinyltoluene, chlorostyrene, N,N-dimethylaminomethylstyrene, methoxycarbonylstyrene, methanesulfonyloxystyrene, and vinylnaphthalene), vinyl sulfone compounds, vinyl ketone compounds, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine). Such other polymer components may be employed in an appropriate range wherein the transferability of the resin (A) is not damaged. Specifically, it is preferred that the content of such other polymer components does not exceed 30% by weight based on the total polymer component of the resin (A).

If desired, the transfer layer may further contain other conventional resins in addition to the resin (A). It should be noted, however, that such other resins be used in a range that the easy removal of the transfer layer is not deteriorated. Specifically, the polymer components (a) and/or (b) are preferably present at least 3% by weight based on the total resin used in the transfer layer.

Examples of other resins which may be used in combination with the resin (A) include vinyl chloride resins, polyolefin resins, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy group-modified silicone resins, polycarbonate resins, ketone resins, polyester resins, silicone resins, amide resins, hydroxy group- or carboxy group-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including furan, tetrahydrofuran, thiophene, dioxane, dioxofuran, lactone, benzofuran, benzothiophene and 1,3-dioxethane rings), cellulose resins, fatty acid-modified cellulose resins, and epoxy resins.

Further, specific examples of usable resins are described, e.g., in *Plastic Zairyo Koza Series,* Vols. 1 to 18, Nikkan Kogyo Shinbunsha (1981), Kinki Kagaku Kyokai Vinyl Bukai (ed.), *Polyenka Vinyl,* Nikkan Kogyo Shinbunsha (1988), Eizo Omori, *Kinosei Acryl Jushi,* Techno System (1985), Ei-ichiro Takiyama, *Polyester Jushi Handbook,* Nikkan Kogyo Shinbunsha (1988), Kazuo Yuki, *Howa Polyester Jushi Handbook,* Nikkan Kogyo Shinbunsha (1989), Kobunshi Gakkai (ed.), *Kobunshi Data Handbook (Oyohen)*, Ch. 1, Baifukan (1986), Yuji Harasaki (ed.), *Saishin Binder Gijutsu Binran,* Ch. 2, Sogo Gijutsu Center (1985), Taira Okuda (ed.), *Kobunshi Kako,* Vol. 20, Supplement "Nenchaku", Kobunshi Kankokai (1976), Keizi Fukuzawa, *Nenchaku Gijutsu,* Kobunshi Kankokai (1987), Mamoru Nishiguchi, *Secchaku Binran,* 14th Ed., Kobunshi Kankokai (1985), and Nippon Secchaku Kokai (ed.), *Secchaku Handbook,* 2nd Ed., Nikkan Kogyo Shinbunsha (1980).

If desired, the transfer layer may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, microcrystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot -melt Secchaku no Jissai,* pp. 29 to 107, Kobunshi Kankokai (1983).

The transfer layer (T) may be composed of two or more layers in the present invention, if desired. In accordance with a preferred embodiment, the transfer layer is composed of a first transfer layer ($T_1$) which is adjacent to the electrophotographic light-sensitive element and which comprises a resin having a relatively high glass transition point or softening point, for example, one of the resins (AH) described above, and a second transfer layer ($T_2$) provided thereon which is adjacent to a receiving material and comprises a resin having a relatively low glass transition point or softening point, for example, one of the resins (AL) described above, and in which the difference in the glass transition point or softening point therebetween is at least 2° C. By introducing such a configuration of the transfer layer, transferability of the transfer layer onto a receiving material is remarkably improved, since adhesion of the transfer layer to the electrophotographic light-sensitive element and adhesion of the transfer layer to a receiving material in the non-image portion are controlled independently at the lower and upper interfaces of the transfer layer.

A thickness of the transfer layer (T) is preferably from 0.1 to 5 μm, and more preferably from 0.5 to 3 μm. When the thickness of transfer layer is 0.1 μm or more, the transfer is sufficiently performed. In order to save the amount of resin to be used, the upper limit thereof is preferably 5 μm, although the transfer layer having a greater thickness may be employed.

According to the method of the present invention, the transfer layer (T) is provided on the electrophotographic light-sensitive element, and then a toner image is formed thereon. While the transfer layer (T) can be provided on the electrophotographic light-sensitive element prior to the formation of toner image, it is preferred that the transfer layer (T) is provided each time on the light-sensitive in an apparatus for performing the electrophotographic process. By the installation of a device of providing the transfer layer in the apparatus for performing the electrophotographic process, the light-sensitive element can be repeatedly employed after the transfer layer is released therefrom. Therefore, it is advantageous in that the formation and release of transfer layer can be performed in sequence with the electrophotographic process in the electrophotographic apparatus. As a result, a cost for the preparation of printing plate can be remarkably reduced.

In order to provide the transfer layer (T) on the electrophotographic light-sensitive element in the present invention, conventional layer-forming methods can be employed. For instance, a solution or dispersion containing the composition for the transfer layer is applied onto the surface of electrophotographic light-sensitive element in a known manner. In particular, for the formation of transfer layer (T) on the surface of electrophotographic light-sensitive element, a hot-melt coating method, an electrodeposition coating method or a transfer method from a releasable support is preferably used. These methods are preferred in view of easy control of uniformity and thickness of the transfer layer and of easy formation of the transfer layer on the surface of electrophotographic light-sensitive element in an electrophotographic apparatus. Each of these methods will be described in greater detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above-mentioned *Hot-melt Secchaku no Jissai,* pp. 197 to 215 can be utilized with modification to suit with coating onto the electrophotographic light-sensitive element. Suitable examples of coating machines include a direct roll coater, an offset gravure roll coater, a rod coater, an extrusion coater, a slot orifice coater, and a curtain coater.

A melting temperature of the resin (A) at coating is usually in a range of from 50° to 180° C., while the optimum temperature is determined depending on the composition of the resin to be used. It is preferred that the resin is first molten using a closed preheating device having an automatic temperature controlling means and then heated in a short time to the desired temperature in a position to be coated on the light-sensitive element. To do so can prevent from degradation of the resin upon thermal oxidation and unevenness in coating.

A coating speed may be varied depending on flowability of the resin at the time of being molten by heating, a kind of coater, and a coating amount, etc., but is suitably in a range of from 1 to 100 mm/sec, preferably from 5 to 40 mm/sec.

Now, the electrodeposition coating method will be described below. According to this method, the resin (A) is electrostatically adhered or electrodeposited (hereinafter simply referred to as electrodeposition sometimes) on the surface of electrophotographic light-sensitive element in the form of resin grains and then transformed into a uniform thin film, for example, by heating, thereby providing the transfer layer. Grains of the resins (A) are sometimes referred to as resin grains (AR) hereinafter.

The resin grains must have either a positive charge or a negative charge. The electroscopicity of the resin grains is appropriately determined depending on a charging property of the light-sensitive element to be used in combination.

The resin grains may contain two or more resins, if desired. For instance, when a combination of resins, for example, those selected from the resins (AH) and (AL), whose glass transition points or softening points are different at least 2° C., preferably at least 5° C., from each other is used, improvement in transferability of the transfer layer formed therefrom to a receiving material and an enlarged latitude of transfer conditions can be achieved. The resin grains containing at least two kinds of resins therein are sometimes referred to as resin grains (ARW) hereinafter. In such a case, these resins may be present as a mixture in the grains or may form a layered structure such as a core/shell structure wherein a core part and a shell part are composed of different resins respectively. Resin grains having a core/shell structure wherein the core part is composed of one of the resin (AH) and the resin (AL) and the shell part is composed of the other are particularly preferred since the transfer layer formed therefrom can be transferred at a high speed under mild transfer conditions.

An average grain diameter of the resin grains having the physical property described above is generally in a range of from 0.01 to 5 μm, preferably from 0.05 to 1 μm and more preferably from 0.1 to 0.5 μm. The resin grains may be employed as grains dispersed in a non-aqueous system (in case of wet type), or grains dispersed in an electrically insulating organic substance which is solid at normal temperature but becomes liquid by heating (in case of pseudo-wet type). The resin grains dispersed in a non-aqueous system are preferred since they can easily prepare a thin layer of uniform thickness.

The resin grains used in the present invention can be produced by a conventionally known mechanical powdering method or polymerization granulation method.

The mechanical powdering method includes a method wherein a resin is dispersed together with a dispersion polymer in a wet type dispersion machine (for example, a ball mill, a paint shaker, Keddy mill, and Dyno-mill), and a method wherein a material for resin grain and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan,* Kyoritsu Shuppan (1971), D. H. Solomon, *The Chemistry of Organic Film Formers,* John Wiley & Sons (1967), *Paint and Surface Coating Theory and Practice,* Yuji Harasaki, *Coating Kogaku,* Asakura Shoten (1971), and Yuji Harasaki, *Coating no Kiso Kagaku,* Maki Shoten (1977).

The polymerization granulation method includes a dispersion polymerization method in a non-aqueous system conventionally known and is specifically described, for example, in Fumio Kitahara et al, *Bunsanryukakei no Kagaku,* Kogaku Tosho (1979), Soichi Muroi (supervised), *Chobiryushi Polymer no Saisentan Gijutsu,* C.M.C. (1991), Koichi Nakamura (ed.), *Saikin no Denshishashin Genzo System to Toner Zairyo no Kaihatsu·Jitsuyoka,* Ch. 3, Nippon Kogaku Joho (1985), and K. E. J. Barrett, *Dispersion Polymerization in Organic Media,* John Wiley & Sons (1975).

The resin grains (ARW) containing at least two kinds of resins having different glass transition points or softening points from each other therein described above can be prepared easily using the seed polymerization method. Specifically, fine grains composed of the first resin are prepared by a conventionally known dispersion polymerization method in a non-aqueous system and then using these fine grains as seeds, a monomer corresponding to the second resin is supplied to conduct polymerization in the same manner as above.

The resin grains (AR) composed of a random copolymer containing the polymer component (f) to increase the peelability of the resin (A) can be easily obtained by performing a polymerization reaction using one or more monomers forming the resin (A) which are soluble in an organic solvent but becomes insoluble therein by being polymerized together with a monomer corresponding to the polymer component (f) according to the polymerization granulation method described above.

The resin grains (AR) containing the polymer component (f) as a block can be prepared by conducting a polymerization reaction using, as a dispersion stabilizing resins, a block copolymer containing the polymer component (f) as a block, or conducting polymerization reaction using a monofunctional macromonomer having a weight average molecular weight of from $1\times10^3$ to $2\times10^4$, preferably from $3\times10^3$ to $1.5\times10^4$ and containing the polymer component (f) as the main repeating unit together with one or more monomers forming the resin (A). Alternatively, the resin grains composed of block copolymer can be obtained by conducting a polymerization reaction using a polymer initiator (for example, azobis polymer initiator or peroxide polymer initiator) containing the polymer component (f) as the main repeating unit.

As the non-aqueous solvent used in the dispersion polymerization method in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of monodisperse system with a very narrow distribution of grain diameters.

A dispersive medium used for the resin grains dispersed in a non-aqueous system is preferably a non-aqueous solvent having an electric resistance of not less than $10^8$ Ω·cm and a dielectric constant of not more than 3.5, since the dispersion is employed in a method wherein the resin grains are electrodeposited utilizing a wet type electrostatic photographic developing process or electrophoresis in electric fields.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

Another method for the preparation of a dispersion of resin grains in non-aqueous system is that a block copolymer comprising a polymer portion which is soluble in the above-described non-aqueous solvent having an electric resistance of not less than $10^8$ Ω·cm and a dielectric constant of not more than 3.5 and a polymer portion which is insoluble in the non-aqueous solvent, is dispersed in the non-aqueous solvent by a wet type dispersion method. Specifically, the block copolymer is first synthesized in an organic solvent which dissolves the resulting block copolymer according to the synthesis method of block copolymer as described above and then dispersed in the non-aqueous solvent described above.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu·Jitsuyoka,* pp. 139 to 148, mentioned above, Denshishashin Gakkai (ed.), *Denshishashin Gijutsu no Kiso to Oyo,* pp. 497 to 505, Corona Sha (1988), and Yuji Harasaki, *Denshishashin,* Vol. 16, No. 2, p. 44 (1977). Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965 are also employed.

The dispersion of resin grains in a non-aqueous system (latex) which can be employed for electrodeposition usually comprises from 0.1 to 20 g of grains mainly containing the resin (A), from 0.01 to 50 g of a dispersion stabilizing resin and if desired, from 0.0001 to 10 g of a charge control agent per one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, silicone oil, paraffin wax and triazine derivatives. The total amount of these additives is restricted by the electric resistance of the dispersion. Specifically, if the electric resistance of the dispersion in a state of excluding the grains therefrom becomes lower than $10^8$ Ω·cm, a sufficient amount of the resin grains deposited is reluctant to obtain and, hence, it is necessary to control the amounts of these additives in the range of not lowering the electric resistance than $10^8$ Ω·cm.

The resin grains which are prepared, provided with an electrostatic charge and dispersed in an electrically insulting liquid behave in the same manner as an electrophotographic wet type developing agent. For instance, the resin grains can be subjected to electrophoresis on the surface of electrophotographic light-sensitive element using a developing device, for example, a slit development electrode device as described in *Denshishashin Gijutsu no Kiso to Oyo,* pp. 275 to 285, mentioned above. Specifically, the grains comprising the resin (A) are supplied between the electrophotographic light-sensitive element and an electrode placed in face of the electrophotographic light-sensitive element, and migrated by electrophoresis according to a potential gradient applied from an external power source to cause the grains to adhere to or electrodeposit on the electrophotographic light-sensitive element, thereby forming a film.

In general, if the charge of grains is positive, an electric voltage was applied between an electroconductive support of the light-sensitive element and a development electrode of a developing device from an external power source so that the light-sensitive element is negatively charged, whereby the grains are electrostatically electrodeposited on the surface of light-sensitive element.

Electrodeposition of grains can also be performed by wet type toner development in a conventional electrophotographic process. Specifically, the electrophotographic light-sensitive element is uniformly charged and then subjected to a conventional wet type toner development as described in *Denshishashin Gijutsu no Kiso to Oyo,* pp. 46 to 79, mentioned above.

The medium for the resin grains dispersed therein which becomes liquid by heating is an electrically insulating organic compound which is solid at normal temperature and becomes liquid by heating at temperature of from 30° C. to 80° C., preferably from 40° C. to 70° C. Suitable compounds include paraffins having a solidifying point of from 30° C. to 80° C., waxes, low molecular weight polypropylene having a solidifying point of from 20° C. to 80° C., beef tallow having a solidifying point of from 20° C. to 50° C. and hardened oils having a solidifying point of from 30° C. to 80° C. They may be employed individually or as a combination of two or more thereof.

Other characteristics required are same as those for the dispersion of resin grains used in the wet type developing method.

The resin grains used in the pseudo-wet type electrodeposition according to the present invention can stably maintain their state of dispersion without the occurrence of heat adhesion of dispersed resin grains by forming a core/shell structure wherein the core portion is composed of a resin having a lower glass transition point or softening point and the shell portion is composed of a resin having a higher glass transition point or softening point which is not softened at the temperature at which the medium used becomes liquid.

The amount of resin grain adhered to the electrophotographic light-sensitive element can be appropriately controlled, for example, by modifying an external bias voltage applied, a potential of the electrophotographic light-sensitive element charged and a processing time.

After the electrodeposition of grains, the liquid is wiped off upon squeeze using a rubber roller, a gap roller or a reverse roller. Other known methods, for example, corona squeeze and air squeeze can also be employed. Then, the deposit is dried with cool air or warm air or by a infrared lamp preferably to be rendered the resin grains in the form of a film, thereby providing the transfer layer.

Moreover, the electrodeposition of grains is conducted which heating the surface of electrophotographic light-sensitive element to adjust a desired temperature, whereby resin grains are electrodeposited and converted to a film simultaneously. The temperature for heating the electrophotographic light-sensitive element is in a range of temperature which does not adversely affect the electrophotographic characteristics of electrophotographic light-sensitive element, preferably not more than 80° C., and more preferably not more than 60° C.

The electrodeposition coating method is particularly preferred since a device used therefor is simple and compact and a uniform layer of a small thickness can be stably and easily prepared.

Now, the formation of transfer layer by the transfer method from a releasable support will be described below. According to this method, the transfer layer provided on a releasable support typically represented by release paper (hereinafter simply referred to as release paper) is transferred by heating onto the surface of electrophotographic light-sensitive element.

The release paper having the transfer layer thereon is simply supplied to a transfer device in the form of a roll or sheet.

The release paper which can be employed in the present invention include those conventionally known as described, for example, in *Nenchaku (Nensecchaku) no Shin Gijutsu to Sono Yoto·Kakushu Oyoseihin no Kaihatsu Siryo,* published by Keiei Kaihatsu Center Shuppan-bu (May 20, 1978), and *All Paper Guide Shi no Shohin Jiten, Jo Kan, Bunka Sangyo Hen,* published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% by weight is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Oji Paper Co., Ltd.), King Rease (manufactured by Shikoku Seishi K.K.), San Release (manufactured by Sanyo Kokusaku Pulp K.K.) and NK High Release (manufactured by Nippon Kako Seishi K.K.).

In order to form the transfer layer on release paper, a composition for the transfer layer mainly composed of the resin (A) is applied to releasing paper in a conventional manner, for example, by bar coating, spin coating or spray coating to form a film. The transfer layer may also be formed on release paper by a hot-melt coating method or an electrodeposition coating method.

Figure 4:
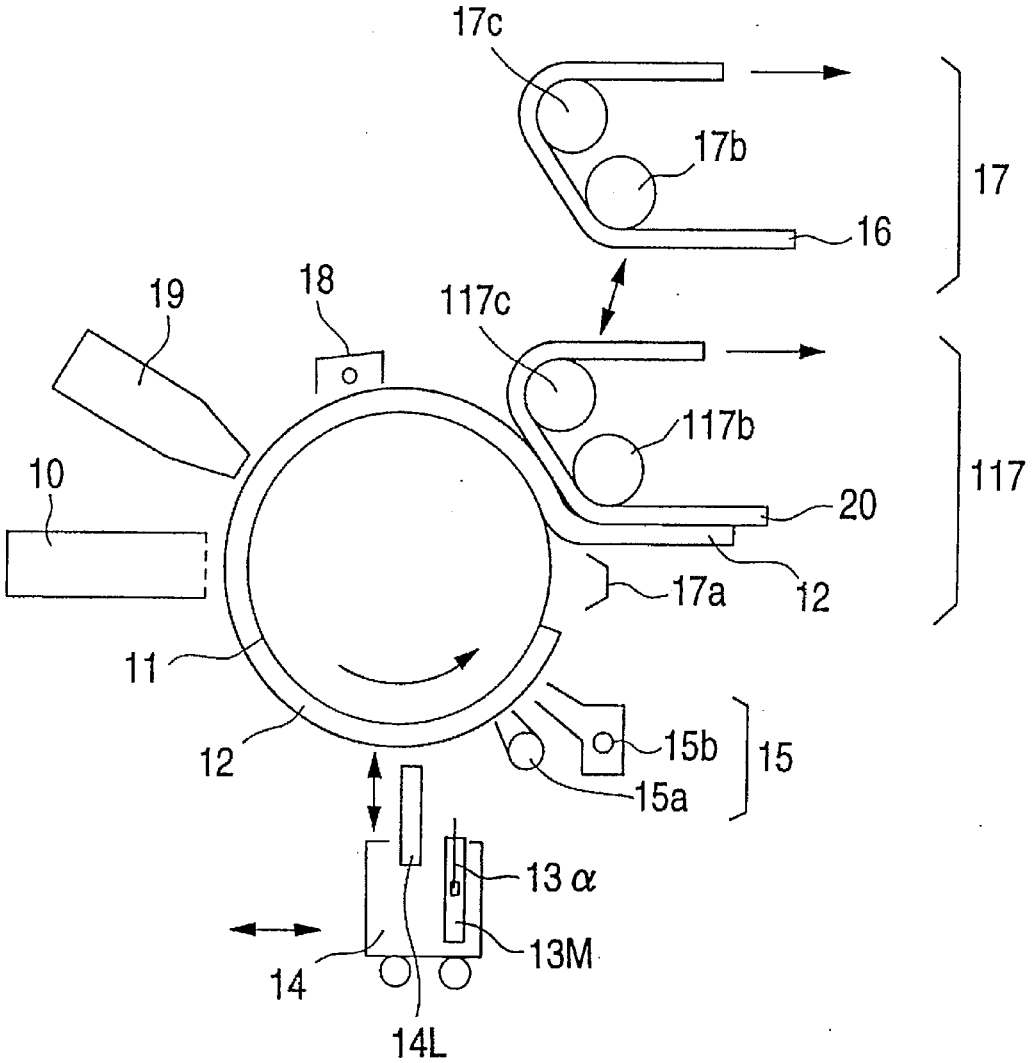
FIG. 4 is a schematic view of an electrophotographic plate-making apparatus suitable for performing the method according to the present invention in which a transfer method from a releasable support is used for the formation of transfer layer.

For a purpose of heat transfer of the transfer layer on release paper to the electrophotographic light-sensitive element, conventional heat transfer methods are utilized. Specifically, release paper having the transfer layer thereon is pressed on the electrophotographic light-sensitive element to heat transfer the transfer layer. For instance, a device shown in FIG. 4 is employed for such a purpose.

The conditions for transfer of the transfer layer from release paper to the surface of electrophotographic light-sensitive element are preferably as follows. A nip pressure of roller is from 0.1 to 10 kgf/cm$^2$ and more preferably from 0.2 to 8 kgf/cm$^2$. A temperature at the transfer is from 25° to 100° C. and more preferably from 40° to 80° C. A speed of the transportation is from 0.5 to 300 mm/sec and more preferably from 3 to 200 mm/sec. The speed of transportation may differ from that of the electrophotographic step, or that of the heat transfer step of the transfer layer to a receiving material.

On the transfer layer (T) provided on the electrophotographic light-sensitive element having the releasable surface is formed a toner image. For the formation of toner image, a conventional electrophotographic process can be utilized. Specifically, each step of charging, light exposure, development and fixing is performed in a conventionally known manner.

In order to form the toner image by an electrophotographic process according to the present invention, any methods and apparatus conventionally known can be employed.

The developers which can be used in the present invention include conventionally known developers for electrostatic photography, either dry type or liquid type. For example, specific examples of the developer are described in *Denshishashin Gijutsu no Kiso to Oyo, supra,* pp. 497–505, mentioned above, Koichi Nakamura (ed.), *Toner Zairyo no Kaihatsu·Jitsuyoka,* Ch. 3, Nippon Kagaku Joho (1985), Gen Machida, *Kirokuyo Zairyo to Kankosei Jushi,* pp. 107–127 (1983), and Denshishasin Gakkai (ed.), *Imaging,* Nos. 2–5, "Denshishashin no Genzo·Teichaku·Taiden·Tensha", Gakkai Shuppan Center.

Dry developers practically used include one-component magnetic toners, two-component toners, one-component non-magnetic toners, and capsule toners. Any of these dry developers may be employed in the present invention.

The typical liquid developer is basically composed of an electrically insulating organic solvent, for example, an isoparaffinic aliphatic hydrocarbon (e.g., Isopar H or isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic dye or pigment) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin,* Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly composed of a resin (and, if desired, a colorant) are preferably present in an amount of from 0.5 to 50 parts by weight per 1000 parts by weight of a carrier liquid. If the toner content is less than 0.5 part by weight, the image density is insufficient, and if it exceeds 50 parts by weight, the occurrence of fog in the non-image portion may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

Particularly, a combination of a scanning exposure system using a laser beam based on digital information and a development system using a liquid developer is an advantageous process since the process is particularly suitable to form highly accurate images.

One specific example of the methods for preparing a toner image is illustrated below. An electrophotographic light-sensitive element having the transfer layer (T) provided thereon is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo,* p. 212 et seq., Corona Sha (1988). A corotron or scotton system is usually used for the charging process. In a preferred charging process, the charging conditions may be controlled by a feedback system of the information on charged potential from a detector connected to the electrophotographic light-sensitive element thereby to control the surface potential within a predetermined range.

Thereafter, the charged electrophotographic light-sensitive element is exposed to light by scanning with a laser beam in accordance with the system described, for example, in *ibidem,* p. 254 et seq.

Toner development is then conducted using a liquid developer. The electrophotographic light-sensitive element charged and exposed is removed from the flat bed and developed according to a wet type developing method as described, for example, in *ibidem,* p. 275 et seq. The exposure mode is determined in accordance with the toner image development mode. Specifically, in case of reversal development, a negative image is irradiated with a laser beam, and a toner having the same charge polarity as that of the charged electrophotographic light-sensitive element is electrodeposited on the exposed area with a bias voltage applied. For the details, reference can be made to *ibidem,* p. 157 et seq.

After the toner development, the electrophotographic light-sensitive element is squeezed to remove the excess developer as described in *ibidem,* p. 283 and dried preferably, the electrophotographic light-sensitive element is rinsed with the carrier liquid used in the liquid developer before squeezing.

According to the method of the present invention, after the toner image is formed on the transfer layer (T), an adhesive layer (M) is selectively provided only on the toner image and then the toner image is collectively transferred together with the transfer layer (T) and the adhesive layer (M) to a receiving material.

By providing the adhesive layer selectively on the toner image according to the present invention, the toner image firmly adheres to the receiving material even when an original of a high image area ratio is used or when the kind of toner or receiving material is varied. As a result, excellent transfer ability of toner image is maintained at a high transfer speed, and fine lines (e.g., lines of 10 μm in width), fine letters (e.g., 2.2 point size of Ming-zhas character) and dots (e.g., a range of from 2% to 98% in dots of 165 lines per inch) are faithfully reproduced without the occurrence of spread of image and distortion of line, whereby the excellent transferred image is formed on the receiving material.

For the resin (B) used in the adhesive layer (M), it is not necessary to take insulating property for maintaining electrophotographic characteristics and removability by a chemical reaction treatment into consideration different from a case of the resin (A) since the adhesive layer is provided on the toner image after the formation thereof and is not removed by the chemical reaction treatment.

The resin (B) generally has a glass transition point of from −50° C. to 75° C. or a softening point of from −30° C. to 90° C., and it has a glass transition point or softening point lower, preferably at least 2° C. lower, more preferably from 5° C. to 40° C. lower than one of the resin (A) used in the transfer layer (T). The difference in the glass transition point or softening point between the resin (A) and the resin (B) means a difference between the lowest glass transition point or softening point of those of the resins (A) and the glass transition point or softening point of the resin (B) when two or more of the resins (A) are employed.

The resin (B) may be employed individually or in combination of two or more thereof. When two or more of the resins (B) are employed, it is preferred that a difference between the lowest glass transition point or softening point of those of the resins (A) used in the transfer layer (T) and the highest glass transition point or softening point of those of the resin (B) used in the adhesive layer (M) is at least 2° C.

A ratio of the resin (B) which has the lowest glass transition point or softening point in the adhesive layer (M) is preferably not less than 30% by weight, more preferably not less than 50% by weight.

The resins (B) which can be used in the adhesive layer (M) are resins which fulfill the above-described thermal condition and include thermoplastic resins and resins conventionally known as adhesive or stick. Suitable examples of these resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, olefin-styrene copolymers, olefin-unsaturated carboxylic ester copolymers, acrylonitrite copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, acrylamide copolymers, methacrylamide copolymers, polycarbonate resins, ketone resins, polyester resins, amide resins, butyral resins, polyvinyl acetal resins, cyclized rubber-methacrylic ester copolymers, cyclized rubber-acrylic ester copolymers, copolymers containing a heterocyclic ring (the heterocyclic ring including, for example, furan, tetrahydrofuran, thiophene, dioxane, dioxofuran, lactone, benzofuran, benzothiophene and 1,3-dioxetane rings), and cellulose resins.

Specific examples of resins are described, e.g., in *Plastic Zairyo Koza Series,* Vols. 1 to 18, Nikkan Kogyo Shinbunsha (1981), Kinki Kagaku Kyokai Vinyl Bukai (ed.), *Polyenka Vinyl,* Nikkan Kogyo Shinbunsha (1988), Eizo Omori, *Kinosei Acryl Jushi,* Techno System (1985), Ei-ichiro Takiyama, *Polyester Jushi Handbook,* Nikkan Kogyo Shinbunsha (1988), Kazuo Yuki, *Howa Polyester Jushi Handbook,* Nikkan Kogyo Shinbunsha (1989), Kobunshi Gakkai (ed.), *Kobunshi Data Handbook (Oyo-hen),* Ch. 1, Baifukan (1986), Yuji Harasaki, *Saishin Binder Gijutsu Binran,* Ch. 2, Sogo Gijutsu Center (1985), Taira Okuda (ed.), *Kobunshi Kako,* Vol. 20, Supplement "Nenchaku", Kobunshi Kankokai (1976), Keizi Fukuzawa, *Nenchaku Gijutsu,* Kobunshi Kankokai (1987), Mamoru Nishiguchi, *Secchaku Binran,* 14th Ed., Kobunshi Kankokai (1985), and Nippon Secchaku Kokai (ed.), *Secchaku Handbook,* 2nd Ed., Nikkan Kogyo Shinbunsha (1980).

In order to provide the adhesive layer (M) only on the toner image, there are, for example, a method for forming the adhesive layer (M) in the same manner as in the liquid development in the electrophotographic process and a wet type electrodeposition method wherein resin grains of the resin (B) (sometimes referred to as "resin grains (BR)") are dispersed in a dispersing medium and are selectively migrated by electrophoresis only on the toner image utilizing the residual electric charge remaining on the toner image after the formation of toner image, thereby forming the adhesive layer (M).

For the purpose of forming the adhesive layer (M) selectively on the toner image, a difference in a potential of electric charge due to whether the toner image is present or not can be utilized. Specifically, when the electrophotographic light-sensitive element having the toner image formed thereon is electrically charged, the image portion has a higher electric charge in comparison with other portions. The charging is preferably conducted using a non-contact type corona discharger such as corotron or scotron. A bias voltage of more than the electric potential of non-image portion but less than that of image portion is applied to a development electrode during the formation of adhesive layer, whereby the adhesive layer is selectively formed on the toner image.

Alternatively, the adhesive layer (M) is selectively formed on the toner image by conducting the charging and exposure in the same manner as in the formation of toner image and then a wet type electrodeposition method based on electrophoresis using a non-aqueous dispersion of grains of the resin (B) in place of the liquid development.

These methods are suitable for easily forming the adhesive layer (M) of a uniform and small thickness only on the toner image.

The formation of grains of Resin (B) and preparation of dispersion of electroscopic resin grains including a pseudo-wet type are performed in the same manner as in the electrodeposition method of the resin (A) described above.

An average grain diameter of the resin grain (BR) is usually in a range of from 0.01 to 5 μm, preferably from 0.05 to 1 μm, and more preferably from 0.1 to0.5 μm.

A thickness of the adhesive layer (M) is preferably in a range of from 0.1 to 5 μm, and more preferably from 0.5 to 3 μm. In the range described above, the adhesive layer having a uniform and small thickness can be easily prepared, and the advantages of the present invention are effectively obtained using the minimum amount of resin to be needed.

In the method of the present invention, the toner image is transferred to a receiving material while putting between the transfer layer (T) easily peelable from the surface of electrophotographic light-sensitive element and the adhesive layer (M) easily adherable to the receiving material. Specifically, the toner image is transferred from the electrophotographic light-sensitive element to the receiving material by bringing the electrophotographic light-sensitive element into contact with the receiving material under the application of a low temperature and/or a low pressure. This is especially advantageous for simplification and reduction in time of the transfer step.

The contact transfer of toner image can be conducted using known procedures and devices. For instance, a receiving material is pressed on the electrophotographic light-sensitive element bearing the toner image by a heating roller and then passed under a roller for release, whereby the transfer layer bearing the toner image and the adhesive layer is separated from the electrophotographic light-sensitive element and transferred to the receiving material. In the case, the roller for release is not necessarily cooled. The electrophotographic light-sensitive element may be preheated in the desired temperature range by a heating means, preferably a non-contact type heater such as an infrared line heater or a flash heater, if desired. The receiving material may be pre-heated, if desired.

The roller for release comprises a metal roller which has a good thermal conductivity such as aluminum, copper or the like and is covered with silicone rubber. The roller may be provided with a cooling means therein or on a portion of the outer surface which is not brought into contact with the receiving material in order to radiate heat. The cooling means includes a cooling fan, a coolant circulation or a thermoelectric cooling element, and if desired, the cooling means may be coupled with a temperature controller so that the temperature of the roller is maintained within a predetermined range.

The surface temperature of electrophotographic light-sensitive element at the time of heat-transfer is preferably in a range of from 30° to 120° C., and more preferably from 35°to 90° C. The nip pressure of roller is preferably in a range of from 0.2 to 15 kgf/cm$^2$ and more preferably from 0.5 to 10 kgf/cm$^2$. The roller may be pressed by springs provided on opposite ends of the roller shaft or by an air cylinder using compressed air. A speed of the transportation is preferably in a range of from 1 to 300 mm/sec and more preferably in a range of from 50 to 250 mm/sec. The speed of transportation may be different from that of the other step.

It is needless to say that the above-described conditions for the transfer of toner image should be optimized depending on the physical properties of the electrophotographic light-sensitive element (i.e., the light-sensitive layer and the support), the transfer layer, the adhesive layer and the receiving material used. Especially it is important to determine the conditions of temperature in the heat transfer step taking into account the factors such as glass transition point, softening temperature, flowability, tackiness, film properties and thickness of the transfer layer.

The receiving material used in the present invention is any of material which provide a hydrophilic surface suitable for lithographic printing. Supports conventionally used for offset printing plates (lithographic printing plates) can be preferably employed. Specific examples of support include a substrate having a hydrophilic surface, for example, a plastic sheet, paper having been rendered durable to printing, an aluminum plate, a zinc plate, a bimetal plate, e.g., a copper-aluminum plate, a copper-stainless steel plate, or a chromium-copper plate, a trimetal plate, e.g., a chromium-copper-aluminum plate, a chromium-lead-iron plate, or a chromium-copper-stainless steel plate. The support preferably has a thickness of from 0.1 to 3 mm, and particularly from 0.1 to 1 mm.

A support with an aluminum surface is preferably subjected to a surface treatment, for example, surface graining, immersion in an aqueous solution of sodium silicate, potassium fluorozirconate or a phosphate, or anodizing. Also, an aluminum plate subjected to surface graining and then immersion in a sodium silicate aqueous solution as described in U.S. Pat. No. 2,714,066, or an aluminum plate subjected to anodizing and then immersion in an alkali silicate aqueous solution as described in JP-B-47-5125 is preferably employed.

Anodizing of an aluminum surface can be carried out by electrolysis in an electrolytic solution comprising at least one aqueous or nonaqueous solution of an inorganic acid (e.g., phosphoric acid, chromic acid, sulfuric acid or boric acid) or an organic acid (e.g., oxalic acid or sulfamic acid) or a salt thereof to oxidize the aluminum surface as an anode.

Silicate electrodeposition as described in U.S. Pat. No. 3,658,662 or a treatment with polyvinylsulfonic acid described in West German Patent Application (OLS) 1,621, 478 is also effective.

The surface treatment is conducted for rendering the surface of a receiving material hydrophilic.

Further, in order to control an adhesion property between the receiving material and the adhesive layer, a surface layer may be provided on the surface of the receiving material.

A plastic sheet or paper as the receiving material should have a hydrophilic surface layer, as a matter of course, since its areas other than those corresponding to the toner images must be hydrophilic. Specifically, a receiving material having the same performance as a known direct writing type lithographic printing plate precursor or an image-receptive layer thereof may be employed.

In the present invention, an apparatus for preparation of a printing plate precursor by an electrophotographic process comprising a means for forming a toner image on a transfer layer (T) provided on an electrophotographic light-sensitive element by an electrophotographic process, a means for providing an adhesive layer (M) on the toner image, and a means for transferring the toner image together with the transfer layer (T) and the adhesive layer (M) from the electrophotographic light-sensitive element to a receiving material is employed. The apparatus may further comprise a means for providing the transfer layer (T) on the electrophotographic light-sensitive element.

Moreover, a means for applying a compound (S) to a surface of the electrophotographic light-sensitive element may be provided in the apparatus described above.

Now, the preparation of a printing plate precursor using an electrophotographic process which is suitable for producing a printing plate according to the present invention by an oil-desensitizing treatment will be described in more detail as well as apparatus useful therefor with reference to the accompanying drawings hereinbelow.

Figure 2:
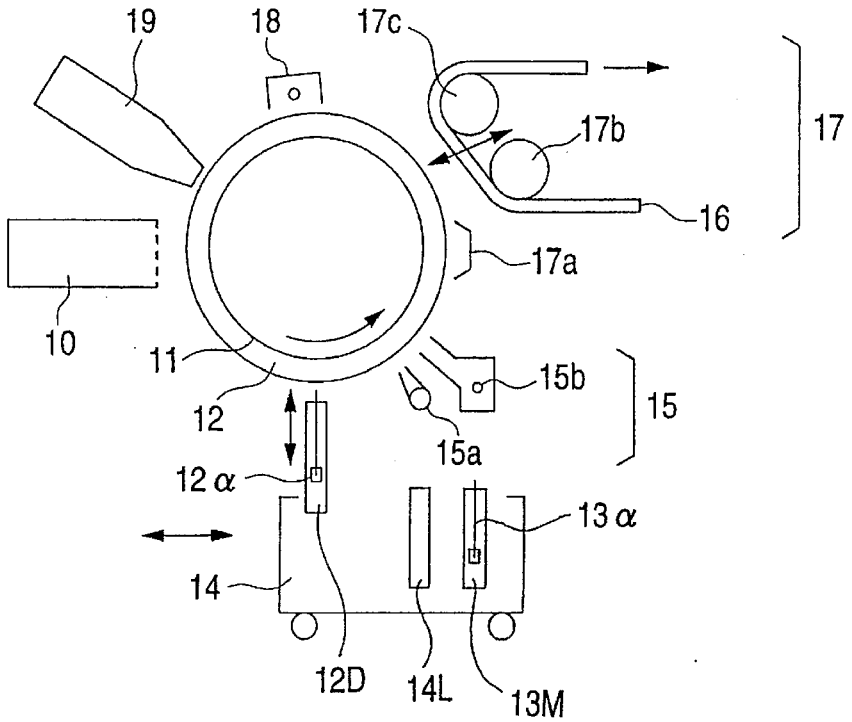
FIG. 2 is a schematic view of an electrophotographic plate-making apparatus suitable for performing the method according to the present invention in which an electrodeposition coating method is used for the formation of transfer layer.

FIG. 2 is a schematic view of an apparatus for preparation of a printing plate precursor by an electrophotographic process suitable for conducting the method according to the present invention.

As described above, when an electrophotographic light-sensitive element 11 whose surface has been modified to have the desired releasability, a transfer layer (T) 12 is formed on the electrophotographic light-sensitive element. On the other hand, when releasability of the surface of electrophotographic light-sensitive element 11 is insufficient, the compound (S) is applied to the surface of electrophotographic light-sensitive element before the formation of transfer layer (T), whereby the desired releasability is imparted to the surface of electrophotographic light-sensitive element. Specifically, the compound (S) is supplied from an applying unit for compound (S) 10 which utilizes any one of the embodiments as described above onto the surface of electrophotographic light-sensitive element 11. The applying unit for compound (S) 10 may be stationary or movable.

On the electrophotographic light-sensitive element 11 is now provided the transfer layer (T) 12. In this embodiment, the transfer layer is formed by the electrodeposition coating method. An electrodeposition unit for forming transfer layer (T) 12D containing a dispersion of resin grains for forming transfer layer (T) 12α is first brought near the surface of electrophotographic light-sensitive element 11 and is kept stationary with a gap of 1 mm between the surface thereof and a development electrode of the electrodeposition unit 12D. The electrophotographic light-sensitive element is rotated while supplying the dispersion of resin grains 12α into the gap and applying an electric voltage across the gap from an external power source (not shown), whereby the grains are deposited over the entire areas of the surface of the electrophotographic light-sensitive element 11.

A solvent in the dispersion of resin grains adhering to the surface of the electrophotographic light-sensitive element is removed by a squeezing device built in the electrodeposition unit 12D. Then the resin grains are fused by a heating means and thus the transfer layer (T) 12 in the form of resin film is obtained.

In order to conduct the exhaustion of solvent in the dispersion, the suction/exhaust unit 15 provided for an electrophotographic process of the electrophotographic light-sensitive element may be employed. The electrodeposition unit 12D is built in the liquid developing unit set 14 as described above or is provided separately from the developing unit.

The electrophotographic light-sensitive element is then subjected to the electrophotographic process. While a dry developer can be utilized in the development step according to the present invention as described above, a liquid developer is employed in the following embodiment since a duplicated image having high definition can be obtained.

The electrophotographic light-sensitive element 11 having the transfer layer 12 provided thereon is uniformly charged to, for instance, a positive polarity by a corona charger 18 and then is exposed imagewise by an exposure device (e.g., a semi-conductor laser) 19 on the basis of image information, whereby an electric potential is lowered in the exposed regions and thus, a contrast in the electrical potential is formed between the exposed regions and the unexposed regions. A liquid developing unit 14L containing a liquid developer comprising resin grains having a positive electrostatic charge dispersed in an electrically insulating liquid is brought near the electrophotographic light-sensitive element 11 from a liquid developing unit set 14 and is kept stationary with a gap of 1 mm therebetween.

The electrophotographic light-sensitive element 11 having the transfer layer (12) is first pre-bathed by a pre-bathing means provided in the liquid developing unit 14L, and then the liquid developer is supplied on the electrophotographic light-sensitive element while applying a developing bias voltage between the electrophotographic light-sensitive element and a development electrode by a bias voltage source and wiring (not shown). The bias voltage is applied so that it is slightly lower than the surface electrical potential of the unexposed regions, while the development electrode is charged to positive and the electrophotographic light-sensitive element is charged to negative. When the bias voltage applied is too low, a sufficient density of the toner image cannot be obtained.

The liquid developer adhering to the electrophotographic light-sensitive element is subsequently washed off by a rinsing means provided in the liquid developing unit 14L and the rinse solution adhering to the electrophotographic light-sensitive element is removed by a squeeze means. Then, the electrophotographic light-sensitive element is dried by passing under a suction/exhaust unit 15. As the pre-bathing solution and the rinse solution, a carrier liquid for the liquid developer is ordinarily used.

After the formation of toner image on the electrophotographic light-sensitive element having the transfer layer by the electrophotographic process, the adhesive layer (M) is selectively provided only on the toner image in a manner similar to the electrodeposition coating method for providing the transfer layer (T) described above. The electrophotographic light-sensitive element bearing the tone image is uniformly charged, and then electrodeposition is conducted using an electrodeposition unit for forming adhesive layer (M) 13M containing a dispersion of resin grains for forming adhesive layer (M) 13α while applying a definite bias voltage to a development electrode of the electrodeposition unit so as to electrodeposit a desired amount of the resin grains on the toner image. For rinsing and exhaustion of solvent in the dispersion, the devices provided for the electrophotographic process are preferably employed as in the formation of transfer layer described above.

Then, a receiving material is pressed on the electrophotographic light-sensitive element having thereon the transfer layer, the toner image and the adhesive layer to heat-transfer the toner image together with the transfer layer and the adhesive layer from the electrophotographic light-sensitive element onto the receiving material. Specifically, the receiving material 16 which may be pre-heated in the desired range of temperature by a back-up roller for transfer **17*b* is pressed on the electrophotographic light-sensitive element and then passed under a back-up roller for release 17*c*, thereby transferring the toner image to the receiving material 16 together with the transfer layer and the adhesive layer. The back-up roller for release 17*c*** may be cooled, if desired. Thus a cycle of steps is terminated.

In the event of imparting the desired releasability onto the surface of electrophotographic light-sensitive element 11, by stopping the apparatus in the stage where the compound (S) has been applied thereon by the applying unit for compound (S) 10, the next operation can start with the step of formation of transfer layer.

Further, in order to provide the transfer layer (T) on the electrophotographic light-sensitive element, the hot-melt coating method or the transfer method from a release support can be employed in place of the electrodeposition coating method described above. A device used for such method is preferably movable.

Figure 3:
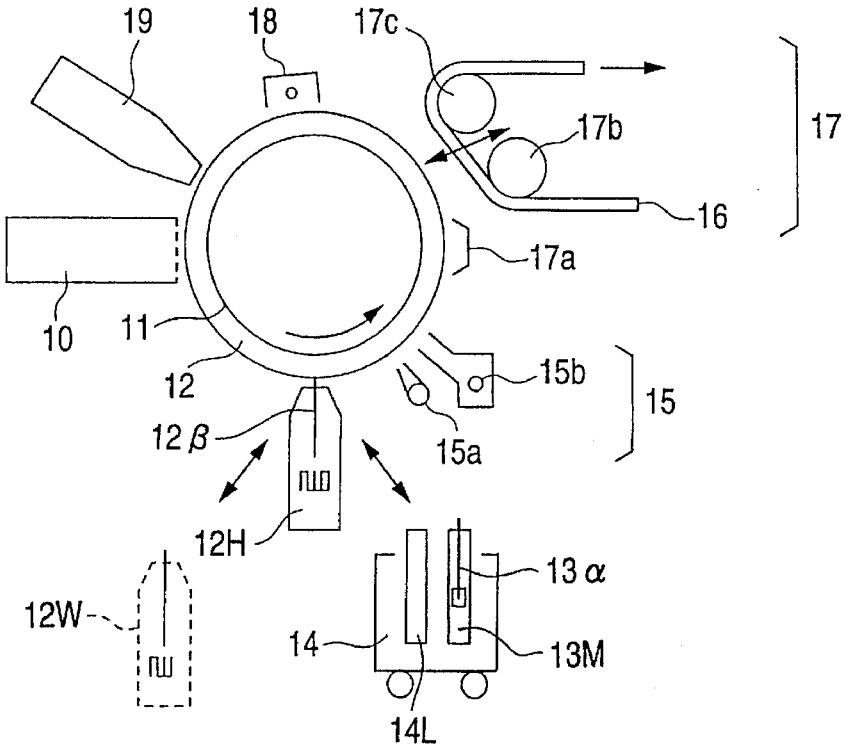
FIG. 3 is a schematic view of an electrophotographic plate-making apparatus suitable for performing the method according to the present invention in which a hot-melt coating method is used for the formation of transfer layer.

In case of using the hot-melt coating method, as schematically shown in FIG. 3, a resin for forming transfer layer (T) 12β is coated on the surface of electrophotographic light-sensitive element 11 provided on the peripheral surface of a drum by a hot-melt coater 12H and is caused to pass under a suction/exhaust unit 15 to be cooled to a predetermined temperature to form the transfer layer (T) 12 on the electrophotographic light-sensitive element 11. Thereafter, the hot-melt coater 12H is moved to a stand-by position 12W.

A device for forming the transfer layer (T) on the electrophotographic light-sensitive element using release paper is schematically shown in FIG. 4. In FIG. 4, release paper 20 having thereon the transfer layer (T) 12 is heat-pressed on the electrophotographic light-sensitive element 11 by a heating roller **117*b*, whereby the first transfer layer (T) 12 is transferred on the surface of light-sensitive element 11. The release paper 20 is cooled by a cooling roller 117*c* and recovered. The electrophotographic light-sensitive element is pre-heated by a heating means 17*a* to improve transferability of the transfer layer 12** at the heat-press, if desired.

Both the transfer unit to light-sensitive element 117 for transfer the transfer layer (T) 12 from release paper 20 to the electrophotographic light-sensitive element 11 and the transfer unit to receiving material 17 for transfer the transfer layer (T) together with the toner image and the adhesive layer (M) to the receiving material 16 are installed in the apparatus as shown in FIG. 4.

Alternatively, a transfer unit to light-sensitive element 117 in FIG. 4 is first employed to transfer the transfer layer (T) 12 from release paper 20 to an electrophotographic light-sensitive element 11 and then the transfer unit may also be used for transfer of the transfer layer to a receiving material 16 as a transfer unit to receiving material 17.

Now, a step of subjecting the receiving material having the transfer layer and toner image thereon (printing plate precursor) with a chemical reaction treatment to remove the transfer layer thereby providing a printing plate will be described below. In order to remove the transfer layer, an appropriate means can be selected in consideration of a chemical reaction treatment by which a resin used in the transfer layer is removed. For instance, treatment with a processing solution, treatment with irradiation of actinic ray or a combination thereof can be employed for removal of the transfer layer.

In order to effect the removal by a chemical reaction with a processing solution, an aqueous solution which is adjusted to the prescribed pH is used. Known pH control agents can be employed to adjust the pH of solution. While the pH of the processing solution used may be any of acidic, neutral and alkaline region, the processing solution is preferably employed in an alkaline region having a pH of 8 or higher taking account of an anticorrosive property and a property of dissolving the transfer layer. The alkaline processing solution can be prepared by using any of conventionally known organic or inorganic compounds, such as carbonates, sodium hydroxide, potassium hydroxide, potassium silicate, sodium silicate, and organic amine compounds, either individually or in combination thereof.

The processing solution may contain a hydrophilic compound which contains a substituent having a Pearson's nucleophilic constant n (refer to R. G. Pearson and H. Sobel, *J. Amer. Chem. Soc.*, Vol. 90, p. 319 (1968)) of not less than 5.5 and has a solubility of at least 1 part by weight per 100 parts by weight of distilled water, in order to accelerate the reaction for rendering hydrophilic.

Suitable examples of such hydrophilic compounds include hydrazines, hydroxylamines, sulfites (e.g., ammonium sulfite, sodium sulfite, potassium sulfite or zinc sulfite), thiosulfates, and mercapto compounds, hydrazide compounds, sulfinic acid compounds and primary or secondary amine compounds each containing at least one polar group selected from a hydroxyl group, a carboxyl group, a sulfo group, a phosphono group and an amino group in the molecule thereof.

Specific examples of the polar group-containing mercapto compounds include 2-mercaptoethanol, 2-mercaptoethylamine, N-methyl-2-mercaptoethylamine, N-(2-hydroxyethyl)-2-mercaptoethylamine, thioglycolic acid, thiomalic acid, thiosalicylic acid, mercaptobenzenecarboxylic acid, 2-mercaptotoluensulfonic acid, 2-mercaptoethylphosphonic acid, mercaptobenzenesulfonic acid, 2-mercaptopropionylaminoacetic acid, 2-mercapto-1-amino-acetic acid, 1-mercaptopropionylaminoacetic acid, 1,2-dimercaptopropionylaminoacetic acid, 2,3-dihydroxypropylmercaptan, and 2-methyl-2-mercapto-1-aminoacetic acid. Specific examples of the polar group-containing sulfinic acid compounds include 2-hydroxyethylsulfinic acid, 3-hydroxypropanesulfinic acid, 4-hydroxybutanesulfinic acid, carboxybenzenesulfinic acid, and dicarboxybenzenesulfinic acid. Specific examples of the polar group-containing hydrazide compounds include 2-hydrazinoethanolsulfonic acid, 4-hydrazinobutanesulfonic acid, hydrazinobenzenesulfonic acid, hydrazinobenzenesulfonic acid, hydrazinobenzoic acid, and hydrazinobenzenecarboxylic acid. Specific examples of the polar group-containing primary or secondary amine compounds include N-(2-hydrozyethyl)amine, N,N-di(2-hydroxyethyl)amine, N,N-di(2-hydroxyethyl) ethylenediamine, tri-(2-hydroxyethyl)ethylenediamine, N-(2,3-dihydroxypropyl)amine, N,N-di(2,3-dihydroxypropyl)amine, 2-aminopropionic acid, aminobenzoic acid, aminopyridine, aminobenzenedicarboxylic acid, 2-hydroxyethylmorpholine, 2-carboxyethylmorpholine, and 3-carboxypiperazine.

The amount of the nucleophilic compound present in the processing solution is preferably from 0.05 to 10 mol/l, and more preferably from 0.1 to 5 mol/l. The pH of the processing solution is preferably not less than 8.

The processing solution may contain other compounds in addition to the pH control agent and nucleophilic compound described above. For example, a water-soluble organic solvent may be used in a range of from about 1 to about 50 parts by weight per 100 parts by weight of water. Suitable examples of the water-soluble organic solvent include alcohols (e.g., methanol, ethanol, propanol, propargyl alcohol, benzyl alcohol, and phenethyl alcohol), ketones (e.g., acetone, methyl ethyl ketone, cyclohexanone and acetophenone), ethers (e.g., dioxane, trioxane, tetrahydrofuran, ethylene glycol dimethyl ether, propylene glycol diethyl ether, ethylene glycol monomethyl ether, propylene glycol monomethyl ether, and tetrahydropyran), amides (e.g., dimethylformamide, pyrrolidone, N-methylpyrrolidone, and dimethylacetamide), esters (e.g., methyl acetate, ethyl acetate, and ethyl formate), sulforan and tetramethylurea. These organic solvents may be used either individually or in combination of two or more thereof.

The processing solution may contain a surface active agent in an amount ranging from about 0.1 to about 20 parts by weight per 100 parts by weight of the processing solution. Suitable examples of the surface active agent include conventionally known anionic, cationic or nonionic surface active agents, such as the compounds as described, for example, in Hiroshi Horiguchi, *Shin Kaimen Kasseizai*, Sankyo Shuppan (1975) and Ryohei Oda and Kazuhiro Teramura, *Kaimen Kasseizai no Gosei to Sono Oyo*, Maki Shoten (1980). Moreover, conventionally known antiseptic compounds and antimoldy compounds are employed in appropriate amounts in order to improve the antiseptic property and antimoldy property of the processing solution during preservation.

With respect to the conditions of the treatment, a temperature of from about 15° to about 60° C., and an immersion time of from about 10 seconds to about 5 minutes are preferred.

The treatment with the processing solution may be combined with a physical operation, for example, application of ultrasonic wave or mechanical movement (such as rubbing with a brush).

Actinic ray which can be used for decomposition to render the transfer layer hydrophilic upon the irradiation treatment includes any of visible light, ultraviolet light, far ultraviolet light, electron beam, X-ray, γ-ray, and α-ray, with ultraviolet light being preferred. More preferably rays having a wavelength range of from 310 to 500 nm are used. As a light source, a high-pressure or ultrahigh-pressure mercury lamp is ordinarily utilized. Usually, the irradiation treatment can be sufficiently carried out from a distance of from 5 cm to 50 cm for a period of from 10 seconds to 10 minutes. The thus irradiated transfer layer is then soaked in an aqueous solution as described above whereby the transfer layer is easily removed.

In accordance with the method of the present invention, transferability of transfer layer at the heat transfer is excellent. Particularly, a toner image is completely transferred together with a transfer layer onto a receiving material even when a thickness of the transfer layer is reduced and the transfer is conducted under a decreased temperature, a decreased pressure or an increased speed, whereby a duplicated image having good qualities can be obtained and no residual transfer layer or toner image is found after the transfer.

Also, the excellent transferability is maintained irrespective of the kind of toner used even when an original of a high image area ratio is employed since adhesion of the toner image to the receiving material is very strong.

The present invention is illustrated in greater detail with reference to the following examples, but the present invention is not to be construed as being limited thereto.

Synthesis Examples of Resin Grain (AR):

SYNTHESIS EXAMPLE 1 OF RESIN GRAIN (AR): (AR-1)

A mixed solution of 16 g of Dispersion Stabilizing Resin (Q-1) having the structure shown below and 550 g of Isopar H was heated to a temperature of 50° C. under nitrogen gas stream while stirring.

Dispersion Stabilizing Resin (Q-1)

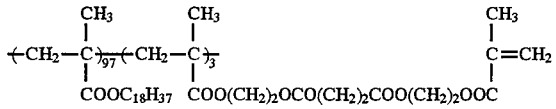

Mw $4\times10^4$

To the solution was dropwise added a mixed solution of 48 g of benzyl methacrylate, 40 g of 2-butoxyethyl methacrylate, 12 g of acrylic acid, 2.6 g of methyl 3-mercaptopropionate and 1.2 g of 2,2'-azobis(2-cyclopropylpropionitrile) (abbreviated as ACPP) over a period of one hour, followed by stirring for one hour. To the reaction mixture was added 0.8 g of ACPP, followed by reacting for 2 hours. Further, 0.5 g of 2,2'-azobis-(isobutyronitrile) (abbreviated as AIBN) was added thereto, the reaction temperature was adjusted to 80° C., and the reaction was continued for 3 hours. After cooling, the reaction mixture was passed through a nylon cloth of 200 mesh to obtain a white dispersion which was a latex of good monodispersity with a polymerization rate of 97% and an average grain diameter of 0.19 μm. The grain diameter was measured by CAPA-500 manufactured by Horiba Ltd. (hereinafter the same).

A part of the white dispersion was centrifuged at a rotation of $1\times10^4$ r.p.m. for one hour and the resin grains precipitated were collected and dried. A weight average molecular weight (Mw) of the resin grain measured by a GPC method and calculated in terms of polystyrene (hereinafter the same) was $8\times10^3$. A glass transition point (Tg) thereof was 34° C.

SYNTHESIS EXAMPLE 2 OF RESIN GRAIN (AR): (AR-2)

A mixed solution of 14 g of Dispersion Stabilizing Resin (Q-2) having the structure shown below, 10 g of Macromonomer (M-1) having the structure shown below, and 553 g of isopar H was heated to a temperature of 55° C. under nitrogen gas stream while stirring.

Dispersion Stabilizing Resin (Q-2)

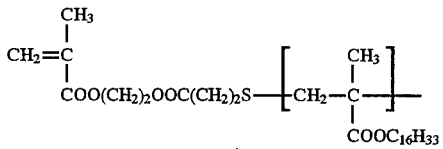

Mw $2\times10^4$

-continued

Macromonomer (M-1)

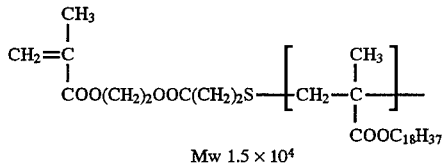

Mw $1.5\times10^4$

To the solution was added dropwise a mixed solution of 52 g of phenethyl methacrylate, 35 g of 3-butoxypropyl methacrylate, 13 g of acrylic acid, 1.8 g of methyl 3-mercaptopropionate and 1.2 g of ACPP over a period of one hour, followed by reacting for one hour. Then, 0.8 g of 2,2'-azobis(isovaleronitrile) (abbreviated as AIVN) was added thereto and the temperature was immediately adjusted to 75° C., and the reaction was continued for 2 hours. To the reaction mixture was further added 0.5 g of AIVN, followed by reacting for 2 hours. After cooling, the reaction mixture was passed through a nylon cloth of 200 mesh to obtain a white dispersion which was a latex of good monodispersity with a polymerization rate of 98% and an average grain diameter of 0.22 μm. An Mw of the resin grain was $1.5\times10^4$ and a Tg thereof was 33° C.

SYNTHESIS EXAMPLES 3 TO 8 OF RESIN GRAIN (AR): (AR-3) TO (AR-8)

A mixed solution of 20 g of Dispersion Stabilizing Resin (Q-3) having the structure shown below and 480 g of Isopar G was heated to a temperature of 50° C. under nitrogen gas stream while stirring.

Dispersion Stabilizing Resin (Q-3)

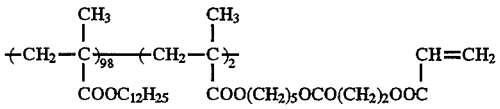

Mw $5\times10^4$

To the solution was added dropwise a mixed solution of each of the monomers shown in Table A below, 2.6 g of methyl 3-mercaptopropionate, 1.5 g of AIVN and 60 g of tetrahydrofuran over a period of one hour, followed by reacting for one hour. Then, 1.0 g of AIVN was added thereto and the temperature was adjusted to 70° C., and the reaction was continued for 2 hours. To the reaction mixture was further added 0.8 g of AIVN, followed by reacting for 3 hours. To the reaction mixture was added 60 g of isopar H, the tetrahydrofuran was distilled off under a reduced pressure of an aspirator at a temperature of 50° C. After cooling, the reaction mixture was passed through a nylon cloth of 200 mesh to obtain a white dispersion which was a latex of good monodispersity. An average grain diameter of each of the resin grains was in a range of from 0.15 to 0.30 μm. An Mw thereof was in a range of from $8\times10^3$ to $1.5\times10^4$ and a Tg thereof was in a range of from 30° C. to 50° C.

TABLE A

| Synthesis Example of Resin Grain (AR) | Resin Grain (AR) | Monomer Corresponding to Polymer Component (a) | | Monomer Corresponding Polymer Component (b) | | Other Monomer | |
|---|---|---|---|---|---|---|---|
| 3 | AR-3 | 2-Carboxyethyl acrylate | 18 g | — | | Methyl methacrylate<br>2,3-Diethoxypropyl methacrylate | 47 g<br>35 g |
| 4 | AR-4 | Acrylic acid | 5 g | 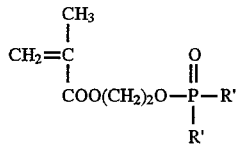 <br>R': $-O(CH_2)_2COC_4H_9$<br>(b-1) | 25 g | Phenethyl methacrylate | 70 g |
| 5 | AR-5 | — | | 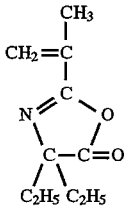 <br>(b-2) | 40 g | Benzyl methacrylate<br>2-(2-Butoxyethoxy)-ethyl methacrylate | 20 g<br>40 g |
| 6 | AR-6 | — | | 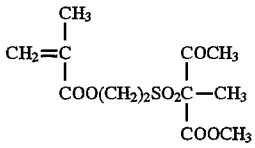 <br>(b-3) | 60 g | Ethyl methacrylate | 40 g |
| 7 | AR-7 | 4-Vinylbenzene-sulfonic acid | 5 g | 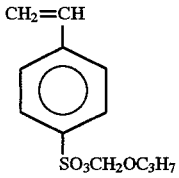 <br>(b-4) | 40 g | Styrene<br>Vinyltoluene | 23 g<br>32 g |
| 8 | AR-8 | Itaconic anhydride | 5 g | 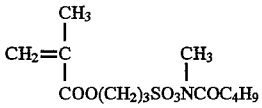 <br>(b-5) | 25 g | o-Methylbenzyl methacrylate<br>1-Ethoxymethyl-2-ethoxy ethyl methacrylate | 30 g<br>40 g |

SYNTHESIS EXAMPLES 9 TO 13 OF RESIN GRAIN (AR): (AR-9) TO (AR-13)

Each of the resin grains was synthesized in the same manner as in Synthesis Example 2 of Resin Grain (AR) except for using 10 g of each of the macromonomers (Mw thereof being in a range of from $8\times10^3$ to $1\times10^4$) shown in Table B below in place of 10 g of Macromonomer (M-1). A polymerization rate of each of the resin grains was in a range of from 98 to 99% and an average grain diameter thereof was in a range of from 0.15 to 0.25 μm with good monodispersity. An Mw of each of the resin grains was in a range of from $9\times10^3$ to $2\times10^4$ and a Tg thereof was in a range of from 40° C. to 70° C.

TABLE B

| Synthesis Example of Resin Grain (AR) | Resin Grain (AR) | Macromonomer |
|---|---|---|
| 9 | AR-9 | (M-2) $CH_2{=}C(CH_3)COO(CH_2)_2OCOCH_2S{+}CH_2{-}C(CH_3)(COOCH_2CF_2CF_2H){+}$ |
| 10 | AR-10 | (M-3) $CH_2{=}CH\,COO(CH_2)_2OCO(CH_2)_2S{+}CH_2{-}C(CH_3)(COO(CH_2)_3Si(OSi(CH_3)_3)_2{-}CH_3){+}$ |
| 11 | AR-11 | (M-4) $CH_2{=}C(CH_3)COO(CH_2)_2S{+}CH_2{-}C(CH_3)(COO(CH_2)_2C_8F_{17}){+}$ |
| 12 | AR-12 | (M-5) $CH_2{=}C(CH_3)COO(CH_2)_2NHCOO(CH_2)_2S{+}CH_2{-}C(CH_3)(COO(CH_2)_3Si(CH_3)_2{-}CH_2C_2F_5){+}$ |
| 13 | AR-13 | (M-6) $CH_2{=}C(CH_3)COO(CH_2)_2NH{+}CH_2CH_2N(CO{-}C_7F_{15}){+}CH_3$ |

SYNTHESIS EXAMPLE 14 OF RESIN GRAIN (AR): (AR-14)

A mixed solution of 15 g of Dispersion Stabilizing Resin (Q-4) having the structure shown below, 62 g of vinyl acetate, 30 g of vinyl valerate, 8 g of crotonic acid and 275 g of Isopar H was heated to a temperature of 80° C. under nitrogen gas stream with stirring.

Dispersion Stabilizing Resin (Q-4)

$$\left(CH_2{-}C(CH_3)(COOC_{13}H_{27})\right)_{97}\left(CH_2{-}CH(COO(CH_2)_2OCO(CH_2)_2COO{-}CH{=}CH_2)\right)_3$$

Mw $3\times10^4$

To the solution was added 1.6 g of AIVN, followed by reacting for 1.5 hours, 0.8 g of AIVN was added thereto, followed by reacting for 2 hours, and 0.5 g of AIBN was further added thereto, followed by reacting for 4 hours. Then, the temperature of the reaction mixture was raised to 100° C. and stirred for 2 hours to distil off the unreacted monomers. After cooling, the reaction mixture was passed through a nylon cloth of 200 mesh to obtain a white dispersion which was a monodispersed latex with a polymerization rate of 93% and an average grain diameter of 0.25 μm. An Mw of the resin grain was $8\times10^4$ and a Tg thereof was 26° C.

SYNTHESIS EXAMPLE 15 OF RESIN GRAIN (AR): (AR-15)

A mixed solution of 18 g of Dispersion Stabilizing Resin (Q-5) having the structure shown below and 500 g of Isopar H was heated to a temperature of 50° C. under nitrogen gas stream with stirring.

Dispersion Stabilizing Resin (Q-5)

$$\left(CH{-}CH_2\right)_{96}\left(CH_2{-}C(CH_3)(CONH(CH_2)_{10}COO(CH_2)_2OOC{-}C(CH_3){=}CH_2)\right)_4$$

Mw $3.5\times10^4$

To the solution was added dropwise a mixed solution of 35 g of benzyl methacrylate, 40 g of 2-(2-hexyloxyethyloxy) ethyl methacrylate, 25 g of 2-sulfoethyl methacrylate, 5.2 g of methyl 3-mercaptopropionate, 1.5 g of AIVN and 120 g of tetrahydrofuran over a period of one hour, followed by further reacting for one hour. Then 1.0 g of AIVN was added to the reaction mixture, the temperature thereof was adjusted to 70° C., and the reaction was conducted for 2 hours. Further, 1.0 g of AIVN was added thereto, followed by reacting for 3 hours. To the reaction mixture was added 120 g of isopar H, the tetrahydrofuran was distilled off under a reduced pressure of an aspirator at a temperature of 50° C.

After cooling, the reaction mixture was passed through a nylon cloth of 200 mesh to obtain a white dispersion which was a latex of good monodispersity having a polymerization rate of 98% and an average grain diameter of 0.18 μm. An Mw of the resin grain was $6\times10^3$ and a Tg thereof was 23° C.

SYNTHESIS EXAMPLES 16 TO 21 OF RESIN GRAIN (AR): (AR-16) TO (AR-21)

A mixed solution of 25 g of Dispersion Stabilizing Resin (Q-6) having the structure shown below and 392 g of Isopar H was heated to a temperature of 50° C. under nitrogen gas stream while stirring.

Dispersion Stabilizing Resin (Q-6)

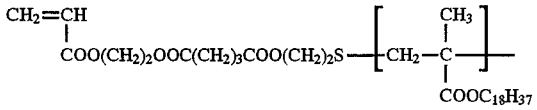

Mw $2.5\times10^4$

To the solution was dropwise added a mixed solution of each of the monomers shown in Table C below, 3.1 g of methyl 3-mercaptopropionate, 3 g of ACPP and 50 g of methyl ethyl ketone over a period of one hour, followed by reacting for one hour. To the reaction mixture was further added 1.0 g of ACPP, followed by reacting for 2 hours. Then, 1.0 g of AIVN was added thereto and the temperature was immediately adjusted to 75° C., and the reaction was continued for 2 hours. To the reaction mixture was further added 0.8 g of AIVN, followed by reacting for 2 hours. After cooling, the reaction mixture was passed through a nylon cloth of 200 mesh to obtain a white dispersion. A polymerization rate of each of the white dispersions obtained was in a range of from 93 to 99% and an average grain diameter thereof was in a range of from 0.15 to 0.25 μm with narrow size distribution. An Mw of each of the resin grains was in a range of from $8\times10^3$ to $1\times10^4$ and a Tg thereof was in a range of from 10° C. to 35° C.

TABLE C

| Synthesis Example of Resin Grain (AR) | Resin Grain (AR) | Monomer Corresponding to Polymer Component (a) | | Monomer Corresponding to Polymer Component (b) | | Other Monomer | |
|---|---|---|---|---|---|---|---|
| 16 | AR-16 | Acrylic acid | 12.5 g | — | | Benzyl methacrylate<br>2-Propoxyethyl methacrylate | 47.5 g<br>40 g |
| 17 | AR-17 | 2-Phosphono-ethyl methacrylate | 8 g | 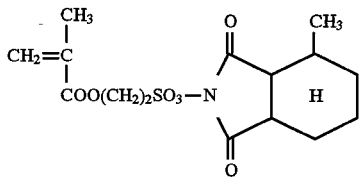 <br>(b-6) | | Methyl methacrylate<br>2-(2-Hexyloxy-ethyloxy)ethyl methacrylate | 29 g<br>50 g |
| 18 | AR-18 | Acrylic acid | 12.5 g | — | | Benzyl methacrylate<br> 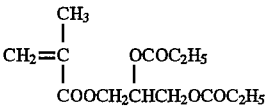 | 55 g<br>32.5 g |
| 19 | AR-19 | Acrylic acid | 8 g | — | | Phenethyl methacrylate<br>2,3-Dibutoxypropyl methacrylate | 44 g<br>40 g |
| 20 | AR-20 | Acrolein | 10 g | 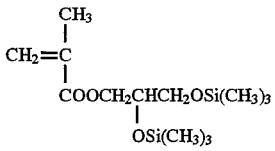 <br>(b-7) | 15 g | 2-Methylphenyl methacrylate<br>2-Ethoxyethyl acrylate | 45 g<br>30 g |

TABLE C-continued

| Synthesis Example of Resin Grain (AR) | Resin Grain (AR) | Monomer Corresponding to Polymer Component (a) | Monomer Corresponding to Polymer Component (b) | | Other Monomer | |
|---|---|---|---|---|---|---|
| 21 | AR-21 | — | $CH_2=C(CH_3)COO(CH_2)_2COC_4H_9$ (b-8) | 30 g | 2,6-Dichlorophenyl methacrylate<br>Ethyl acrylate | 40 g<br>30 g |

SYNTHESIS EXAMPLE 1 OF RESIN GRAIN (ARW): (ARW-1)

A mixed solution of the whole amount of dispersion of Resin Grain (AR-14) obtained by Synthesis Example 14 of Resin Grain (AR) (as seed) and 10 g of Dispersion Stabilizing Resin (Q-1) described above was heated to a temperature of 60° C. under nitrogen gas stream with stirring. To the mixture was added dropwise a mixture of 48 g of benzyl methacrylate, 40 g of 2-butoxylethyl methacrylate, 12 g of acrylic acid, 3.8 g of methyl 3-mercaptopropionate, 0.8 g of AIVN and 200 g of Isopar H over a period of 2 hours, followed by further reacting for 2 hours. Then 0.8 g of AIVN was added to the reaction mixture, the temperature thereof was raised to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization rate of 98% and an average grain diameter of 0.24 μm.

In order to investigate that the resin grain thus-obtained was composed of the two kinds of resins, the state of resin grain was observed using a scanning electron microscope.

Specifically, the dispersion of Resin Grain (ARW-1) was applied to a polyethylene terephthalate film so that the resin grains were present in a dispersive state on the film, followed by heating at a temperature of 30° C. or 50° C. for 5 minutes to prepare a sample. Each sample was observed using a scanning electron microscope (JSL-T330 Type manufactured by JEOL Co., Ltd.) of 20,000 magnifications. As a result, the resin grains were observed with the sample heated at 30° C. On the contrary, with the sample heated at 50° C. the resin grains had been melted by heating and were not observed.

The state of resin grain was observed in the same manner as described above with respect to resin grains formed from respective two kinds of resins (copolymers) constituting Resin Grain (ARW-1), i.e., Resin Grain (AR-14) and Resin Grain (AR-1) described above and a mixture of Resin Grains (AR-14) and (AR-1) in a weight ratio of 1:1. As a result, it was found that with Resin Grain (AR-14), the resin grains were not observed in the sample heated at 30° C., although the resin grains were observed in the sample before heating. On the other hand, with Resin Grain (AR-1), the resin grains were not observed in the sample heated at 50° C. Further, with the mixture of two kind of resin grains, disappearance of the resin grains was observed in the sample heated at 30° C. in comparison with the sample before heating.

From these results it was confirmed that Resin Grain (ARW-1) described above was not a mixture of two kinds of resin grains but contained two kinds of resins therein, and had a core/shell structure wherein the resin having a relatively high Tg formed shell portion and the resin having a relatively low Tg formed core portion.

SYNTHESIS EXAMPLES 2 TO 6 OF RESIN GRAIN (ARW): (ARW-2) TO ( ARW-6)

Each of the resin grains (ARW-2) to (ARW-6) was synthesized in the same manner as in Synthesis Examples 1 of Resin Grain (ARW) except for using each of the monomers shown in Table D below in place of the monomers employed in Synthesis Example 1 of Resin Grain (ARW). A polymerization rate of each of the resin grains was in a range of from 95 to 99% and an average grain diameter thereof was in a range of from 0.20 to 0.30 μm with good monodispersity.

TABLE D

| Synthesis Example of Resin Grain (ARW) | Resin Grain (ARW) | Monomers for Seed Grain | Weight Ratio | Monomers for Shell Portion | Weight Ratio |
|---|---|---|---|---|---|
| 2 | ARW-2 | Methyl methacrylate | 42 | Benzyl methacrylate | 47 |
| | | Ethyl acrylate | 35 | 2-Pentyloxyethyl methacrylate | 40 |
| | | Monomer (b-3) | 23 | Acrylic acid | 13 |
| 3 | ARW-3 | Benzyl methacrylate | 86 | Methyl methacrylate | 52 |
| | | Acrylic acid | 14 | 2-(2-Butoxyethoxy)ethyl methacrylate | 30 |
| | | | | 3-Sulfopropyl acrylate | 18 |
| 4 | ARW-4 | Vinyl acetate | 65 | Methyl methacrylate | 40 |
| | | Vinyl butyrate | 25 | Methyl acrylate | 30 |
| | | 2-Vinyl acetic acid | 10 | Monomer (b-1) | 30 |

TABLE D-continued

| Synthesis Example of Resin Grain (ARW) | Resin Grain (ARW) | Monomers for Seed Grain | Weight Ratio | Monomers for Shell Portion | Weight Ratio |
|---|---|---|---|---|---|
| 5 | ARW-5 | Vinyl acetate | 90 | Benzyl methacrylate | 70 |
| | | Itaconic anhydride | 10 | Monomer (b-5) | 25 |
| | | | | Acrylic acid | 5 |
| 6 | ARW-6 | Benzyl methacrylate | 52 | 3-Phenylpropyl methacrylate | 49 |
| | | 2,3-Diacetyloxypropyl methacrylate | 35 | Acrylic acid | 16 |
| | | Acrylic acid | 13 | 2-Ethoxy-1-ethoxymethyl-ethyl methacrylate | 35 |

Synthesis Examples of Resin Grain (BR):

SYNTHESIS EXAMPLE 1 OF RESIN GRAIN (BR): (BR-1)

A mixed solution of 12 g of Dispersion Stabilizing Resin (Q-7) having the structure shown below, 60 g of vinyl acetate 40 g of vinyl propionate, and 384 g of Isopar H was heated to a temperature of 70° C. under nitrogen gas stream while stirring.

Dispersion Stabilizing Resin (Q-7)

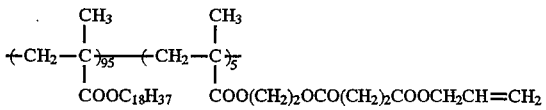

Mw $4\times10^4$

To the solution was added 0.8 g of AIVN as a polymerization initiator, followed by reacting for 3 hours. Twenty minutes after the addition of the polymerization initiator, the reaction mixture became white turbid, and the reaction temperature rose to 88° C. Then, 0.5 g of the above-described initiator was added to the reaction mixture, the reaction were carried out for 2 hours. The temperature of reaction mixture was raised to 100° C. and stirred for 2 hours to remove the unreacted monomer by distillation. After cooling, the reaction mixture was passed through a nylon cloth of 200 mesh to obtain a white dispersion which was a latex of good monodispersity with a polymerization rate of 90% and an average grain diameter of 0.18 μm. An Mw of the resin grain was $8\times10^4$ and a Tg thereof was 23° C.

SYNTHESIS EXAMPLE 2 OF RESIN GRAIN (BR): (BR-2)

A mixed solution of 20 g of Dispersion Stabilizing Resin (Q-8) having the structure shown below and 382 g of isopar G was heated to a temperature of 60° C. under nitrogen gas stream while stirring.

Dispersion Stabilizing Resin (Q-8)

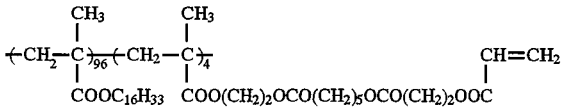

Mw $4\times10^4$

To the solution was added dropwise a mixture of 20 g of methyl methacrylate, 80 g of ethyl acrylate, 0.6 g of methyl 3-mercaptopropionate and 1.0 g of AIVN over a period of one hour, followed by reacting for one hour. To the reaction mixture was further added 0.8 g of AIVN, followed by reacting for 2 hours. Thus, 0.8 g of AIBN was added thereto and the temperature was adjusted to 80° C., and the reaction was continued for 2 hours. To the reaction mixture was further added 0.5 g of AIBN, followed by reacting for 2 hours. The temperature of reaction mixture was raised to 100° C. and the unreacted monomer was distilled off under a reduced pressure of 10 to 20 mmHg.

After cooling, the reaction mixture was passed through a nylon cloth of 200 mesh to obtain a white dispersion which was a latex of good monodispersity with a polymerization rate of 98% and an average grain diameter of 0.17 μm. An Mw of the resin grain was $8\times10^4$ and a Tg thereof was 12° C.

SYNTHESIS EXAMPLES 3 TO 12 OF RESIN GRAIN (BR-3) TO (BR-12)

Each of the resin grains (BR) was synthesized in the same manner as in Synthesis Example 2 of Resin Grain (BR) except for using each of the monomers shown in Table E below in place of 20 g of methyl methacrylate and 80 g of ethyl acrylate employed in Synthesis Example 2 of Resin Grain (BR).

A polymerization rate of each of the resin grains was in a range of from 90% to 99% and an average grain diameter thereof was in a range of from 0.13 μm to 0.20 μm with good monodispersity. A Tg of each of the resin grains was in a range of from −20° C. to 15° C.

TABLE E

| Synthesis Example of Resin Grain (BR) | Resin Grain (BR) | Monomer | Amount (g) |
|---|---|---|---|
| 3 | BR-3 | Methyl methacrylate | 30 |
| | | Ethyl acrylate | 70 |
| 4 | BR-4 | Methyl methacrylate | 10 |
| | | Methyl acrylate | 90 |
| 5 | BR-5 | Styrene | 20 |
| | | Vinyl toluene | 80 |
| 6 | BR-6 | Vinyl acetate | 60 |
| | | Vinyl valerate | 40 |
| 7 | BR-7 | Methyl methacylate | 50 |
| | | 2-Ethylhexyl acylate | 50 |
| 8 | BR-8 | Methyl methacrylate | 75 |
| | | Dodecyl methacrylate | 20 |
| | | Acrylic acid | 5 |
| 9 | BR-9 | Methyl methacrylate | 20 |
| | | Ethyl acrylate | 60 |
| | | 2-Butoxyethyl methacrylate | 20 |
| 10 | BR-10 | Benzyl methacrylate | 40 |
| | | Butyl acrylate | 60 |
| 11 | BR-11 | Methyl acrylate | 100 |
| 12 | BR-12 | Vinyl acetate | 59 |
| | | vinyl butyrate | 40 |
| | | Crotonic acid | 1 |

SYNTHESIS EXAMPLE 13 OF RESIN GRAIN (BR): (BR-13)

A mixture of resins (B) comprising a vinyl acetate/ethylene (46/54 by weight ratio) copolymer (Evaflex 45X manufactured by Du Pont-Mitsui Polychemicals Co., Ltd.) having a Tg of −25° C. and polyvinyl acetate having a Tg of 38° C. in a weight ratio of 1:1 was melted and kneaded by a three-roll mill at a temperature of 120° C. and then pulverized by a trio-blender. A mixture of 5 g of the resulting coarse powder, 4 g of a dispersion stabilizing resin (Sorprene 1205 manufactured by Asahi Kasei Kogyo Kabushiki Kaisha) and 51 g of isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dyno-mill KDL (manufactured by Sinmaru Enterprises Co., Ltd.) with glass beads having a diameter of from 0.75 to 1 mm at a rotation of 4500 r.p.m. for 6 hours, and then passed through a nylon cloth of 200 mesh to obtain a white dispersion which was a latex having an average grain diameter of 0.4 μm.

SYNTHESIS EXAMPLES 14 TO 18 OF RESIN GRAIN (BR): (BR-14) TO (BR-18)

Each dispersion was prepared according to a wet type dispersion process in the same manner as in Synthesis Example 13 of Resin Grain (BR) except for using each of the compounds shown in Table F below in place of two kinds of the resins (B) employed in Synthesis Example 13 of Resin Grain (BR). An average grain diameter of each of the white dispersion obtained was in a range of from 0.3 μm to 0.6 μm.

TABLE F

| Synthesis Example of Resin Grain (BR) | Resin Grain (BR) | Resin (B) |
|---|---|---|
| 14 | BR-14 | Mixture of cellulose acetate butyrate (Cellidor Bsp manufactured by Bayer AG) and vinyl acetate/vinyl butyrate (70/30 by weight ratio) copolymer in a weight ratio of 60:40 |
| 15 | BR-15 | Mixture of styrene/butadiene copolymer (Sorprene 1204 manufactured by Asahi Kasei Kogyo Kabushiki Kaisha) and styrene/vinyl acetate (20/80 by weight ratio) copolymer in a weight ratio of 50:50 |
| 16 | BR-16 | Mixture of polyvinyl butyral resin (S-Lec manufactured by Sekisui Chemical Co., Ltd.) and cellulose propionate (Cellidoria manufactured by Daicel Co., Ltd.) in a weight ratio of 70:30 |
| 17 | BR-17 | Mixture of polyester resin (Chemit R-185 manufactured by Toray Co., Ltd.) and methyl methacrylate/butyl acrylate (60/40 by weight ratio) AB block copolymer in a weight ratio of 50:50 |
| 18 | BR-18 | Mixture of polydecamethylene terephthalate and polypentamethylene carbonate in a weight ratio of 30:70 |

SYNTHESIS EXAMPLE 19 OF RESIN GRAIN/ BR): (BR-19)

A mixture of 12 g of Dispersion Stabilizing Resin (Q-4) described above, 80 g of vinyl acetate, 20 g of vinyl propionate and 388 g of Isopar H was heated to a temperature of 80° C. under nitrogen gas stream while stirring. To the solution was added 1.5 g of AIBN as a polymerization initiator, followed by reacting for 2 hours. To the reaction mixture was added 0.8 g of AIBN, followed by reacting for 2 hours. Further, 0.8 g of AIBN, followed by reacting for 2 hours. After cooling the reaction mixture was passed through a nylon cloth of 200 mesh to obtain a white dispersion which was a latex of good monodispersity with a polymerization rate of 93% and an average grain diameter of 0.14 μm. An Mw of the resin grain was $8\times10^4$ and a Tg thereof was 23° C.

A mixed solution of the whole amount of the above-described resin grain dispersion (as seed) and 10 g of Dispersion Stabilizing Resin (Q-1) described above was heated to a temperature of 60° C. under nitrogen gas stream with stirring. To the mixture was added dropwise a mixture of 35 g of methyl methacrylate, 65 g of methyl acrylate, 0.6 g of methyl 3-mercaptopropionate, 0.8 g of AIVN and 400 g of isopar G over a period of 2 hours, followed by further reacting for 2 hours. Then 0.8 g of AIVN was added to the reaction mixture, the temperature thereof was raised to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization rate of 98% and an average grain diameter of 0.25 μm.

EXAMPLE 1

A mixture of 2 g of X-form metal-free phthalocyanine (manufactured by Dainippon Ink and Chemicals, Inc.), 14.4 g of Binder Resin (P-1) having the structure shown below, 3.6 g of Binder Resin (P-2) having the structure shown below, 0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (P-1)

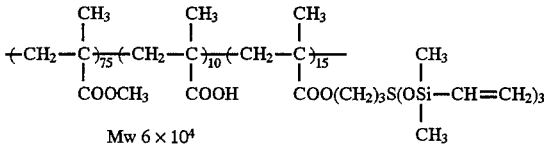

-continued

Binder Resin (P-2)

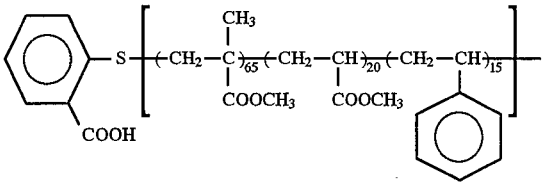

Mw $6\times10^3$

Compound (A)

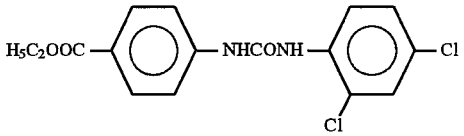

The resulting dispersion was coated on an aluminium plate having a thickness of 0.2 mm, which had been subjected to degrease treatment, by a wire bar, set to touch, and heated in a circulating oven at 110° C. for 20 seconds to form a light-sensitive layer having a thickness of 8 μm.

Then, a surface layer for imparting releasability was provided on the light-sensitive layer.

Formation of Surface Layer for Imparting Releasability

A coating composition comprising 10 g of silicone resin having the structure shown below, 1 g of crosslinking agent having the structure shown below, 0.2 g of crosslinking controller having the structure shown below, 0.1 g of platinum as a catalyst for crosslinking and 100 g of n-hexane was coated by a wire round rod, set to touch, and heated at 120° C. for 10 minutes to form the surface layer having a thickness of 1.5 μm. The adhesion of the surface of the resulting electrophotographic light-sensitive element was not more than 1 g·f.

Silicone Resin

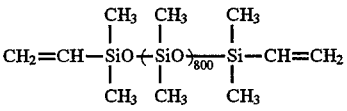

(presumptive structure)

Crosslinking Agent

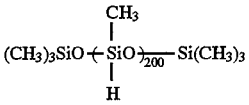

(presumptive structure)

Crosslinking Controller $CH\equiv C-Si(OCH_3)_3$

The electrophotographic light-sensitive element having the surface of releasability was installed in an apparatus as shown in FIG. 2 as a light-sensitive element 11.

On the electrophotographic light-sensitive element was provided a transfer layer (T) 12 by the electrodeposition coating method using an electrodeposition unit for forming transfer layer (T) 12D.

Specifically, on the surface of electrophotographic light-sensitive element whose surface temperature was adjusted to 60° C. and which was rotated at a circumferential speed of 100 mm/sec, Dispersion of Resin (A) (TL-1) containing positively charged resin grains shown below was supplied using a slit electrodeposition device, as the electodeposition unit for forming transfer layer (T) 12D, while putting the electrophotographic light-sensitive element to earth and applying an electric voltage of +100 V to an electrode of the slit electrodeposition device to cause the resin grains to electrodeposit and fix. Thus, the transfer layer (T) composed of the resin (A) was prepared on the electrophotographic light-sensitive element. A thickness of the transfer layer (T) was 1.0 μm.

| Dispersion of Resin (A) (TL-1) | |
|---|---|
| Resin Grain (AR-1) | 20 g (solid basis) |
| Charge Control Agent (CD-1) (octadecyl vinyl ether/N-hexadecyl maleic monoamide (1/1 by molar ratio) copolymer) | 0.08 g |
| Charge Adjuvant (AD-1) (dodecyl metharylate/methacrylic acid (94/6 by weight ratio) copolymer) | 0.1 g |
| Isopar G | up to make 1 liter |

A toner image was then formed on the transfer layer provided on the electrophotographic light-sensitive element by an electrophotographic process. Specifically, the electrophotographic light-sensitive element 11 was charged to +450 V with a corona charger 18 in dark and image-exposed to light using a semiconductor laser having an oscillation wavelength of 788 nm as an exposure device 19 at an irradiation dose on the electrophotographic light-sensitive element of 25 erg/cm$^2$ based on digital image data of an information which had been obtained by reading an original by a color scanner, conducting several corrections relating to color reproduction specific for color separation system and stored in a hard disc.

Thereafter, the exposed electrophotographic light-sensitive element was subjected to reversal development using a liquid developer for electrophotographic printing plate precursor (ELP-TX manufactured by Fuji Photo Film Co., Ltd.) by a liquid developing unit 14L while applying a bias voltage of +350 V to a development electrode to thereby electrodeposit toner particles on the exposed areas. The electrophotographic light-sensitive element was then rinsed in a bath of isopar H alone to remove stain on the non-image portion.

Surface electric potentials of the image portion and non-image portion were +250 V and +400 V, respectively, just after the development because the development had not been conducted up to the saturation. Successively, on the surface of electrophotographic light-sensitive element whose surface temperature was maintained at 60° C. and which was rotated at a circumferential speed of 100 mm/sec, Dispersion of Resin (B) (ML-1) containing positively charged resin grains shown below was supplied using a slit electrodeposition device, as an electrodeposition unit for forming adhesive layer (M) 13M, while applying an electric voltage of +350 V to a development electrode of the slit electrodeposition device, whereby the resin grains were selectively electrodeposited on the toner image, followed by passing under a suction/exhaust unit 15 and a heating means **17*a*** to dry. Thus, an adhesive layer (M) composed of the resin (B) having a thickness of 1 μm was formed only on the toner image.

| Dispersion of Resin (B) (ML-1) | |
|---|---|
| Resin Grain (BR-1) | 20 g (solid basis) |
| Charge Control Agent (CD-1) | 0.09 g |
| Charge Adjuvant (AD-1) | 0.1 g |
| Isopar G | up to make 1 liter |

Then, an aluminum substrate used for the production of Fuji PS-Plate FPD (manufacturing by Fuji Photo Film Co., Ltd.) as a receiving material 16 was passed between the drum of electrophotographic light-sensitive element whose surface temperature was maintained at 60° C. and a backup roller for transfer 17*b* adjusted at a surface temperature of 110° C. and a backup roller for release 17*c* whose temperature was not controlled under the condition of a nip pressure of 4 Kgf/cm$^2$ and a drum circumferential speed of 100 mm/sec, whereby the toner image was transferred together with the transfer layer and the adhesive layer from the electrophotographic light-sensitive element to the aluminum substrate.

The duplicated image thus-obtained on the aluminum substrate of FPD was visually observed using an optical microscope of 200 magnifications. None of background stain was observed in the non-image portion and the duplicated image was excellent even in high definition regions or highly accurate image portions in that cutting or distortion of fine lines such as lines of 10 μm in the width, fine letters such as 2.2 point size of Ming-zhao character and dots such as a range of from 2% to 98% in dots of 165 lines per inch were not found. The transfer layer, toner image and adhesive layer were wholly transferred to the aluminum substrate without remains.

The printing plate precursor thus-obtained was further heated using a device (RICOH FUSER Model 592 manufactured by Ricoh Co., Ltd.) to fix sufficiently the toner image portion. The printing plate precursor was observed visually using an optical microscope of 200 magnifications. None of change was recognized in the image as compared with that before the heat treatment.

Then, the printing plate precursor, was subjected to an oil-desensitizing treatment (i.e., removal of the transfer layer) to prepare a printing plate and its printing performance was evaluated. Specifically, the printing plate precursor was immersed in Oil-Desensitizing Solution (E-1) having the composition shown below at 35° C. for 20 seconds with mild rubbing of the surface of precursor with a fur brush to remove the transfer layer (T), thoroughly washed with water, and gummed to prepare an offset printing plate.

Oil-Desensitizing Solution (E-1)

A solution prepared by diluting PS plate processing solution (DP-4 manufactured by Fuji Photo Film Co., Ltd.) 50-fold with distilled water (pH: 12.5)

The printing plate thus obtained was observed visually using an optical microscope of 200 magnifications. It was found that the non-image portion had no residual transfer layer, and the image portion suffered no defects (i.e., cutting of fine lines, fine letters and dots) in high definition regions or highly accurate image portion.

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 50,000 prints with clear images free from background stains were obtained irrespective of the kind of color ink.

Moreover, when the printing plate according to the present invention was exchanged for an ordinary PS plate and printing was continued under ordinary conditions, no trouble arose. It was thus confirmed that the printing plate according to the present invention can share a printing machine with other offset printing plates such as PS plates.

As described above, the offset printing plate obtained according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

As described above, for the purpose of maintaining sufficient adhesion of toner image portion to the receiving material and increasing mechanical strength of toner image at the time of printing, a means for improving adhesion of toner image to the receiving material can be performed after the heat-transfer of toner image together with the transfer layer depending on the kind of liquid developer used for the formation of toner image or the condition of toner fixation.

Also, similar results to the above were obtained by a flash fixing method or a heat roll fixing method as the means for improving adhesion of toner image.

For comparison, the following procedures were conducted.

COMPARATIVE EXAMPLE 1

The same procedure as in Example 1 was performed except that the adhesive layer (M) was not provided on the toner image to form a toner image on an aluminum substrate of FPD. The transfer of the transfer layer (T) and toner image was not completely conducted and the residue of the transfer layer and toner image was observed on the electrophotographic light-sensitive element. Thus, cuttings of toner image were recognized in the duplicated image formed on the aluminum substrate. Then, a thickness of the transfer layer was changed to 4 μm and the transfer was conducted under different conditions of temperature of 120° C., a pressure of 5 kgf/cm$^2$ and a speed of 10 mm/sec. As a result, the toner image was completely transferred together with the transfer layer onto an aluminum substrate and the duplicated image thus-obtained had no cutting of image and was equivalent to that obtained in Example 1.

COMPARATIVE EXAMPLE 2

The same procedure as in Example 1 was performed except that the transfer layer (T) was not provided on the electrophotographic light-sensitive element to form a toner image on an aluminum substrate of FPD. The transfer of toner image was not completely conducted same as in Comparative Example 1. Then, a thickness of the transfer layer and conditions for transfer were variously changed to achieve the complete transfer. However, satisfactory results were not obtained.

It can be seen from these results that the method of the present invention makes possible the moderation of transfer condition, increase in transfer speed, and decrease in the total process time since the processing from the formation of transfer layer to the transfer step can be performed at the same temperature.

EXAMPLE 2

An amorphous silicon electrophotographic light-sensitive element (manufactured by KYOSERA Corp.) was installed in an apparatus as shown in FIG. 2 as a light-sensitive element. The adhesion of the surface of electrophotographic light-sensitive element was 230 g·f.

Impartation of releasability to the electrophotographic light-sensitive element was conducted by dipping the electrophotographic light-sensitive element in a solution of the compound (S) according to the present invention (dip method) in the apparatus. Specifically, the electrophotographic light-sensitive element rotated at a circumferential speed of 10 mm/sec was brought into contact with a bath containing a solution prepared by dissolving 1.0 g of Compound (S-1) shown below in one liter of Isopar G (manufactured by Esso Standard Oil Co.) for 7 seconds and dried using air-squeezing. The adhesion of the surface of electrophotographic light-sensitive element thus-treated was 3 g·f and the electrophotographic light-sensitive element exhibited good releasability.

Compound (S-1)

Silicone surface active agent (SILWet FZ-2171 manufactured by Nippon Unicar Co., Ltd.)

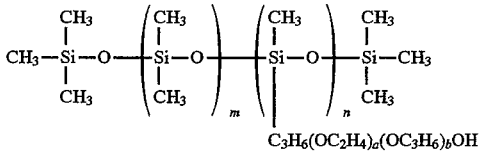

(presumptive structure)

On the surface of electrophotographic light-sensitive element whose surface temperature was adjusted at 50° C. by an infrared line heater and which was rotated at a circumferential speed of 100 mm/sec, Dispersion of Resin (A) (TL-2) containing positively charged resin grains shown below was supplied using a slit electrodeposition device, while putting the electrophotographic light-sensitive element to earth and applying an electric voltage of +150 V to an electrode of the slit electrodeposition device to cause the resin grains to electrodeposite. The dispersion medium was removed by air-squeezing using a suction/exhaust unit, and the resin grains were fused to form a film, whereby the transfer layer (T) 12 composed of the resin (A) was prepared on the electrophotographic light-sensitive element. A thickness of the transfer layer was 1.5 μm.

| Dispersion of Resin (A) (TL-2) | |
|---|---|
| Resin Grain (AR-2) | 8 g (solid basis) |
| Resin Grain (AR-18) | 12 g (solid basis) |
| Charge Control Agent (CD-2) (1-octadecene/tert-octyl maleic monoamide (1/1 by molar ratio) copolymer) | 0.1 g |
| Silicone oil | 5 g |

-continued

| Dispersion of Resin (A) (TL-2) | |
|---|---|
| (KF-96 manufactured by Shin-Etsu Silicone K.K.) | |
| Isopar H | up to make 1 liter |

A toner image was then formed on the transfer layer (T) provided on the electrophotographic light-sensitive element by an electrophotographic process. Specifically, the electrophotographic light-sensitive element while maintaining its surface temperature at 50° C. was charged to +700 V with a corona discharge in dark and exposed to light using a semiconductor laser having an oscillation wavelength of 780 nm at an irradiation dose on the surface of electrophotographic light-sensitive element of 25 erg/cm$^2$ based on digital image data of an information same as in Example 1. The residual electric potential in the exposed area was +120 V.

The exposed electrophotographic light-sensitive element was subjected to development using Liquid Developer (LD-1) having the composition shown below while applying a bias voltage of +300 V to a development electrode of a developing device to thereby electrodeposit the toner particles on the exposed areas. The electrophotographic light-sensitive material was then rinsed in a bath of Isopar H alone to remove stains on the non-image areas.

Preparation of Liquid Developer (LD-1)

1) Synthesis of Toner Particles:

A mixed solution of 30 g of methyl methacrylate, 70 g of methyl acrylate, 20 g of a dispersion polymer having the structure shown below, and 680 g of Isopar H was heated to 65° C. under nitrogen gas stream with stirring. To the solution was added 1.2 g of 2,2'-azobis(isovaleronitrile) (abbreviated as AIVN), followed by reacting for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under a reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95% by weight, and the resulting dispersion had an average grain diameter of resin grain of 0.22 μm and good monodispersity.

Dispersion Polymer

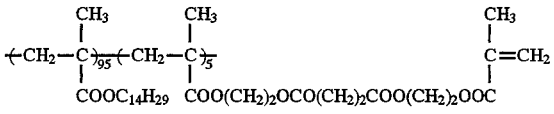

Mw $8\times10^4$

2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Toyo Seiki Seisakusho Co.) together with glass beads and dispersed for 4 hours to prepare a fine dispersion of nigrosine.

3) Preparation of Liquid Developer:

A mixture of 45 g of the above-prepared toner particle dispersion, 25 g of the above-prepared nigrosine dispersion, 0.2 g of a hexadecene/maleic acid monooctadecylamide (1/1 ratio by mole) copolymer, and 15 g of branched octadecyl alcohol (FOC-1800 manufactured by Nissan Chemical industries, Ltd.) was diluted with 1 l of Isopar G to prepare Liquid Developer (LD-1) for electrophotography.

On the toner image thus-formed, an adhesive layer (M) was provided by the electrodeposition coating method. Specifically, on the surface of electrophotographic light-sensitive element whose surface temperature was maintained at 50° C. , Dispersion of Resin (B) (ML-2) shown below was supplied using an electrodeposition unit for forming adhesive layer (M) 13M, while applying an electric voltage of +300 V to a development electrode in a manner similar to the formation of transfer layer (T) using Dispersion of Resin (a) (TL-2) thereby forming the adhesive layer having a thickness of 0.5 μm only on the toner image.

| Dispersion of Resin (B) (ML-2) | |
|---|---|
| Resin Grain (BR-2) | 20 g (solid basis) |
| Charge Control Agent (CD-1) | 0.08 g |
| Branched Tetradecyl Alcohol (FOC-1400 manufactured by Nissan Chemical Industries, Ltd.) | 10 g |
| Isopar G | up to make 1 liter |

Then, an aluminum substrate for FPO was passed between the drum of electrophotographic light-sensitive element whose surface temperature was maintained at 50° C. and a backup roller for transfer **17*b* adjusted at a surface temperature of 100° C. and a backup roller for release 17*c*** whose temperature was not controlled under the condition of a nip pressure of 4 Kgf/cm$^2$ and a drum circumferential speed of 100 mm/sec, whereby the toner image was transferred together with the transfer layer and the adhesive layer from the electrophotographic light-sensitive element to the aluminum substrate.

The duplicated image thus-obtained on the aluminum substrate of FPD was visually observed using an optical microscope of 200 magnifications. None of background stain was observed in the non-image portion and the duplicated image was excellent even in high definition regions or highly accurate image portions in that spread, cutting or distortion of fine lines such as lines of 10 μm in width and dots such as a range of from 2% to 98% in dots of 165 lines per inch were found. The transfer layer, toner image and adhesive layer were wholly transferred to the aluminum substrate without remains.

The printing plate precursor thus-obtained was subjected to a flash fixing method to sufficiently fix the toner image portion. Then, it was subjected to an oil-desensitizing treatment (i.e., removal of the transfer layer) to prepare a printing plate and its printing performance was evaluated. Specifically, the printing plate precursor was immersed in Oil-Desensitizing Solution (E-2) having the composition shown below at 35° C. for 20 seconds with mild rubbing of the surface of precursor with a fur brush to remove the transfer layer (T), thoroughly washed with water, and gummed to prepare an offset printing plate.

Oil-Desensitizing Solution (E-2)

A solution prepared by diluting PS plate processing solution (DP-4 manufactured by Fuji Photo Film Co., Ltd.) 60-fold with distilled water and adding 3 g of monoethanolamine (pH: 12.3)

The printing plate thus obtained was observed visually using an optical microscope of 200 magnifications. It was found that the non-image portion had no residual transfer layer, and the image portion suffered no defects (i.e., cutting of fine lines, fine letters and dots) in high definition regions or highly accurate image portions.

The printing plate was subjected to printing in the same manner as in Example 1. More than 60,000 prints of excellent image equivalent to the image formed on the printing plate precursor were obtained.

EXAMPLE 3

Impartation of releasability to the surface of electrophotographic light-sensitive element by the application of compound (S) in the apparatus conducting an electrophotographic process on the electrophotographic light-sensitive element was performed in the following manner in place of the dip method described in Example 2 above.

(1) For imparting releasability to the electrophotographic light-sensitive element, in an applying unit for compound (S) 10 of the apparatus as shown in FIG. 2, a metering roll having a silicone rubber layer on the surface thereof was brought into contact with a bath containing an oil of Compound (S-2) having the structure shown below on one side and with the electrophotographic light-sensitive element on the other side and they were rotated at a circumferential speed of 15 mm/sec for 20 seconds. As a result, the adhesion of the surface of electrophotographic light-sensitive element was 5 g·f.

Compound (S-2)

Carboxy-modified silicone oil

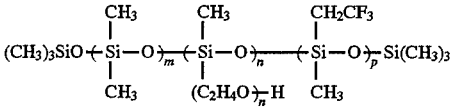

Further, a transfer roll having a styrenebutadiene rubber layer on the surface thereof was placed between the metering roll dipped in the silicone oil bath of Compound (S-2) and the electrophotographic light-sensitive element, and the treatment was conducted in the same manner as above. Good releasability of the surface of electrophotographic light-sensitive element similar to the above was obtained.

Moreover, in the above-described method of using the metering roll and transfer roll as a device for applying compound (S), Compound (S-2) was supplied between the metering roll and the transfer roll and the treatment was conducted in the same manner as above. Again, good result similar to the above was obtained.

(2) An AW-treated felt (material: wool having a thickness of 15 mm and a width of 20 mm) impregnated uniformly with 2 g of Compound (S-3), i.e., dimethyl silicone oil (KF-96L-2.0 manufactured by Shin-Etsu Silicone Co., Ltd.) was pressed under a pressure of 200 g on the surface of electrophotographic light-sensitive element and the electrophotographic light-sensitive element was rotated at a circumferential speed of 20 mm/sec for 30 seconds. The adhesion of the surface of electrophotographic light-sensitive element thus-treated was 5 g·f.

(3) A rubber roller having a heating means integrated therein and covered with cloth impregnated with Compound (S-4), i.e., fluorine-containing surface active agent (Sarflon S-141 manufactured by Asahi Glass Co., Ltd.) was heated to a surface temperature of 60° C., then brought into contact with the electrophotographic light-sensitive element and they were rotated at a circumferential speed of 20 mm/sec for 30 seconds. The adhesion of the surface of electrophotographic light-sensitive element thus-treated was 12 g·f.

(4) A silicone rubber roller comprising a metal axis covered with silicone rubber (manufactured by Kinyosha K.K.) was pressed on the electrophotographic light-sensitive element at a nip pressure of 500 g·f/cm$^2$and rotated at a circumferential speed of 15 mm/sec for 10 seconds. The adhesion of the surface of electrophotographic light-sensitive element thus-treated was 10 g·f.

Using the electrophotographic light-sensitive elements treated by these methods for the impartation of releasability to the surface thereof, the formation of transfer layer, formation of toner image, formation of adhesive layer, transfer of toner image to receiving material, preparation of printing plate and printing were conducted in the same manner as in Example 2. Good results similar to those in Example 2 were obtained.

EXAMPLE 4

A mixture of 1 g of X-form metal-free phthalocyanine (manufactured by Dainippon Ink and Chemicals, Inc.), 8 g of Binder Resin (P-3) having the structure shown below, 0.15 g of Compound (B) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion were added 2 g of Resin (PP-1) having the structure shown below, 0.03 g of phthalic anhydride and 0.01 g of zirconium acetylacetone, followed by further dispersing for 2 minutes. The glass beads were separated by filtration to prepare a dispersion for a light-sensitive layer.

Binder Resin (P-3)

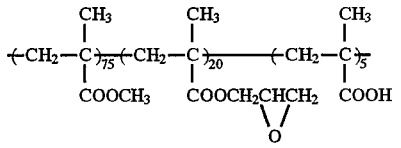

Mw 5 × 10$^4$

Compound (B)

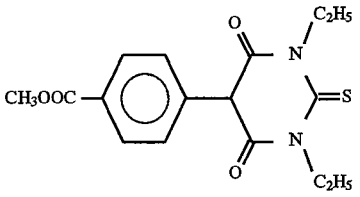

Resin (PP-1)

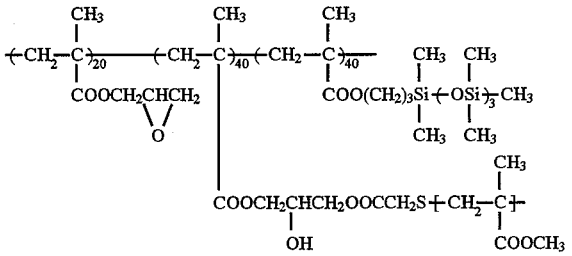

Mw 6 × 10$^4$ (Mw of graft portion 1.5 × 10$^4$)

The resulting dispersion was coated on an aluminum plate having a thickness of 0.2 mm, which had been subjected to degrease treatment, by a wire bar, set to touch, and heated in a circulating oven at 110° C. for seconds, and then further heated at 140° C. for one hour to form a light-sensitive layer having a thickness of 8 μm. The adhesion of the surface of the resulting electrophotographic light-sensitive element was 2 g·f.

For comparison, an electrophotographic light-sensitive element was prepared in the same manner as described above except for eliminating 2 g of Resin (PP-1) and using 10 g of Binder Resin (P-3). The adhesion of the surface thereof was 420 g·f and did not exhibit releasability at all.

The electrophotographic light-sensitive element having the surface of releasability was installed in an apparatus as shown in FIG. 2 as a light-sensitive element to form a first transfer layer ($T_1$) thereon. Specifically, on the surface of electrophotographic light-sensitive element whose surface temperature was adjusted to 55° C. and which was rotated at a circumferential speed of 100 mm/sec, Dispersion of Resin (A) (TL-3) containing positively charged resin grains shown below was supplied using a slit electrodeposition device, while putting the electrophotographic light-sensitive element to earth and applying an electric voltage of +100 V to an electrode of the slit electrodeposition device to cause the resin grains to electrodeposite and fix, whereby the first transfer layer ($T_1$) having a thickness of 0.5 μm was formed.

| Dispersion of Resin (A) (TL-3) | |
|---|---|
| Resin Grain (AR-10) | 20 g (solid basis) |
| Charge Control Agent (CD-3) (octadecyl vinyl ether/N-hexadecyl maleic monoamide/N-hexadecyl maleimide (5/3/2 by molar ratio) copolymer) | 0.06 g |
| Charge Adjuvant (AD-1) | 1.0 g |
| Isopar G | up to make 1 liter |

On the first transfer layer ($T_1$) was formed a second transfer layer ($T_2$) having a thickness of 0.5 μm in the same manner as in the formation of the first transfer layer ($T_1$) except for using Dispersion of Resin (A) (TL-4) shown below in place of Dispersion of Resin (A) (TL-3).

| Dispersion of Resin (A) (TL-4) | |
|---|---|
| Resin Grain (AR-18) | 20 g (solid basis) |
| Charge Control Agent (CD-3) | 0.07 g |
| Charge Adjuvant (AD-1) | 1.0 g |
| Isopar G | up to make 1 liter |

On the electrophotographic light-sensitive element having the transfer layer (T) of stratified structure whose surface temperature was maintained at 55° C., the formation of toner image and the formation of adhesive layer (M) were performed in the same manner as in Example 1.

Successively, a sheet of Straight Master (manufactured by Mitsubishi Paper Mills, Ltd.) as a receiving material was passed between the drum of electrophotographic light-sensitive element whose surface temperature was maintained at 55° C. and a backup roller for transfer adjusted at a temperature 100° C. and a back up roller for release whose temperature was not controlled under the condition of a nip pressure of 4.4 kgf/cm$^2$ and a drum circumferential speed of 100 mm/sec, whereby the toner image was transferred together with the transfer layer and the adhesive layer to the sheet of Straight Master. The toner image portion was then fixed on the sheet by a flash fixing method.

In the duplicated image obtained on the sheet of Straight Master, no stain was observed in the non-image portion and no defects (i.e., cutting of fine lines, fine letters and dots) in high definition regions or highly accurate image portions were found.

The printing plate precursor thus-obtained was immersed in Oil-Desensitizing Solution (E-3) having the composition shown below at 35° C. for 20 seconds with rubbing of the surface of precursor to remove the transfer layer (T) and thoroughly washed with water to obtain a lithographic printing plate.

| Oil-Desensitizing Solution (E-3) | |
|---|---|
| Ammonium sulfite | 20 g |
| Neosoap (manufactured by Matsumoto Yushi K.K.) | 2 g |
| Isopropyl alcohol | 30 g |
| Distilled water | up to make 1 liter |
| Sodium hydroxide | to adjust pH to 12.2 |

Using the resulting printing plate, printing was conducted in the same manner as in Example 1. More than 1,000 prints with highly accurate images free from background stain in the non-image portion similar to those in Example 1 were obtained.

EXAMPLES 5 TO 18

Each printing plate precursor was prepared in the same manner as in Example t except for using each of the resin grains shown in Table G below in place of Resin Grain (AR-1) for the transfer layer (T) and Resin Grain (BR-1) for the adhesive layer (M), respectively.

TABLE G

| Example | Resin Grain for Transfer Layer (weight ratio) | Resin Grain for Adhesive Layer |
|---|---|---|
| 5 | AR-2/AR-9 (80/20) | BR-3 |
| 6 | AR-3/AR-11(90/10) | BR-4 |
| 7 | ARW-2 | BR-6 |
| 8 | ARW-3 | BR-5 |
| 9 | ARW-4/AR-13 (90/10) | BR-7 |
| 10 | AR-16 | BR-19 |
| 11 | AR-6/AR-1 (30/70) | BR-8 |
| 12 | ARW-5 | BR-10 |
| 13 | ARW-6 | BR-11 |
| 14 | ARW-1/AR-4 (80/20) | BR-13 |
| 15 | AR-2/AR-8 (60/40) | BR-14 |
| 16 | AR-7 | BR-17 |
| 17 | AR-14/AR-21 (60/40) | BR-19/BR-2 (50/50) |
| 18 | AR-15/AR-17 (70/30) | BR-18/BR-11 (40/60) |

The duplicated image thus-obtained on the aluminum substrate of FPD was visually observed using an optical microscope of 200 magnifications. None of background stain was observed in the non-image portion and the duplicated image was excellent even in high definition regions or highly accurate image portions in that cutting or distortion of fine lines, fine letters and dots were not found. The transfer layer, toner image and adhesive layer were wholly transferred to the aluminum substrate without remains.

Each of the printing plate precursors described above was immersed in Oil-Desensitizing Solution (E-4) having the composition shown below at 35° C. for 25 seconds with moderate rubbing of the surface of precursor with a fur brush to remove the transfer layer, thoroughly washed with water, and gummed to obtain a lithographic printing plate.

| Oil-Desensitizing Solution (E-4) | |
|---|---|
| Monoethanolamine | 25 g |
| Benzyl alcohol | 20 g |
| Distilled water | up to make 1 liter |
| Sodium hydroxide | to adjust pH to 12.5 |

Each of the printing plate thus-prepared was observed visually using an optical microscope of 200 magnifications. It was found that the non-image portion had no residual transfer layer, and the image portion suffered no defects (i.e., cutting of fine lines, fine letters and dots) in high definition regions or highly accurate image portions.

The printing plate was subjected to printing in the same manner as in Example 1. As a result, more than 50,000 prints with clear images free from background stains were obtained irrespective of the kind of color ink.

EXAMPLE 19

A printing plate was prepared in the same manner as in Example 1 except for using the hot-melt coating method as shown below for the preparation of transfer layer (T) in place of the electrodeposition coating method.

Formation of Transfer Layer (T)

A mixture of Resin (A-1) having the structure shown below and Resin (A-2) having the structure shown below in a weight ratio of 1:1 was coated on the surface of electrophotographic light-sensitive element at a rate of 20 mm/sec by a hot-melt coater adjusted at 90° C. and cooled by blowing cool air from a suction/exhaust unit to form the transfer layer (T) and the surface temperature of electrophotographic light-sensitive element was maintained at 60° C. A thickness of the transfer layer was 2.0 μm.

Resin (A-1)

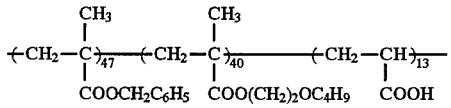

Mw $8 \times 10^3$, Tg 24° C.

Resin (A-2)

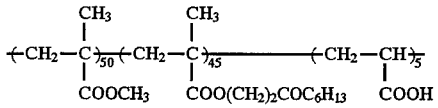

Mw $1.5 \times 10^4$, Tg 31° C.

Using the resulting printing plate, offset printing was conducted in the same manner as in Example 1. More than 60,000 prints with clear images free from background stains were obtained.

EXAMPLE 20

The formation of transfer layer on the electrophotographic light-sensitive element was performed by the transfer method from release paper using a device as shown in FIG. 4 instead of the electrodeposition coating method as described in Example 1. Specifically, on Separate Shi (manufactured by Oji Paper Co., Ltd.) as release paper 20, was coated a mixture of Resin (A-3) having the structure shown below and Resin (A-4) having the structure shown below in a weight ratio of 1:2 to prepare a transfer layer having a thickness of 2.5 μm. The resulting paper was brought into contact with the electrophotographic light-sensitive element same as described in Example 1 under the condition of a nip pressure of 3 Kgf/cm$^2$, a surface temperature of 60° C. and a transportation speed of 50 mm/sec, whereby the transfer layer (T) 12 having a thickness of 2.5 μm was formed on the electrophotographic light-sensitive element 11.

Resin (A-3)

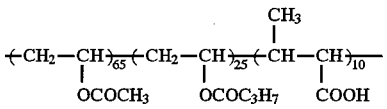

Mw 8 × 10$^4$, Tg 20° C.

Resin (A-4)

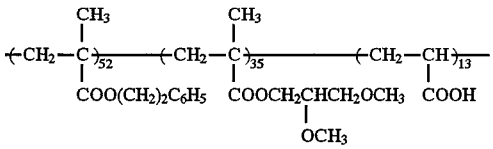

Mw 9 × 10$^3$, Tg 35° C.

Using the electrophotographic light-sensitive element having the transfer layer thus prepared, a printing plate was prepared, followed by conducting printing in the same manner as in Example 1. The image quality of prints obtained and printing durability were good as those in Example 1.

EXAMPLE 21

5 g of 4,4'-bis(diethylamino)-2,2'-dimethyltriphenylmethane as an organic photoconductive substance, 4 g of Binder Resin (P-4) having the structure shown below, 0.6 g of Resin (PP-2) having the structure shown below, 40 mg of Dye (D-1) having the structure shown below, and 0.2 g of Compound (A) described above as a chemical sensitizer were dissolved in a mixed 'solvent of 30 ml of methylene chloride and 30 ml of ethylene chloride to prepare a solution for light-sensitive layer.

Binder Resin (P-4)

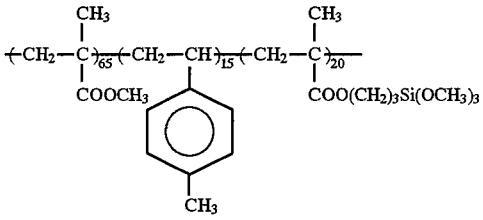

Mw 7 × 10$^4$

-continued

Binder Resin (PP-2)

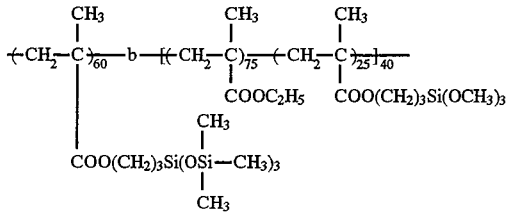

Mw 6 × 10$^4$ (-b-: a bond connecting blocks)

Dye (D-1)

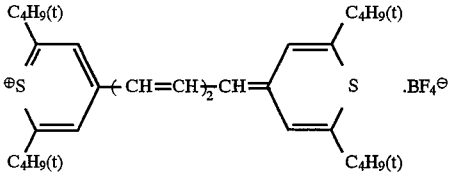

The resulting solution for light-sensitive layer was coated on a conductive transparent substrate composed of a 100 μm thick polyethylene terephthalate film having a deposited layer of indium oxide thereon (surface resistivity: $10^3$ Ω) by a wire round rod to prepare a light-sensitive element having an organic light-sensitive layer having a thickness of about 4 μm. The adhesion of the surface of electrophotographic light-sensitive element was 2 g·f.

The procedure same as in Example 1 was repeated except for using the resulting electrophotographic light-sensitive element in place of the electrophotographic light-sensitive element employed in Example 1 to prepare a printing plate. Using the printing plate, printing was conducted in the same manner as in Example 1. The prints obtained had clear images without the formation of background stain and printing durability of the printing plate was good similar to Example 1.

EXAMPLE 22

A mixture of 5 g of a bisazo pigment having the structure shown below, 95 g of tetrahydrofuran and 5 g of a polyester resin (Vylon 200 manufactured by Toyobo Co., Ltd.) was thoroughly pulverized in a ball mill. To the mixture was added 520 g of tetrahydrofuran with stirring. The resulting dispersion was coated on a conductive transparent substrate used in Example 21 by a wire round rod to prepare a charge generating layer having a thickness of about 0.7 μm.

Bisazo Pigment

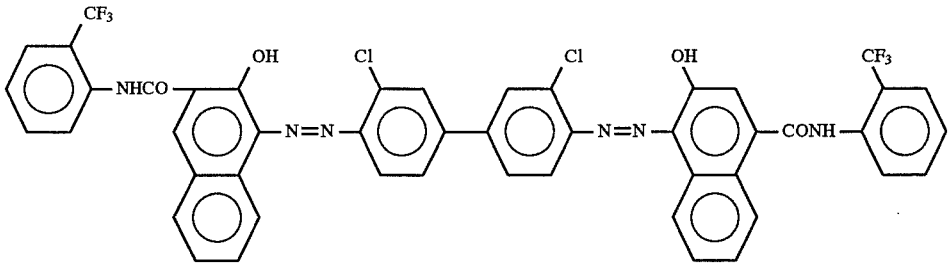

A mixed solution of 20 g of a hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive layer of a double-layered structure was prepared.

Hydrazone Compound

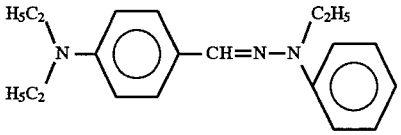

A mixed solution of 13 g of Resin (PP-3) having the structure shown below, 0.2 g of phthalic anhydride, 0.002 g of o-chlorophenol and 100 g of toluene was coated on the light-sensitive layer by a wire round rod, set to touch and heated at 140° C. for one hour to prepare a surface layer for imparting releasability having a thickness of 1 μm. The adhesion of the surface of the resulting light-sensitive element was 1 g·f.

Resin (PP-3)

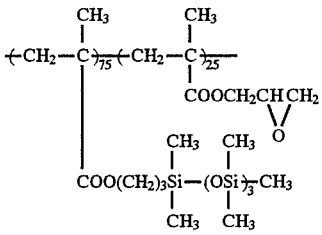

Mw $5 \times 10^4$

The resulting electrophotographic light-sensitive element was charged to a surface electric potential of −500 V in dark and exposed imagewise using a helium-neon laser of 633 nm at an irradiation dose on the surface of the electrophotographic light-sensitive element of 30 erg/cm$^2$, followed by conducting the same procedure as in Example 1 to prepare a printing plate. As a result of lithographic printing using the resulting printing plate in the same manner as in Example 1, the printing plate exhibited the good performance similar to that in Example 1.

EXAMPLE 23

A mixture of 100 g of photoconductive zinc oxide, 25 g of Binder Resin (P-5) having the structure shown below, 3 g of Resin (PP-4) having the structure shown below, 0.15 g of maleic anhydride, 0.01 g of Dye (D-2) having the structure shown below and 180 g of toluene was dispersed by a homogenizer (manufactured by Nippon Seiki K.K.) at a rotation of $9\times10^3$ r.p.m. for 10 minutes.

Binder Resin (P-5)

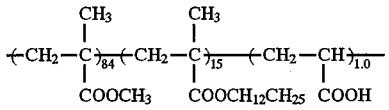

Mw $6 \times 10^4$

Resin (PP-4)

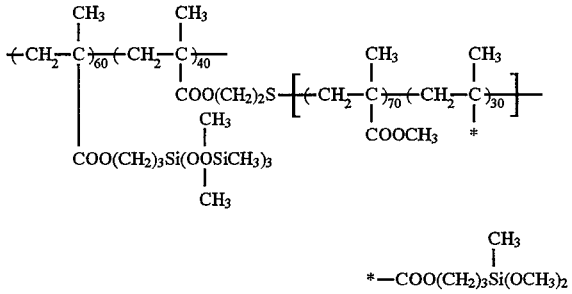

Mw $5 \times 10^4$ (Mw of graft portion $1.5 \times 10^4$)

Dye (D-2)

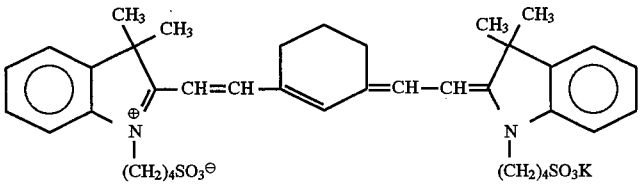

The resulting dispersion was coated on base paper for a paper master having a thickness of 0.2 mm, which had been subjected to electrically conductive treatment and solvent-resistant treatment, by a wire bar at a coverage of 20 g/m$^2$, and heated at 110° C. for 15 seconds. The adhesion of the surface of the thus-obtained electrophotographic light-sensitive element was 2 g·f.

For comparison, an electrophotographic light-sensitive element was prepared in the same manner as described above except for eliminating 3 g of Resin (PP-4). The adhesion of the surface thereof was more than 400 gf.

On the electrophotographic light-sensitive element was provided a transfer layer (T) by the electrodeposition coating method in the following manner.

Using Dispersion of Resin (A) (TL-5) shown below, resin grains were electrodeposited while applying an electric voltage of −150 V to the electrophotographic light-sensitive element to form the transfer layer (T) having a thickness of 1.5 μm.

| Dispersion of Resin (A) (TL-5) | |
|---|---|
| Resin Grain (ARW-2) | 20 g (solid basis) |
| Charge Control Agent (CD-3) | 0.06 g |
| Branched Tetradecyl Alcohol (FOC-1400 manufactured by Nissan Chemical Industries, Ltd.) | 15 g |
| Isopar G | up to make 1 liter |

The electrophotographic light-sensitive element having the transfer layer (T) provided thereon was charged to a surface electric potential of −600 V in dark, exposed to light using a semiconductor laser imaging device having an oscillation wavelength of 830 nm, developed with a liquid developer (ELP-T toner manufactured by Fuji Photo Film Co., Ltd.) while applying a bias voltage of −100 V to a developing unit, rinsed in a bath of Isopar G, and the toner image was fixed by a heat roll.

Then, the electrophotographic light-sensitive element bearing the toner image was again charged with a corona charger. As a result, surface electric potentials of the toner image portion and non-image portion were −700 V and −550 V respectively. On the surface of electrophotographic light-sensitive element, Dispersion of Resin (B) (ML-3) containing resin grains shown below was supplied using a slit electrodeposition unit while applying an electric voltage of −650 V to a development electrode, whereby the resin grains were selectively electrodeposited on the toner image, followed by passing under a suction/exhaust unit and a heating means to dry. Thus, an adhesive layer (M) composed of Resin (B) having a thickness of 0.5 μm was formed only on the toner image.

| Dispersion of Resin (B) (ML-3) | |
|---|---|
| Resin Grain (BR-4) | 20 g (solid basis) |
| Charge Control Agent (CD-3) | 0.06 g |
| Branched Tetradecyl Alcohol (FOC-1400 manufactured by Nissan Chemical Industries, Ltd.) | 15 g |
| Isopar G | up to make 1 liter |

Successively, a sheet of Straight Master (manufactured by Mitsubishi Paper Mills, Ltd.) as a receiving material was passed between the drum of electrophotographic light-sensitive element whose surface temperature was maintained at 50° C. and a backup roller for transfer adjusted at a temperature of 90° C. and a backup roller for release whose temperature was not controlled under the condition of a nip pressure of 3 Kgf/cm$^2$ and a drum circumferential speed of 150 mm/sec, and separated from the electrophotographic light-sensitive element, whereby the transfer layer (T), toner image and adhesive layer (M) were wholly transferred to the sheet of Straight Master.

As a result of visual evaluation of the image transferred on the Straight Master, it was found that the transferred image was almost same as the duplicated image on the electrophotographic light-sensitive element before transfer and degradation of image was not observed. Also, on the surface of the electrophotographic light-sensitive element after the transfer, the residue of the transfer layer was not observed at all. These results indicated that the transfer had been completely performed.

Then, the sheet of Straight Master having the toner image, i.e., printing plate precursor was subjected to an oil-desensitizing treatment to prepare a printing plate and its printing performance was evaluated. Specifically, the printing plate precursor was immersed in Oil-Desensitizing Solution (E-5) having the composition shown below at 35° C. for 20 seconds with moderate brushing to remove the transfer layer and thoroughly washed with water to obtain a printing plate.

| Oil-Desensitizing Solution (E-5) | |
|---|---|
| DP-4 (manufactured by Fuji Photo Film Co., Ltd.) | 20 g |
| Neosoap (manufactured by Matsumoto Yushi K.K.) | 1 g |
| Benzyl alcohol | 10 g |
| Distilled water | up to make 1 l |
| Sodium hydroxide | to adjust pH to 12.5 |

The printing plate thus-obtained was observed visually using an optical microscope of 200 magnifications. It was found that the non-image portin had no residual transfer layer, and the image portion was excellent even in high definition regions or highly accurate image portions in that cutting, spread or distortion of fine lines such as lines of 10 μm in width, fine letters such as 3.0 point size of Ming-zhao character and dots such as a range from 2% to 98% in dots of 150 lines per inch were not recognized.

The printing plate was subjected to printing on neutral paper with various offset printing color inks using an offset printing machine (Ryobi 3200 MCD Model manufactured by Ryobi Ltd.), and an aqueous solution (pH: 7.0) prepared by diluting dampening water for PS plate (SG-23 manufactured by Tokyo Ink K.K.) 130-fold with distilled water, as dampening water. As a result, more than 1,000 prints with clear images free from background stains were obtained irrespective of the kind of color ink.

In a conventional system wherein an electrophotographic light-sensitive element utilizing zinc oxide is oil-desensitized with an oil-desensitizing solution containing a chelating agent as the main component under an acidic condition to prepare a lithographic printing plate, printing durability of the plate is in a range of several hundred prints without the occurrence of background stain in the non-image area when neutral paper are used for printing or when offset printing color inks other than black ink are employed. Contrary to the conventional system, the method for preparation of a printing plate by an electrophotographic process according to the present invention can provide a printing plate having excellent printing performance in spite of using a zinc oxide-containing light-sensitive element.

EXAMPLES 24 TO 29

Each printing plate was prepared and offset printing was conducted using the resulting printing plate in the same manner as in Example 2 except for employing each of the compounds (S) shown in Table H below in place of 1.0 g/l of Compound (S-1) employed in Example 2.

The results obtained were similar to those in Example 2. Specifically, the releasability was effectively imparted on the surface of electrophotographic light-sensitive element using each of the compounds (S).

TABLE H

| Example | | Compound (S) | Amount (g/l) |
|---|---|---|---|
| 24 | (S-5) | Higher fatty acid-modified silicone (TSF 411 manufactured by Toshiba Silicone Co., Ltd.) 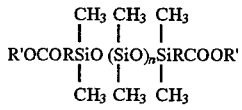 (presumptive structure) | 1 |
| 25 | (S-6) | Carboxy-modified silicone (X-22-3701E manufactured by Shin-Etsu Silicone Co., Ltd.) 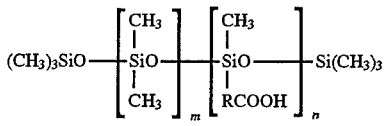 (presumptive structure) | 0.5 |
| 26 | (S-7) | Carbinol-modified silicone (X-22-176B manufactured by Shin-Etsu Silicone Co., Ltd.) | |

TABLE H-continued

| Example | | Compound (S) | Amount (g/l) |
|---|---|---|---|
| | | 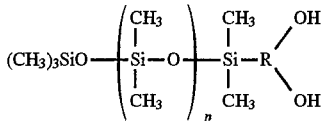 (presumptive structure) | 1 |
| 27 | (S-8) | Mercapto-modified silicone (X-22-167B manufactured by Shin-Etsu Silicone Co., Ltd.) | |
| | | 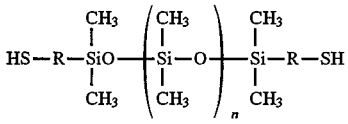 (presumptive structure) | 2 |
| 28 | (S-9) | 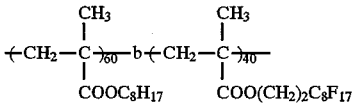 Mw $6 \times 10^3$ | 1.5 |
| 29 | (S-10) | 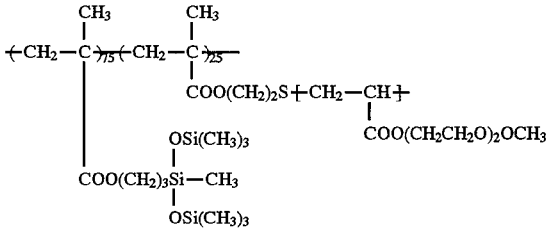 Mw $8 \times 10^3$ (Mw of graft portion $3 \times 10^3$) | 2 |

EXAMPLES 30 TO 41

Offset printing plates were prepared by subjecting some of the printing plate precursors prepared in the foregoing examples to the following oil-desensitizing treatment. Specifically, to 0.2 moles of each of the nucleophilic compounds shown in Table I below, 30 g of each of the organic compounds shown in Table I below, and 2 g of Newcol B4SN (manufactured by Nippon Nyukazai K.K.) was added distilled water to make one liter, and the solution was adjusted to a pH of 12.5. Each printing plate precursor was immersed in the resulting treating solution at a temperature of 30° C. for 20 seconds with moderate rubbing to remove the transfer layer.

Printing was carried out using the resulting printing plate under the same conditions as in Example 1. Each printing plate exhibited good characteristics similar to those in Example 1.

TABLE I

| Example | Basis Example for Printing Plate Precursor | Nucleophilic Compound | Organic Compound |
|---|---|---|---|
| 30 | Example 5 | Sodium sulfite | N,N-Dimethylformamide |
| 31 | Example 6 | Monoethanolamine | Sulfolane |
| 32 | Example 8 | Diethanolamine | Polyethylene glycol |
| 33 | Example 9 | Thiomalic acid | Ethylene glycol dimethyl ether |
| 34 | Example 11 | Thiosalicylic acid | Benzyl alcohol |
| 35 | Example 14 | Taurine | Diethylene glycol monomethyl ether |
| 36 | Example 15 | 4-Sulfobenzenesulfinic acid | Glycerin |
| 37 | Example 17 | Thioglycolic acid | Tetramethylurea |
| 38 | Example 18 | 2-Mercaptoethylphosphonic acid | Dioxane |
| 39 | Example 23 | Cysteine | N-Methylacetamide |
| 40 | Example 7 | Sodium thiosulfate | Polypropylene glycol |
| 41 | Example 16 | Ammonium sulfite | N,N-Dimethylacetamide |

While the invention has been described in detail and with reference to specific embodiments thereof, it will be apparent to one skilled in the art that various changes and modifications can be made therein without departing from the spirit and scope thereof.

What is claimed is:

1. A method for preparation of a printing plate by an electrophotographic process comprising providing a peelable transfer layer (T) containing a resin (A) capable of being removed upon a chemical reaction treatment on an electrophotographic light-sensitive element, forming a toner image on the transfer layer by an electrophotographic process, providing an adhesive layer (M) containing a thermoplastic resin (B) only on the toner image, transferring the toner image together with the transfer layer (T) and the adhesive layer (M) from the electrophotographic light-sensitive element to a receiving material having a surface capable of providing a hydrophilic surface suitable for lithographic printing at the time of printing, and then removing the transfer layer (T) on the receiving material by the chemical reaction treatment.

2. A method for preparation of a printing plate by an electrophotographic process as claimed in claim 1, wherein a surface of the electrophotographic light-sensitive element has an adhesion of not more than 50 gram·force at the time for the formation of transfer layer (T).

3. A method for preparation of a printing plate by an electrophotographic process as claimed in claim 2, wherein the electrophotographic light-sensitive element comprises amorphous silicon as a photoconductive substance.

4. A method for preparation of a printing plate by an electrophotographic process as claimed in claim 2, wherein the electrophotographic light-sensitive element contains a polymer having a polymer component containing at least one of a silicon atom and a fluorine atom in the region near to the surface thereof.

5. A method for preparation of a printing plate by an electrophotographic process as claimed in claim 4, wherein the polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks.

6. A method for preparation of a printing plate by an electrophotographic process as claimed in claim 4, wherein the polymer further contains a polymer component containing a photo- and/or heat-curable group.

7. A method for preparation of a printing plate by an electrophotographic process as claimed in claim 5, wherein the polymer further contains a polymer component containing a photo- and/or heat-curable group.

8. A method for preparation of a printing plate by an electrophotographic process as claimed in claim 4, wherein the electrophotographic light-sensitive element further contains a photo- and/or heat-curable resin.

9. A method for preparation of a printing plate by an electrophotographic process as claimed in claim 2, wherein the electrophotographic light-sensitive element is an electrophotographic light-sensitive element to the surface of which a compound (S) which contains a fluorine atom and/or a silicon atom has been applied.

10. A method for preparation of a printing plate by an electrophotographic process as claimed in claim 1, wherein the transfer layer is peelable from the light-sensitive element at a temperature of not more than 100° C. or at a pressure of not more than 15 Kgf/cm$^2$.

11. A method for preparation of a printing plate by an electrophotographic process as claimed in claim 1, wherein the resin (A) has a glass transition point of not more than 80° C. or a softening point of not more than 100° C.

12. A method for preparation of a printing plate by an electrophotographic process as claimed in claim 1, wherein the resin (A) contains at least one polymer component selected from polymer component (a) containing at least one group selected from the group consisting of a $-CO_2H$ group, a -CHO group, $-SO_3H$ group, a $-SO_2H$ group, a $-P(=O)(OH)R^1$ group (wherein $R^1$ is a -OH group, a hydrocarbon group or a $-OR^2$ group (wherein $R^2$ represents a hydrocarbon group)), a phenolic hydroxy group, a cyclic acid anhydride-containing group, a $-CONHCOR^3$ group (wherein $R^3$ represents a hydrocarbon group) and a $-CONHSO_2R^3$ group, and polymer component (b) containing at least one functional group capable of forming at least one group selected from the group consisting of a $-CO_2H$ group, a -CHO group, a $-SO_3H$ group, a $-SO_2H$ group, a $-P(=O)(OH)R^1$ group and a -OH group upon a chemical reaction.

13. A method for preparation of a printing plate by an electrophotographic process as claimed in claim 12, wherein the resin (A) further contains a polymer component corresponding to the repeating unit represented by the following general formula (U):

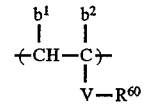

(U)

wherein V is -COO-, -OCO-, -O-, -CO-, $-C_6H_4-$, $-(CH_2-)_nCOO-$ or $-(CH_2-)_nOCO-$; n represents an integer of from 1 to 4; $R^{60}$ represents a hydrocarbon group having from 1 to 22 carbon atoms; and $b^1$ and $b^2$, which may be the same or different, each is a hydrogen atom, a fluorine atom, a chlorine atom, a bromine atom, a cyano group, a trifluoromethyl group, a hydrocarbon group having from 1 to 7 carbon atoms or $-COOZ^{11}$ (wherein $Z^{11}$ represents a hydrocarbon group having from 1 to 7 carbon atoms).

14. A method for preparation of a printing plate by an electrophotographic process as claimed in claim 12, wherein the resin (A) further contains a polymer component (f) containing a moiety having at least one of a fluorine atom and a silicon atom.

15. A method for preparation of a printing plate by an electrophotographic process as claimed in claim 14, wherein the polymer component (f) is present as a block in the resin (A).

16. A method for preparation of a printing plate by an electrophotographic process as claimed in claim 11, wherein the transfer layer (T) contains a resin (AH) having a glass transition point of from 28° C. to 80° C. or a softening point of from 35° C. to 100° C. and a resin (AL) having a glass transition point of not more than 30° C. or a softening point of not more than 30° C. in which the glass transition point or softening point of the resin (AL) is at least 2° C. lower than that of the resin (AH).

17. A method for preparation of a printing plate by an electrophotographic process as claimed in claim 11, wherein the transfer layer is composed of a first transfer layer ($T_1$) adjacent to the electrophotographic light-sensitive element containing a resin (AH) having a glass transition point of from 28° C. to 80° C. or a softening point of from 35° C. to 100° C. and a second transfer layer ($T_2$) adjacent to the receiving material containing a resin (AL) having a glass transition point of not more than 30° C. or a softening point of not more than 30° C. in which the glass transition point or softening point of the resin (AL) is at leash 2° C. lower than that of the resin (AH).

18. A method for preparation of a printing plate by an electrophotographic process as claimed in claim 1, wherein the transfer layer (T) is provided by a hot-melt coating method.

19. A method for preparation of a printing plate by an electrophotographic process as claimed in claim 1, wherein the first transfer layer (T) is provided by an electrodeposition coating method.

20. A method for preparation of a printing plate by an electrophotographic process as claimed in claim 1, wherein the first transfer layer (T) is provided by a transfer method from a releasable support.

21. A method for preparation of a printing plate by an electrophotographic process as claimed in claim 19, wherein the electrodeposition coating method is carried out using grains comprising the resin (A) supplied as a dispersion thereof in an electrically insulating solvent having an electric resistance of not less than $10^8$ Ω·cm and a dielectric constant of not more than 3.5.

22. A method for preparation of a printing plate by an electrophotographic process as claimed in claim 19, wherein the electrodeposition coating method is carried out using grains comprising the resin (A) which are supplied between the electrophotographic light-sensitive element and an electrode placed in face of the electrophotographic light-sensitive element, and migrated by electrophoresis according to a potential gradient applied from an external power source to cause the grains to adhere to or electrodeposit on the electrophotographic light-sensitive element, thereby forming a film.

23. A method for preparation of a printing plate by an electrophotographic process as claimed in claim 21, wherein the grains contains a resin (AH) having a glass transition point of from 28° C. to 80° C. or a softening point of from 35° C. to 100° C. and a resin (AL) having a glass transition point of not more than 30° C. or a softening point of not more than 30° C. in which the glass transition point or softening point of the resin (AL) is at least 2° C. lower than that of the resin (AH).

24. A method for preparation of a printing plate by an electrophotographic process as claimed in claim 23, wherein the grains have a core/shell structure.

25. A method for preparation of a printing plate by an electrophotographic process as claimed in claim 1, wherein the electrophotographic process comprises a scanning exposure system using a laser beam based on digital information and a development system using a liquid developer.

26. A method for preparation of a printing plate by an electrophotographic process as claimed in claim 1, wherein the thermoplastic resin (B) has a glass transition point or softening point at least 2° C. lower than a glass transition point or softening point of the resin (A) used in the transfer layer (T).

27. A method for preparation of a printing plate by an electrophotographic process as claimed in claim 1, wherein the adhesive layer (M) is provided by an electrodeposition coating method on the toner image.

28. A method for preparation of a printing plate by an electrophotographic process as claimed in claim 1, wherein the adhesive layer (M) is provided by an electrodeposition coating method on the transfer image.

29. A method for preparation of a printing plate by an electrophotographic process as claimed in claim 1, wherein before the formation of transfer layer, a compound (S) containing a fluorine atom and/or a silicon atom is applied to a surface of the electrophotographic light-sensitive element.

30. A method for preparation of a printing plate by an electrophotographic process as claimed in claim 21, wherein the dispersion of resin grains further contains a compound (S) which containing a fluorine atom and/or a silicon atom.

* * * * *